US012441532B2

(12) United States Patent
Narahara et al.

(10) Patent No.: US 12,441,532 B2
(45) Date of Patent: Oct. 14, 2025

(54) CONSTANT-TEMPERATURE TRANSPORT CONTAINER AND THERMAL-STORAGE MEDIUM PACKAGE LINKER

(71) Applicants: KANEKA CORPORATION, Osaka (JP); TAMAIKASEI CO., LTD., Hokkaido (JP)

(72) Inventors: Risa Narahara, Osaka (JP); Masatada Sakai, Hokkaido (JP); Yuka Sekiya, Hokkaido (JP)

(73) Assignees: KANEKA CORPORATION, Osaka (JP); TAMAIKASEI CO., LTD., Hokkaido (JP)

( * ) Notice: Subject to any disclaimer, the term of this patent is extended or adjusted under 35 U.S.C. 154(b) by 225 days.

(21) Appl. No.: 18/202,689

(22) Filed: May 26, 2023

(65) Prior Publication Data

US 2023/0294902 A1 Sep. 21, 2023

Related U.S. Application Data

(63) Continuation of application No. PCT/JP2021/043455, filed on Nov. 26, 2021.

(30) Foreign Application Priority Data

Nov. 27, 2020 (JP) ..... 2020-197328
Nov. 27, 2020 (JP) ..... 2020-197329
Nov. 27, 2020 (JP) ..... 2020-197330

(51) Int. Cl.
*B65D 81/38* (2006.01)
*B65D 25/02* (2006.01)
(Continued)

(52) U.S. Cl.
CPC ..... *B65D 81/3823* (2013.01); *B65D 25/02* (2013.01); *F25D 3/06* (2013.01);
(Continued)

(58) Field of Classification Search
CPC ..... B65D 81/3823; B65D 25/02; B65D 81/3818; B65D 19/06; B65D 2519/00273;
(Continued)

(56) References Cited

U.S. PATENT DOCUMENTS 6,266,972 B1 * 7/2001 Bostic ..... B65D 81/3823 62/530
9,180,998 B2 11/2015 Banks et al.
(Continued)

FOREIGN PATENT DOCUMENTS

CN 204096253 U 1/2015
EP 2699481 B1 11/2015
(Continued)

OTHER PUBLICATIONS

Extended European Search Report issued in European Application No. 21898113.2, dated Oct. 2, 2024 (8 pages).
(Continued)

*Primary Examiner* — Don M Anderson
*Assistant Examiner* — John Martin Hoppmann
(74) *Attorney, Agent, or Firm* — Osha Bergman Watanabe & Burton LLP

(57) ABSTRACT

In order to prevent external air from flowing into the insides of side wall panels and to efficiently set heat storage materials into the side wall panels, a constant-temperature transport container includes side wall panels. The side wall panels are configured such that insertion corners are formed by side surfaces, and the side surfaces being arranged adjacent to each other with insertion openings being exposed to an outside. The side wall panels are connected to each other via side surfaces opposite to the insertion corners. Each of the insertion corners is provided with a fitting corner configured to be fitted to the side surfaces provided with the insertion openings.

12 Claims, 22 Drawing Sheets

(51) Int. Cl.
*F25D 3/06* (2006.01)
*F25D 11/00* (2006.01)
*F25D 23/06* (2006.01)

(52) U.S. Cl.
CPC ..... *F25D 11/006* (2013.01); *F25D 23/063* (2013.01); *F25D 2303/084* (2013.01)

(58) Field of Classification Search
CPC ..... B65D 81/3813; B65D 81/382; B65D 81/383; B65D 81/3832; B65D 81/3825; B65D 81/38; F25D 3/06; F25D 2303/084; F25D 11/006; F25D 23/063; F25D 2303/0843; A61J 1/165; F28D 20/0056
See application file for complete search history.

(56) References Cited

U.S. PATENT DOCUMENTS

| | | | | |
|---|---|---|---|---|
| 10,337,784 | B2 | 7/2019 | Mills et al. | |
| 10,568,808 | B2 | 2/2020 | Ferracamo, Jr. | |
| 10,661,969 | B2 | 5/2020 | Pranadi et al. | |
| 2014/0091098 | A1 | 4/2014 | Casoli | |
| 2016/0362240 | A1* | 12/2016 | Ferracamo, Jr. ..... | A61J 1/165 |
| 2019/0110440 | A1* | 4/2019 | Fuchs ..... | B32B 7/05 |
| 2019/0137160 | A1* | 5/2019 | Larsen ..... | F25D 3/08 |
| 2020/0039687 | A1 | 2/2020 | Kuhn et al. | |

FOREIGN PATENT DOCUMENTS

| | | | |
|---|---|---|---|
| JP | S63188481 | U | 12/1988 |
| JP | 2002243340 | A | 8/2002 |
| JP | 2015178931 | A | 10/2015 |
| JP | 2018179308 | A | 11/2018 |
| JP | 2019163079 | A | 9/2019 |
| JP | 2020059553 | A | 4/2020 |
| JP | 2020-164241 | A | 10/2020 |
| WO | 2006082433 | A1 | 8/2006 |
| WO | 2014125878 | A1 | 8/2014 |

OTHER PUBLICATIONS

International Search Report issued in corresponding International Application No. PCT/JP2021/043455, mailed Feb. 1, 2022, with translation (4 pages).
Written Opinion issued in corresponding International Application No. PCT/JP2021/043455, mailed Feb. 1, 2022, with translation in the form of the International Preliminary Report on Patentability (9 pages).
Office Action issued in corresponding Chinese Patent Application No. 202180078731.6, dated Jun. 4, 2025, with translation (18 pages).

* cited by examiner

CONSTANT-TEMPERATURE TRANSPORT CONTAINER AND THERMAL-STORAGE MEDIUM PACKAGE LINKER

TECHNICAL FIELD

One or more embodiments of the present invention relate to a constant-temperature transport container and a connected body for a heat storage material package.

BACKGROUND

A method of transporting or storing articles such as pharmaceutical products, medical devices, cells, specimens, organs, chemical substances, foods, and the like in a state in which the articles are kept cooled or warm may be, for example, as follows. That is, a cold storage material or a heat storage material having been frozen or solidified in advance is placed in a container having a heat insulating property, so as to prepare a cold-insulated transporting container or a heat-insulated transporting container. Then, by using melting latent heat of the cold storage material or solidification latent heat of the heat storage material, an article housed in the heat-insulated transporting container is transported or stored with the temperature of the article maintained. To maintain the above-described article to be kept warm (hereinafter, which may also be referred to as a "temperature-keeping target article") within a given temperature (hereinafter, which may also be referred to as a "controlled temperature") range for a long time, it is considered preferable to use a constant-temperature transport container including (i) a cold storage material having a melting temperature in the given temperature range or a heat storage material having a melting temperature in the given temperature range and (ii) a container having a heat insulating property. Typically, a temperature-keeping target article is transported in the form of a constant-temperature transport package including a constant-temperature transport container in which the temperature-keeping target article is packed.

Recently, in the field of the constant-temperature transport package, there has been proposed a technique of mounting, in a constant-temperature transport package, a pallet prepared to include a temperature-keeping target article mounted thereon. This technique requires a pallet-in-pallet shipper. However, in order to make it possible to mount, on the constant-temperature transport package, the pallet including the temperature-keeping target article mounted thereon, the constant-temperature transport package is necessarily increased in size. Further, along with the increase in size, the number of heat storage materials to be mounted on the constant-temperature transport package also increases. Moreover, in a case where side wall panels are configured such that heat storage materials are inserted thereinto from above, if the size of the side wall panels increases, the heights of the side wall panels also increase and accordingly it is difficult for a user to set the heat storage material from above the side wall panels. Furthermore, if the side wall panels and a ceiling panel in which the heat storage materials are housed are to be moved, it is difficult to handle the side wall panels and the ceiling panel, since such panels are very heavy due to the heat storage materials.

As a technique for solving the above that may occur when the heat storage materials are inserted from above the side wall panels, for example, Patent Literatures 1 and 2 disclose a constant-temperature transport container configured such that heat storage materials can be inserted thereinto from lateral sides of side wall panels.

Patent Literatures 3 and 4 disclose a constant-temperature transport container configured such that heat storage materials are inserted, in an up-down direction, into side wall panels (hereinafter, such a structure may also be referred to as a "vertical-insertion-type" structure). Patent Literature 5 discloses a constant-temperature transport container configured such that heat storage materials are inserted, in a horizontal direction, into side wall panels (hereinafter, such a structure may also be referred to as a "lateral-insertion-type" structure).

Further, recently, in the field of the constant-temperature transport package, the workability of packing of heat storage materials is sometimes emphasized. As a method for improving the workability of packing of heat storage materials, a connected body including heat storage material packages or cold storage material packages connected to each other can be employed. This can significantly reduce the required time for packing.

A conventional connected body of heat storage material packages or cold storage material packages is disclosed in Patent Literatures 6 and 7, for example.

Patent Literature 6 discloses, as a connected body of heat storage material packages, a connected body including a belt-like sheet having a plurality of storage pockets respectively having heat storage materials housed therein. When the connected body of Patent Literature 6 is in use, the connected body is wound around an article whose temperature is to be maintained.

Patent Literature 7 discloses a connected body including cold storage plates as heat storage material packages. Each of the cold storage plates includes a freezable refrigerant. Patent Literature 7 discloses a cold storage body including a plurality of cold storage plates connected to each other via hinges. The plurality of cold storage plates are connected to each other such that the cold storage plates are turnable at the connecting parts at least by 180 degrees. The cold storage body of Patent Literature 7 is configured to allow make a selection between (i) a state where the cold storage plates are multiplied and (ii) a state where the cold storage plates are unfolded, when cooling is carried out with use of the cold storage bodies or the refrigerants of the cold storage bodies are frozen.

PATENT LITERATURE

Patent Literature 1
Specification of European Patent Application Publication No. 2699481
Patent Literature 2
Specification of U.S. patent Ser. No. 10/661,969
Patent Literature 3
Specification of U.S. patent Ser. No. 10/568,808
Patent Literature 4
Specification of U.S. Pat. No. 9,180,998
Patent Literature 5
Japanese Patent Application Publication Tokukai No. 2015-178931
Patent Literature 6
Specification of U.S. patent Ser. No. 10/337,784
Patent Literature 7
Japanese Patent Application Publication Tokukai No. 2018-179308

However, the techniques of Patent Literatures 1 to 7 leave room for improvement in terms of prevention of a phenomenon that external air flows into the insides of the side wall panels. Further, the techniques of Patent Literatures 1 to 7 leave room for improvement also in terms of enhancement of the efficiency of setting heat storage materials into the side wall panels.

SUMMARY

An aspect of one or more embodiments of the present invention is to provide a constant-temperature transport container capable of (i) preventing external air from flowing into the insides of side wall panels and (ii) efficiently setting heat storage materials into the side wall panels.

In order to attain the above, a constant-temperature transport container in accordance with an aspect of one or more embodiments of the present invention is a constant-temperature transport container that is assembled and that keeps a temperature of a temperature-keeping target article at a constant temperature, the constant-temperature transport container including: four side wall panels; a ceiling panel; and a bottom panel, each of the four side wall panels including at least one first housing part within which a heat storage material is to be housed and a first insertion opening which is provided in a side surface of the side wall panel and through which the heat storage material is to be inserted into the first housing part, the four side wall panels being configured such that: the four side wall panels form first insertion corners for the heat storage materials, each of the first insertion corners being formed by the side surfaces, each provided with the first insertion opening, of two side wall panels among the four side wall panels, the side surfaces of the two side wall panels being arranged adjacent to each other with the first insertion openings being exposed to an outside; the number of first insertion corners is two, and the two first insertion corners are formed to face each other; the side wall panels are connected to each other via side surfaces of the side wall panels which side surfaces are opposite to the two first insertion corners; and each of the two first insertion corners is provided with a first fitting corner configured to close the first insertion openings and to be fitted to the side surfaces provided with the first insertion openings.

In accordance with an aspect of one or more embodiments of the present invention, it is possible (i) to prevent external air from flowing into the insides of side wall panels and (ii) to efficiently set heat storage materials into the side wall panels.

BRIEF DESCRIPTION OF THE DRAWINGS

FIG. 26A (2601) is a perspective view illustrating an internal configuration of each of the constant-temperature transport containers. FIG. 26B (2602) is a perspective view illustrating a configuration of each of the side wall panels of the constant-temperature transport containers used in Examples 2 and 3 and Reference Example 1. FIG. 26C (2603) is a perspective view illustrating a configuration of each of the side wall panels of the constant-temperature transport containers used in Comparative Examples 3 and 4 and Reference Example 2.

DETAILED DESCRIPTION OF THE EMBODIMENTS

Figure 1:
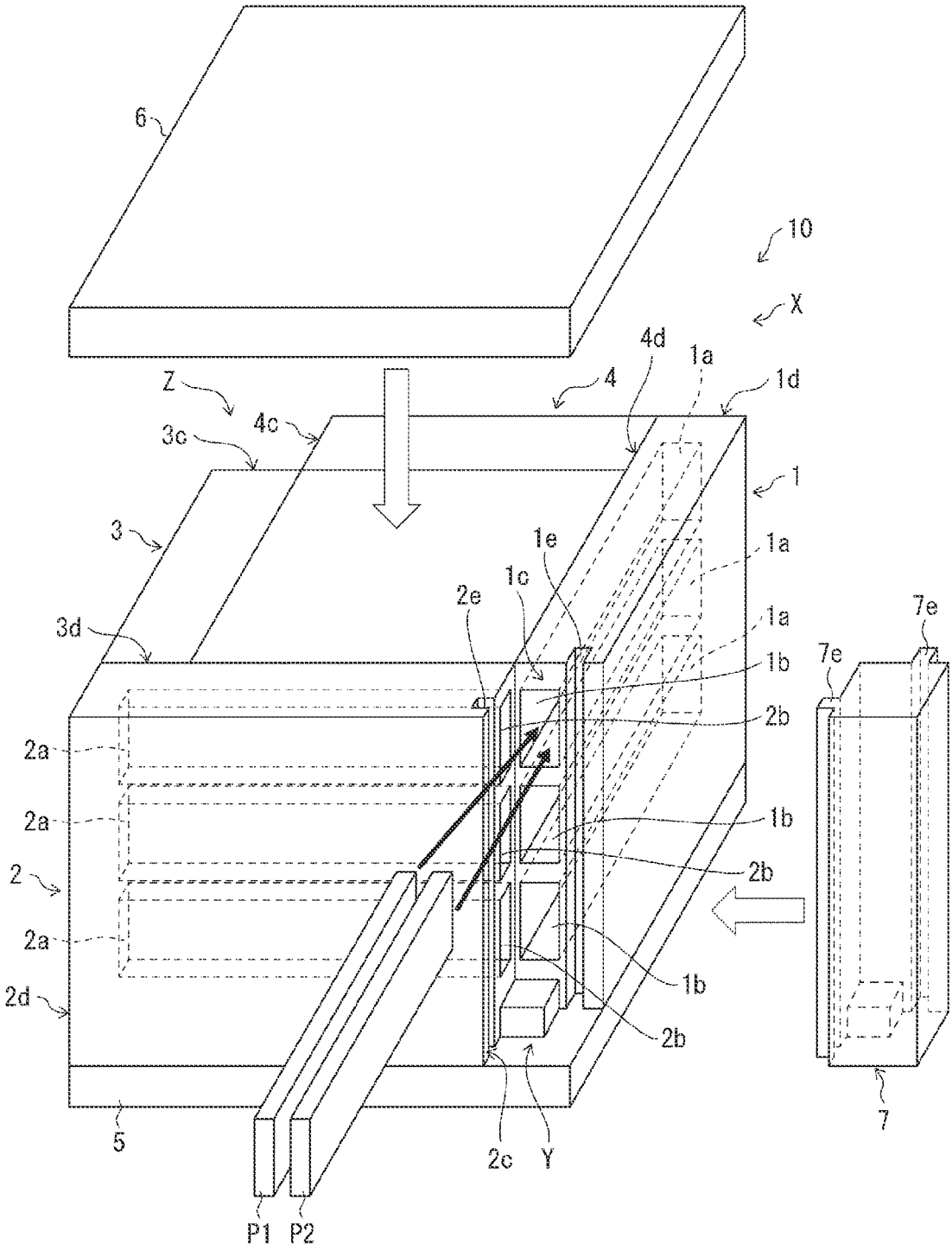
FIG. 1 is an exploded perspective view schematically illustrating a configuration of a constant-temperature transport container in accordance with Embodiment 1 of one or more embodiments of the present invention.

Outlines of Embodiments 1 to 6 of One or More Embodiments of the Present Invention As discussed above, the conventional constant-temperature transport containers (e.g., Patent Literatures 1 and 2) configured such that the heat storage materials can be inserted from a lateral side of the side wall panels leave room for improvement in the following points, for example.

In the constant-temperature transport container of Patent Literature 1, after the heat storage materials are inserted into insertion openings in lateral sides of the side wall panels, the insertion openings are closed by a vertical bar. This, however, often creates a gap between the insertion openings for the heat storage materials and the vertical bar, thereby making it impossible to prevent external air from flowing into the insides of the side wall panels. Therefore, in order to prevent the external air from flowing into the insides of the side wall panels, the constant-temperature transport container of Patent Literature 1 requires high dimensional precision both in the closing member and the insertion opening. The constant-temperature transport container of Patent Literature 1 leaves room for improvement in preventing the external air from flowing into the insides of the side wall panels.

With the technique disclosed in Patent Literature 2, after assembling of the four side wall panels, it is impossible to set the heat storage materials into the side wall panels from the lateral sides of the side wall panels. Therefore, the constant-temperature transport container of Patent Literature 2 leaves room for improvement in enhancing the efficiency of setting the heat storage materials into the side wall panels.

In order to deal with this, constant-temperature transport containers in accordance with Embodiments 1 to 6 each include four side wall panels each having (i) a housing part within which a heat storage material is to be housed and (ii) an insertion opening which is provided to a side surface of the side wall panel and through which the heat storage material is to be inserted into the housing part. The four side wall panels have the following features (1) to (4): (1) The four side wall panels form first insertion corners for the heat storage materials, each of the first insertion corners being formed by the side surfaces, each provided with the first insertion opening, of two side wall panels among the four side wall panels, the side surfaces of the two side wall panels being arranged adjacent to each other with the first insertion openings being exposed to an outside. (2) The number of first insertion corners is two, and the two first insertion corners are formed to face each other. (3) The side wall panels are connected to each other via side surfaces of the side wall panels which side surfaces are opposite to the two first insertion corners. (4) Each of the two first insertion corners is provided with a first fitting corner configured to close the first insertion openings and to be fitted to the side surfaces provided with the first insertion openings.

With the above features (1) to (3), after assembling of the four side wall panels, the mounting parts for the heat storage materials are collected in the two insertion corners. Therefore, after assembling the four side wall panels, a user can efficiently set the heat storage materials into the four side wall panels.

Further, with the above feature (4), the insertion openings are closed by fitting the insertion corners to the fitting corners. By employing such a fitting structure having a complicated feature, it is possible to prevent external air from flowing into the insides of the side wall panels.

Embodiment 1

The following will provide a detail description of an embodiment of one or more embodiments of the present invention. FIG. 1 is an exploded perspective view schematically illustrating a configuration of a constant-temperature transport container 10 in accordance with one or more embodiments.

As shown in FIG. 1, the constant-temperature transport container 10 is an assembled container that is in the form of a quadrangular box and that enables transportation of a temperature-keeping target article at a constant temperature, and is constituted by a container main body X having an upper surface which is open and a ceiling panel 6 configured to close the opening in the upper surface of the container main body X. The container main body X is constituted by four side wall panels 1, 2, 3, and 4 and a bottom panel 5. Each of the side wall panels 1, 2, 3, and 4, the bottom panel 5, and the ceiling panel 6 is made of a heat insulator and is in the form of a quadrangle when viewed in plan view.

The bottom panel 5 is made of a quadrangular plate which can be separated from the side wall panels 1, 2, 3, and 4. The side wall panels 1, 2, 3, and 4 are each made of a quadrangular plate. The quadrangular plates respectively constituting the side wall panels 1, 2, 3, and 4 can be separated from each other. Regarding each of the quadrangular plates constituting the side wall panels 1, 2, 3, and 4, a direction of a thickness of each quadrangular plate will be referred to as a "thickness direction", and a direction of a vertical height of each quadrangular plate when the side wall panel is set to the bottom panel 5 such that the side wall panel stands on the bottom panel 5 will be referred to as a "height direction". A direction perpendicular to both the height direction and the thickness direction will be referred to as a "lateral direction" or a "horizontal direction". Further, regarding each of the side wall panels 1 to 4, the bottom panel 5, and the ceiling panel 6, a side close to a luggage space of the constant-temperature transport container 10 will be referred to as an "inner side", and a side opposite to the inner side will be referred to as an "outer side".

The side wall panels 1, 2, 3, and 4 are connected to the bottom panel 5 via a known connecting means. For example, the side wall panels 1, 2, 3, and 4 are connected to the bottom panel 5 via a projection-and-recess structure. In this case, the projection-and-recess fitting structure is formed between (i) lower end portions of the side wall panels 1, 2, 3, and 4 and (ii) portions of the bottom panel 5 which portions face the lower end portions. Further, upper end portions of the side wall panels 1, 2, 3, and 4 are structured to be fitted to the ceiling panel 6.

Next, the following will describe configurations of the side wall panels 1 to 4. The following description will focus on the configurations of the side wall panels 1 and 2. The side wall panels 3 and 4 are identical in configuration to the side wall panels 1 and 2, and therefore a description thereof is omitted.

The side wall panel 1 includes storage parts 1*a* (first housing parts) in which stored materials P1 and P2, each of which is a heat storage material, are to be stored and insertion openings 1*b* (first insertion openings) through which the stored materials P1 and P2 are to be inserted into the storage parts 1*a*. The insertion openings 1*b* are formed in a side surface 1*c* of the side wall panel 1. The storage parts 1*a* constitute, in an inner space of the side wall panel 1, spaces in which the stored materials P1 and P2 are to be housed, and extend horizontally from the insertion openings 1*b*. The storage parts 1*a* do not reach another side surface 1*d* of the side wall panel 1. That is, each of the storage parts 1*a* is not a cavity extending from the one side surface 1*c* to another side surface 1*d*. Thus, another side surface 1*d* of the side wall panel 1 has no insertion opening 1*b*. In the configuration shown in FIG. 1, three storage parts 1*a* are aligned in a height direction. However, the number of storage parts 1*a* and/or the like can be set as appropriate in accordance with the size of the side wall panel 1, the sizes of the stored materials P1 and P2, and/or the like.

The side wall panel 2 includes storage parts 2*a* (first housing parts) in which stored materials P1 and P2, each of which is a heat storage material, are to be stored and insertion openings 2*b* (first insertion openings) through which the stored materials P1 and P2 are inserted into the storage parts 2*a*. The storage parts 2*a* and the insertion openings 2*b* are similar in configuration to the storage parts 1*a* and the insertion openings 1*b* of the side wall panel 1, and therefore a description thereof is omitted.

In the constant-temperature transport container 10 shown in FIG. 1, the side surfaces of the side wall panels 1 to 4 have (i) the insertion openings formed in their side surfaces and (ii) the storage parts extending in a horizontal direction from the respective insertion openings. Thus, at the time of assembling of the constant-temperature transport container 10, the stored materials P1 and P2 can be inserted into the side wall panels 1 to 4 from their lateral sides.

The conventional constant-temperature transport containers are each configured such that the stored materials are inserted from above the side wall panels. In such a configuration, when the size of the constant-temperature transport container increases, the heights of the side wall panels increase. This makes it difficult for a user to put the stored materials into the side wall panels. Particularly in a case where a woman, who is relatively short, carries out the assembling, her eyes hardly contact and/or her hands hardly reach the insertion openings for the stored materials. Therefore, it is difficult for her to put the stored materials into the side wall panels. Further, if the side wall panels are to be moved after the stored materials are housed therein, it is difficult to handle the side wall panels, since the side wall panels are very heavy.

In contrast to such conventional constant-temperature transport containers, the constant-temperature transport container 10 allows insertion of the stored materials P1 and P2 into each of the side wall panels 1 to 4 from its lateral side at the time of assembling. Therefore, even when the size of the constant-temperature transport container increases and accordingly the heights of the side wall panels increase, a user can easily access the insertion openings for the stored materials. As a result, with the constant-temperature transport container 10, it is easier to put the stored materials into the side wall panels. Further, it is not necessary to move the heavy side wall panels into which the stored materials have been inserted. This makes it possible to reduce the burden of the assembly work.

With the constant-temperature transport container 10 in accordance with one or more embodiments, it is possible to prevent external air from flowing into the insides of the side wall panels 1 to 4 and to efficiently set the heat storage materials into the side wall panels 1 to 4.

In the constant-temperature transport container 10, the four side wall panels 1 to 4 form two insertion corners Y and Z (first insertion corners). The two insertion corners Y and Z face each other. With the configuration in which the insertion corners Y and Z are arranged so as to face each other in this manner, the constant-temperature transport container 10 is stable in terms of structure even when fitting corners 7 are not fitted to the insertion corners Y and Z. The insertion corner Y is formed by the side wall panels 1 and 2, specifically, by the side surface 1*c* provided with the insertion opening 1*b* and the side surface 2*c* provided with the insertion opening 2*b*. The insertion corner Z is identical in configuration to the insertion corner Y. That is, the insertion corner Z is formed by the side wall panels 3 and 4, specifically, by the side surfaces 3*c* and 4*c* provided with the insertion openings for the stored materials P1 and P2. The following description will discuss the insertion corner Y. The insertion corner Z is similar to the insertion corner Y, and therefore a description thereof is omitted.

With the side wall panels 1 and 2, the insertion corner Y is formed by the side surfaces 1 and 2 adjacent to each other, with the insertion openings 1*b* and 2*b* being exposed to the outside.

In the constant-temperature transport container 10, the side wall panels 1 and 4 are connected to each other via the side surface 1*d*, which is opposite to the insertion corner Y, and the side surface 4*d*, which is opposite to the insertion corner Z. Similarly, the side wall panels 2 and 3 are connected to each other via the side surface 2*d*, which is opposite to the insertion corner Y, and the side surface 3*d*, which is opposite to the insertion corner Z. The configuration herein in which the side wall panels are connected to each other via the side surfaces 1*d* and 4*d* encompasses (i) a configuration in which the side wall panels are connected to each other with one of the side surfaces 1*d* and 4*d* being in contact with the side wall panel having the other of the side surfaces 1*d* and 4*d* and (ii) a configuration in which the side wall panels are connected to each other with the side surfaces 1*d* and 4*d* being in contact with each other. In FIG. 1, the configuration in which the side wall panels are connected to each other via the side surfaces 1*d* and 4*d* is the configuration in which the side wall panels are connected to each other with the side surface 4*d* of the side wall panel 4 being in contact with the side wall panel 1.

In the constant-temperature transport container 10, the insertion corner Y is provided with the fitting corner 7 (first fitting corner). The fitting corner 7 is structured to close the insertion openings 1*b* and 2*b* and to be fitted to the side surface 1*c* provided with the insertion openings 1*b* and the side surface 2*c* provided with the insertion openings 2*b*. Specifically, the side surface 1*c*, provided with the insertion openings 1*b*, of the side wall panel 1 has a fitting recess 1*e*. Further, the side surface 2*c*, provided with the insertion openings 2*b*, of the side wall panel 2 has a fitting recess 2*e*. Each of the fitting recesses 1*e* and 2*e* is a recessed groove extending in an up-down direction.

The fitting corner 7 is in the form of a rectangular parallelepiped that can be accommodated in a space in the insertion corner Y which space is formed by the side surfaces 1*c* and 2*c*. The fitting corner 7 is fitted to the insertion corner Y such that the fitting corner 7 is flush with the side wall panels 1 and 2. The fitting corner 7 has surfaces respectively facing the side surfaces 1*c* and 2*c*, and each of these surfaces is provided with a fitting projection 7*e*. Each of the two fitting projections 7*e* and 7*e* is a long projection extending in the up-down direction. Of the two fitting projections 7*e* and 7*e*, one is fitted to the fitting recess 1*e*, and the other is fitted to the fitting recess 2*e*. As discussed above, in the constant-temperature transport container 10, the side surfaces 1*c* and 2*c*, provided with the insertion openings 1*b* and 2*b*, of the side wall panels 1 and 2 are respectively provided with the fitting recesses 1*e* and 2*e* configured to be fitted to the insertion corner Y. The fitting corner 7 is provided with the fitting projections 7*e* and 7*e* configured to be fitted to the fitting recesses 1*e* and 2*e*.

In the insertion corner Y, fitting the fitting corner 7 to the side surface 1*c* of the side wall panel 1 and the side surface 2*c* of the side wall panel 2 closes the insertion openings 1*b* and 2*b*. Consequently, it is possible to prevent external air from flowing into the inside of the storage part 1*a* of the side wall panel 1. Similarly, it is possible to prevent external air from flowing into the inside of the storage part 2*a* of the side wall panel 2.

In the constant-temperature transport container 10, the fitting corner 7 is firmly fixed to the insertion corner Y by the fitting structure. As discussed above, the insertion openings 1*b* and 2*b* are closed by the fitting corner 7 firmly fixed to the insertion corner Y. Thus, it is possible to more reliably prevent external air from flowing into the insides of the side wall panels 1 and 2.

Next, the following will describe a method for assembling the constant-temperature transport container 10.

First, the side wall panel 1 is set to the bottom panel 5 such that the side wall panel 1 stands on the bottom panel 5. In doing so, for example, the projection-and-recess fitting structure between the side wall panel 1 and the bottom panel 5 is brought into a fitted state, so that the side wall panel 1 is connected to the bottom panel 5. Next, the side wall panel 2 is set to the side wall panel 1 such that the insertion corner Y is formed by the side surfaces 1*c* and 2*c*. In this state, the side wall panel 2 is set to the bottom panel 5 such that the side wall panel 2 stands on the bottom panel 5. Note that a method for setting the side wall panels 2 to 4 to the bottom panel 5 such that the side wall panels 2 to 4 stand on the bottom panel 5 is similar to the method for setting the side wall panel 1 to the bottom panel 5 such that the side wall panel 1 stands on the bottom panel 5, and therefore a description thereof is omitted.

Next, the side wall panel 4 is set to the bottom panel 5 such that the side wall panel 4 stands on the bottom panel 5 and the side surface 4*d* of the side wall panel 4 is connected to the side surface 1*d* of the side wall panel 1. Then, the side wall panel 3 is set to the bottom panel 5 such that the side wall panel 3 stands on the bottom panel 5 and the side surface 3*d* of the side wall panel 3 is connected to the side surface 2*d* of the side wall panel 2. By setting the side wall panels 3 and 4 to the bottom panel 5 such that the side wall panels 3 and 4 stand on the bottom panel 5, the insertion corner Z is formed by the side surface 3*c* of the side wall panel 3 and the side surface 4*d* of the side wall panel 4.

This yields a structure in which the side wall panels 1, 2, 3, and 4 stand on the bottom panel 5. Then, the stored materials P1 and P2 are inserted into this structure through the insertion openings 1*b*, 2*b*, 3*b*, and 4*b*, so that the stored materials P1 and P2 are set into the side wall panels 1 to 4. Here, the insertion corners Y and Z face each other. Further, the insertion openings 1*b*, 2*b*, 3*b*, and 4*b* for the stored materials P1 and P2 are collected in two locations, i.e., the insertion corners Y and Z. Thus, in setting the stored materials P1 and P2 into the side wall panels 1 to 4, a user can access all the insertion openings 1*b*, 2*b*, 3*b*, and 4*b* by moving to only the two locations. Therefore, it is possible to efficiently set the stored materials P1 and P2 into the side wall panels 1, 2, 3, and 4. Further, since the insertion openings 1*b*, 2*b*, 3*b*, and 4*b* for the stored materials P1 and P2 are collected in two locations, a small space can be used to assemble the constant-temperature transport container 10.

Further, in the constant-temperature transport container 10, the insertion corners Y and Z are formed in a state where the four side wall panels 1 to 4 stand on the bottom panel 5. Therefore, the user does not need to cause the very heavy side wall panels 1 to 4 in which the stored materials P1 and P2 have been set to stand on the bottom panel 5. Instead, the user may cause the light side wall panels 1 to 4 in which the stored materials P1 and P2 are not set to stand on the bottom panel 5. Thus, by employing the configuration of the constant-temperature transport container 10, it is possible to reduce the burden imposed on the user at the time of assembling of the side wall panels 1 to 4.

By fitting the fitting corners 7 to the insertion corners Y and Z after setting the stored materials P1 and P2 into the side wall panels 1 to 4, a container main body X is formed. Then, by connecting the ceiling panel 6 to an upper end portion of the container main body X thus assembled, a constant-temperature transport container 10 is completed.

As discussed above, with the constant-temperature transport container 10 in accordance with one or more embodiments, it is possible to prevent external air from flowing into the insides of the side wall panels 1 to 4 and to efficiently set the stored materials P1 and P2 into the side wall panels 1 to 4.

Here, there is no particular limitation on the material of the constant-temperature transport container 10, provided that the material has a heat insulating property. The material of the constant-temperature transport container 10 may be a foamed plastic or a vacuum heat insulator. Specific examples of the foamed plastic include foamed polystyrene, foamed polyethylene, foamed polypropylene, foamed polyurethane, and a foamed poly(3-hydroxyalkanoate)-based resin. The foamed plastic may be the one containing a radiative heat transfer inhibitor, since such a foamed plastic is excellent in the heat insulating property. Examples thereof include a carbon-containing bead foamed molded body containing carbon that can act as a radiative heat transfer inhibitor. Examples of the carbon include graphite, graphene, active carbon, coke, and carbon black. In terms of balance between the cost and the effect of enhancing the heat insulating property, the carbon may be graphite or carbon black, or graphite. Examples of the vacuum heat insulator include the ones including, as a core, silica powder, glass wool, glass fiber, and/or the like.

Further, the constant-temperature transport container 10 may be made of two or more kinds of foamed plastic used in combination. Specific examples of the combination include a combination of a foamed body obtained by foaming polyethylene and a foamed body obtained by foaming polystyrene.

Further, the constant-temperature transport container 10 may be made of a combination of a foamed plastic and a vacuum heat insulator. In this case, the vacuum heat insulator may be used to cover outer surfaces or inner surfaces of the container main body X and/or the ceiling panel 6 each made of the foamed plastic, or the vacuum heat insulator may be buried in the insides of the walls constituting the container main body X and the ceiling panel 6. This can yield a transport container having a high heat insulating property.

In the constant-temperature transport container 10, the fitting structure between (i) the side surfaces 1*c* and 2*c* and (ii) the fitting corner 7 is not limited to any particular one. From the viewpoint of enhancing the efficiency of the fitting work of the fitting corner 7 with respect to the insertion corner Y, the fitting corner 7 may be structured so as to be inserted for fitting from the side surface side of the constant-temperature transport container 10 (hereinafter, such a structure will be referred to as a "horizontal insertion structure").

For example, in the structure shown in FIG. 1, the horizontal insertion structure may be configured to allow the fitting corner 7 to be fitted to the insertion corner Y along a horizontal direction. For example, the horizontal insertion structure can be achieved as below. That is, a fitting surface of the fitting recess of at least one of the side wall panels 1 and 2 which fitting surface is to be fitted to the fitting corner 7 is exposed when viewed in a horizontal direction of the other of the side wall panels 1 and 2.

For example, in the configuration shown in FIG. 1, the horizontal insertion structure is configured such that a fitting surface of the fitting recess 1*e* of the one side wall panel 1 which fitting surface is to be fitted to the fitting projection 7*e* is exposed when viewed in a horizontal direction of the other side wall panel 2. That is, the fitting surface of the fitting recess 1*e* via which fitting surface is to be fitted to the fitting projection 7*e* is not shielded by the outer surface of the side wall panel 1, and is visible when seen in the horizontal direction of the side wall panel 2. In other words, the fitting recess 1*e* is provided at an outermost end of the side surface 1*c* of the side wall panel 1, and a portion of an outer side wall which portion corresponds to the fitting recess 1*e* is not formed.

In such a horizontal insertion structure, the fitting corner 7 is moved toward the side surface 1*c* from the side surface side of the constant-temperature transport container 10 so that the fitting recess 1*e* is fitted to the one fitting projection 7*e*. When the fitting recess 1*e* is fitted to the one fitting projection 7*e* in this manner, the fitting recess 2*e* is also fitted to the other fitting projection 7*e*. Therefore, it is not necessary to fit the fitting projections 7*e* of the fitting corner 7 with the fitting recesses 1*e* and 2*e* from above. Consequently, the efficiency of the fitting work of the fitting corner 7 is enhanced.

Further, the fitting corner 7 may be configured to be fitted not only to the side surfaces 1*c* and 2*c* but also to at least one of the bottom panel 5 and the ceiling panel 6. In other words, it is preferable that at least one of the bottom panel 5 and the ceiling panel 6 be connected to the fitting corner 7 via the fitting structure. Consequently, the fitting corner 7 is fitted also to at least one of the bottom panel 5 and the ceiling panel 6 so as to be fixed thereto. Thus, the fitting corner 7 is firmly held by the insertion corner Y.

There is no particular limitation on the fitting structure via which the side surfaces 1*c* and 2*c* are fitted to with the fitting corner 7. From the viewpoint of enhancing the efficiency of inserting the stored materials P1 and P2 into the insertion openings 1*b* and 2*b* in the insertion corner Y, the side surfaces 1*c* and 2*c* may be provided with the fitting recesses 1*e* and 2*e*, rather than the fitting projections, as shown in FIG. 1. In a case where the side surfaces 1*c* and 2*c* are provided with the fitting projections, it may sometimes be difficult to insert the stored materials P1 and P2 into the insertion opening 1*b* or 2*b* due to the fitting projections.

(Stored Materials P1 and P2)

Each of the stored materials P1 and P2 is a heat storage material. The "heat storage material" herein encompasses not only the heat storage material but also a cold storage material. That is, each of the stored materials P1 and P2 is at least one of the heat storage material and the cold storage material. The heat storage material or the cold storage material is an article made of a plastic container or a film bag in including a heat storage component or a cold storage component sealed therein.

There is no particular limitation on the material of the container or bag filled with the heat storage component or the cold storage component. Examples of the material include polyethylene, polypropylene, polyethylene terephthalate, polystyrene, polyvinyl chloride, nylon, and polyester. One kind selected from these materials may be used alone. Alternatively, in order to enhance the heat resistance and/or the barrier property, a multi-layer structure made of two or more kinds selected from these materials may be used. There is no particular limitation on the shape of the container or bag. From the viewpoint of enhancing the heat exchange efficiency, the container or bag may have a shape that can secure a large surface area.

Each of the stored materials P1 and P2 may be at least either of the latent-heat heat storage material and the latent-heat cold storage material. The latent heat type heat storage material or the latent heat type cold storage material is a material that uses heat energy associated with phase transition of the heat storage component or the cold storage component and that utilizes heat energy absorbed when the phase state of the heat storage component or the cold storage cold storage transitions from a solidified state (solid) to a melted state (liquid) or heat energy released when the phase state of the heat storage component or the cold storage cold storage transitions from a melted state (liquid) to a solidified state (solid).

Figure 2:
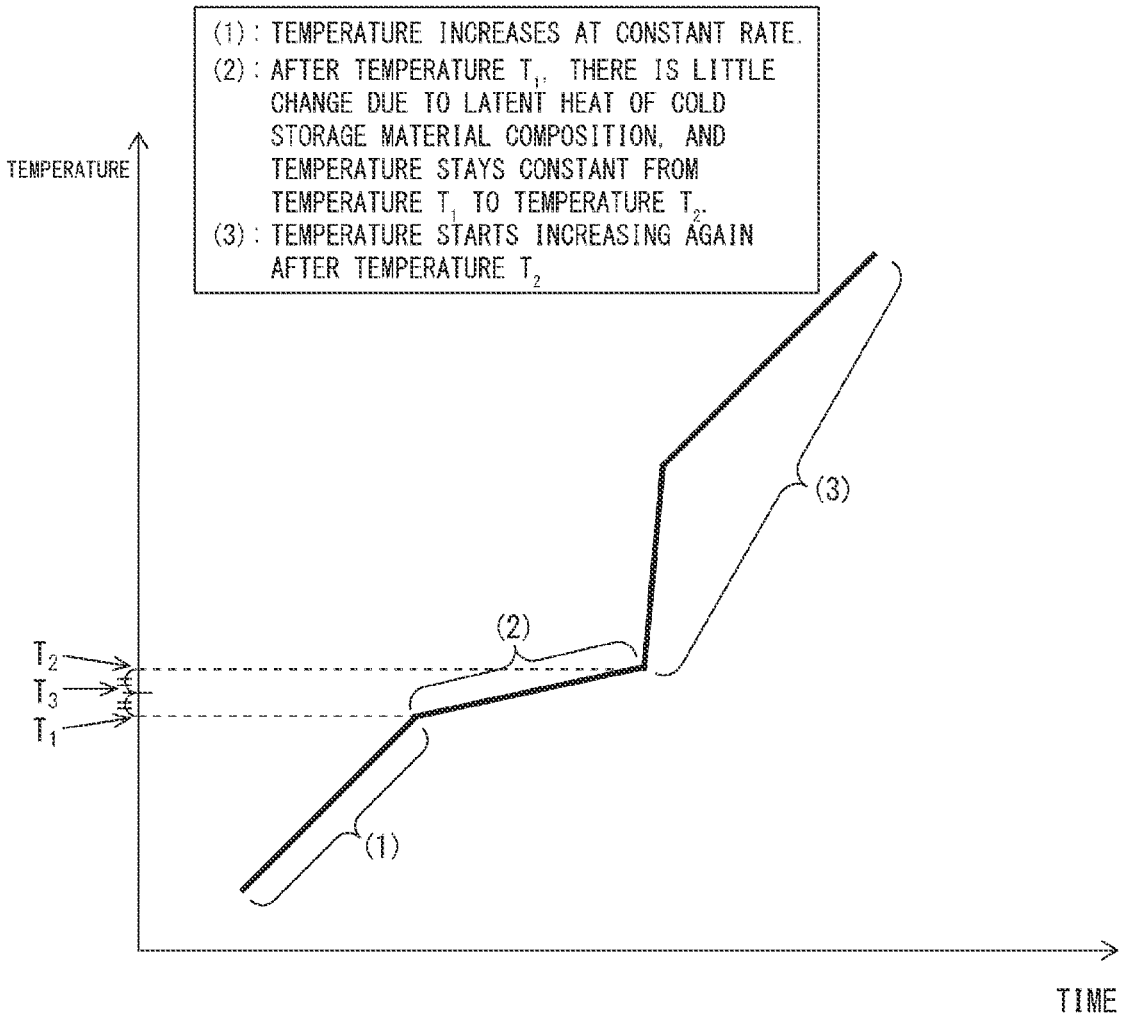
FIG. 2 is a graph plotting a change over time in temperature of a cold storage material composition when a cold storage material composition in a solidified state was placed in a thermostatic bath and the temperature of the thermostatic bath was then increased from a cryogenic temperature at a constant rate of temperature increase.

A solidifying/melting temperature of the heat storage component or the cold storage component refers to a temperature at which the phase state of the heat storage component or the cold storage component changes from a solidified state (solid) to a melted state (liquid) or from a melted state (liquid) to a solidified state (solid). The "melting temperature" of a cold storage material composition as used herein is intended to mean "a temperature at which the cold storage material composition in a solid state starts melting into a liquid state". The "melting temperature" will be more specifically discussed with reference to FIG. 2. FIG. 2 is a graph plotting a change over time in temperature of a cold storage material composition when a cold storage material composition in a solidified state was placed in a thermostatic bath, and the temperature of the thermostatic bath was then increased from a cryogenic temperature at a constant rate of temperature increase. In comparison with the temperature of the thermostatic bath which is increased at a constant rate, the temperature of the cold storage material composition, as shown in FIG. 2, changes in the order of the following (1) to (3): (1) The temperature of the cold storage material composition increases at a constant rate; (2) after temperature T1, there is little change due to latent heat of the cold storage material composition, and the temperature of the cold storage material composition stays constant from the temperature T1 to temperature T2; and (3) the temperature of the cold storage material composition starts increasing again after the temperature T2. The temperature T1 as used herein is referred to as "melting start temperature", and the temperature T2 as used herein is referred to as "melting end temperature". A midpoint between the temperature T1 and the temperature T2, i.e., temperature T3, is defined herein as "melting temperature".

Generally, the phase state refers to any one of three phase states of a substance, i.e., solid, liquid, and gas. One or more embodiments utilize the solid phase state and the liquid phase state among these. The phase state of the heat storage component or the cold storage component refers to a phase state of not less than 50 wt %. For example, a phase state in which 80 wt % of the heat storage component is in a solid state and 20 wt % of the heat storage component is in a liquid state is solid (solidified state).

There is no particular limitation on a composition of the latent heat type heat storage component or the latent heat type cold storage component used in one or more embodiments. Examples of such a composition include organic compound heat storage material compositions such as: inorganic hydrate salts such as calcium chloride 6-hydrate, sodium sulfate 10-hydrate, sodium acetate 3-hydrate, potassium chloride 6-hydrate, and quaternary ammonium salt-hydrate; at least one kind of higher alkane selected from the group of linear and branched paraffins having 9 to 30 carbon atoms, such as normal tetradecane, normal hexadecane, normal heptadecane, normal dodecane, and normal docosane; saturated fatty acids having 6 to 18 carbon chains, such as octanoic acid, decanoic acid, lauric acid, dodecanoic acid, and stearic acid; fatty acid ester compounds such as methyl laurate, methyl myristate, and butyl stearate; palmitoleic acid, oleic acid, linoleic acid, unsaturated fatty acid having 6 to 18 carbon chains, and ester compounds thereof; higher alcohols (including linear alcohol, branched alcohol, primary alcohol, secondary alcohol, and tertiary alcohol) which are monohydric alcohols having not less than 6 carbon atoms such as 1-decanol, 2-decanol, undecanol, lauryl alcohol, tridecanol, myristyl alcohol, pentadecanol, cetyl alcohol, heptadecanol, stearyl alcohol, nonadecanol, arachidyl alcohol, behenyl alcohol, carnauvir alcohol, ceryl alcohol, elaidyl alcohol, and 1-menthol; polyalkylene glycols which are dihydric alcohols such as polyethylene glycol and polybutylene glycol. One kind selected from them may be used, or a mixture of two or more kinds selected from them may be used.

Other examples include: components containing water as a main component, such as an aqueous calcium chloride, an aqueous calcium bromide, an aqueous potassium bicarbonate, an aqueous potassium chloride, an aqueous ammonium chloride, and an aqueous sodium chloride; and components containing water and a superabsorbent polymer.

In the constant-temperature transport container 10 shown in FIG. 1, two kinds of heat storage material(s) and/or cold storage material(s) (either or both of the heat storage material(s) and the cold storage material(s)), i.e., the stored materials P1 and P2 are housed. Alternatively, in a constant-temperature transport container in accordance with one or more embodiments, one kind of the heat storage material(s) and/or the cold storage material(s) (either or both of the heat storage material(s) and the cold storage material(s)) may be placed and housed. In a case where the ambient temperature is lower than the controlled temperature, e.g., in winter, temperature adjustment is carried out at a temperature higher than the solidifying/melting temperature of the heat storage material(s) and/or the cold storage material(s) that is/are to be placed and stored in the container, so that the heat storage material(s) and/or the cold storage material(s) in a melted state is/are placed in the container. In this case, when the heat storage material(s) and/or the cold storage material(s) is/are cooled by the ambient temperature, the temperature(s) thereof degrease(s) and the phase(s) thereof transition(s) from a melted state (liquid) to a solidified state (solid), so that the heat storage material and/or the cold storage material release(s) heat energy. This can suppress exposure of the temperature-keeping target article to the external air, thereby maintaining the temperature of the temperature-keeping target article within a given temperature range.

Meanwhile, in a case where the ambient temperature is higher than the controlled temperature, e.g., in summer, temperature adjustment is carried out at a temperature lower than the solidifying/melting temperature of the heat storage material(s) and/or the cold storage material(s) that is/are to be placed and stored in the container, and the heat storage material(s) and/or the cold storage material(s) in a solidified state is/are placed in the container. In this case, when the heat storage material(s) and/or the cold storage material(s) is/are heated by the ambient temperature, the temperature(s) thereof increase(s) and the phase(s) thereof transition(s) from a solidified state (solid) to a melted state (liquid), so that the heat storage material(s) and/or the cold storage material(s) absorb(s) heat energy. This can suppress exposure of the temperature-keeping target article to the external air, thereby maintaining the temperature-keeping target article within a given temperature range.

In a case where one kind of the constant-temperature transport container employs the heat storage material(s) and/or the cold storage material(s) is/are used, effects of temperature increase or decrease caused by a temperature difference between the heat storage material(s) and/or the cold storage material(s) and the external air can be suppressed, via the heat insulator constituting the constant-temperature transport container, by the releasing/absorbing effect of latent heat energy of the single kind of the heat storage material(s) and/or the cold storage material(s), and accordingly the temperature-kept article can be maintained within a given temperature range for a certain time. For this, however, the heat storage material(s) and/or the cold storage material(s) need to be adjusted in advance at a specific temperature with respect to the external ambient temperature, and this is troublesome. Further, in a case where the temperature is to be maintained for a long time, the number/weight of the heat storage material(s) and/or the cold storage material(s) tend to increase.

In one or more embodiments, a plurality of heat storage materials having different melting temperature ranges may be used. In the constant-temperature transport container in accordance with one or more embodiments, two or more kinds of the heat storage material(s) and/or the cold storage material(s) having different solidified/melted states can be placed and stored in the stored materials P1 and P2, as shown in FIG. 1. For example, in a case where the first heat storage material or cold storage material (a) and the second heat storage material or cold storage material (b) are used and the same temperature adjustment conditions are employed throughout an year regardless of the ambient temperature, the following combinations of the stored materials P1 and P2 may be employed, for example. One example of the combination includes: the stored material P1 which is located close to the temperature-keeping target article and in which the first heat storage material or cold storage material (a) having a solidifying/melting temperature close to the controlled temperature and being in a melted state is stored; and the stored material P2 which is located outward of the first heat storage material or cold storage material and in which the second heat storage material or cold storage material (b) having a solidifying/melting temperature not more than 0° C. and being in a solidified state is stored.

In a case where the first heat storage material or cold storage material (a) and the second heat storage material or cold storage material (b) are used, temperature adjustment may be carried out so that the first heat storage material or cold storage material (a) is in a melted state at a temperature higher than the controlled temperature and the second heat storage material or cold storage material (b) may be solidified and frozen at a temperature not more than the melting temperature of the second heat storage material or cold storage material (b). In this case, the first heat storage material or cold storage material (a) is housed in the stored material P1 located close to the temperature-keeping target article, and the second heat storage material or cold storage material (b) is housed in the stored material P2. The second heat storage material or cold storage material (b) located outward of the first heat storage material or cold storage material (a) functions as a thermal buffer material for the ambient temperature in order to maintain the temperature-keeping target article within a desired temperature range.

In a case where these two or more kinds of heat storage material(s) and/or cold storage material(s) having different solidified/melted states are used, effects of temperature increase and decrease caused by a temperature difference between the heat storage material(s) and/or the cold storage material(s) and the external air can be suppressed by causing, via the heat insulators constituting the container, the second heat storage material or cold storage material (b) which is disposed outward of the first heat storage material or cold storage material (a) disposed adjacent to the temperature-keeping target article to function as a thermal buffer material. Further, due to a temperature interaction between the first heat storage material or cold storage material (a) and the second heat storage material or cold storage material (b), the first heat storage material or cold storage material (a) that is in a melted state is cooled and accordingly the temperature thereof decreases and transitions from a melted state (liquid) to a solidified state (solid), so as to release heat energy. This makes it possible to protect the temperature-keeping target article from both a temperature higher than the temperature of the temperature-keeping target article and a temperature lower than the temperature of the temperature-keeping target article. Consequently, it is possible to reduce an amount of the heat storage material(s) or cold storage material(s) to be used and to maintain the temperature-keeping target article within a given temperature range for a longer time.

In a specific example of the case where the two or more kinds of the heat storage material(s) and/or the cold storage material(s) having different solidified/melted states are used, a heat storage material or a cold storage material whose melting temperature is adjusted at a temperature around 5° C. or 20° C. is housed in the stored material P1 and a heat storage material or a cold storage material whose melting temperature is adjusted at 0° C. is housed in the stored material P2.

There is no particular limitation on the shapes of the stored materials P1 and P2, provided that the shapes of the stored materials P1 and P2 allow the stored materials P1 and P2 to be inserted into the side wall panels 1 to 4 from the lateral sides. For example, each of the stored materials P1 and P2 may be a heat storage material or a cold storage material made of a single long container which has a size that can be housed in the storage part of the side wall panel and which has one kind of heat storage component or cold storage component accommodated therein.

From the viewpoint of versatility of the heat storage material and/or the cold storage material, each of the stored materials P1 and P2 is a connected body including a plurality of heat storage materials and/or cold storage materials that are connected to each other. This makes it possible to improve the workability of setting the stored materials P1 and P2 and to provide the stored materials P1 and P2 suitable for multiple constant-temperature transport containers having different sizes. This can enhance the versatility of the stored materials P1 and P2.

Embodiment 2

The following will provide a description of another embodiment of one or more embodiments of the present invention. For convenience, members having identical functions to those of the foregoing embodiment are given identical reference signs, and their descriptions will be omitted.

Figure 3:
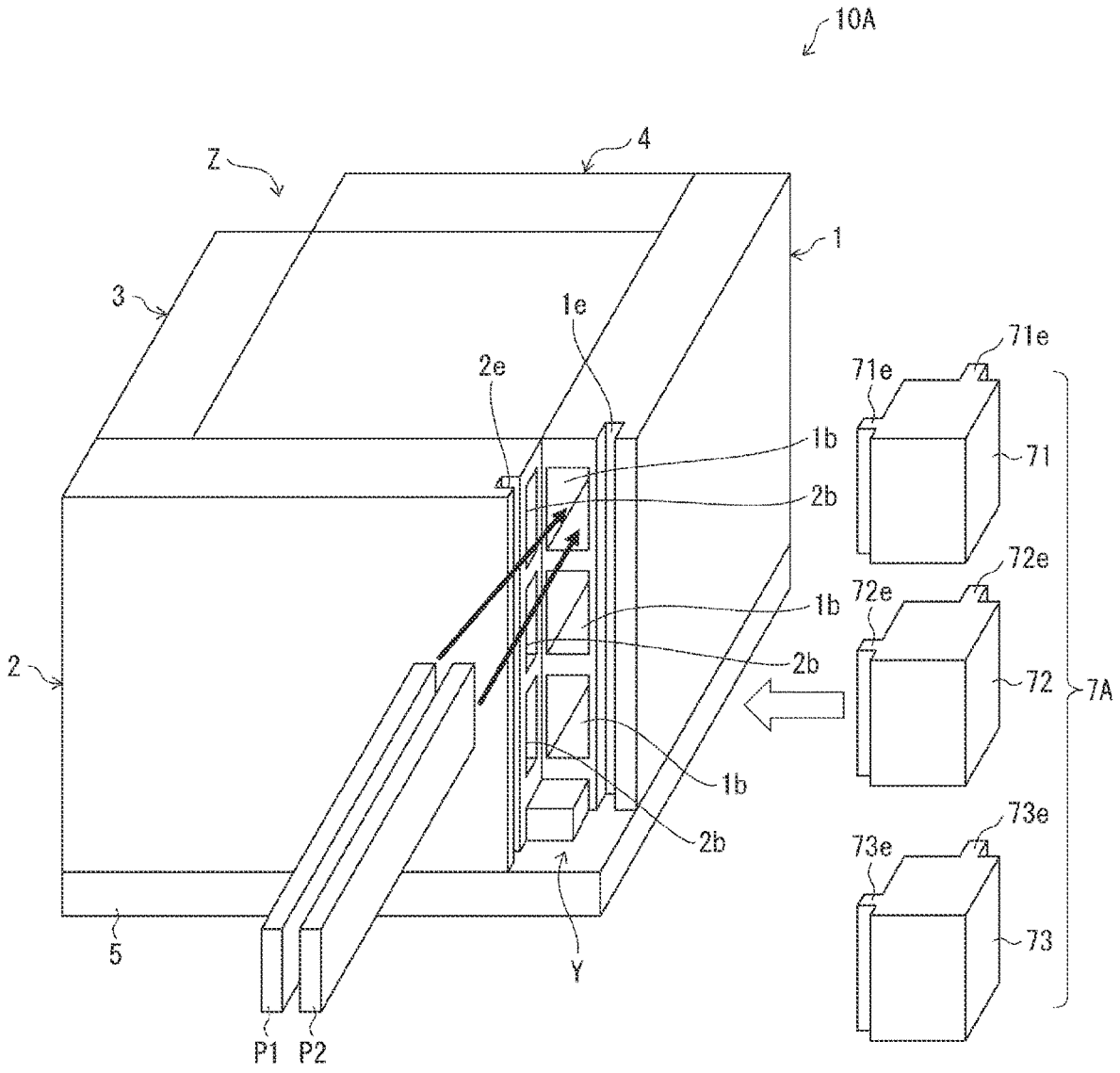
FIG. 3 is a perspective view schematically illustrating a configuration of a constant-temperature transport container in accordance with Embodiment 2 of one or more embodiments of the present invention.

FIG. 3 is a perspective view schematically illustrating a configuration of a constant-temperature transport container 10A in accordance with one or more embodiments. Note that, for simplification, FIG. 3 does not illustrate a storage part 1*a*, a storage part 2*a*, and a ceiling panel 6.

As shown in FIG. 3, the constant-temperature transport container 10A in accordance with one or more embodiments differs from Embodiment 1 in a configuration of a fitting corner 7A. As shown in FIG. 3, the fitting corner 7A is made of a plurality of members that are assembled. To be more specific, the fitting corner 7A is made of members 71, 72, and 73 that are assembled. Each of the members 71, 72, and 72 has a rectangular parallelepiped shape.

The fitting corner 7A is an assembled body obtained by assembling the members 71, 72, and 73, and is structured so as to be accommodated in a space formed by side surfaces 1*c* and 2*c* in an insertion corner Y. The members 71, 72, and 72 are fitted to the insertion corner Y such that the members 71, 72, and 72 are flush with the side wall panels 1 and 2. The member 71 has surfaces which respectively face the side surfaces 1*c* and 2*c* and which are respectively provided with fitting projections 71*e* and 71*e*. The member 72 has surfaces which respectively face the side surfaces 1*c* and 2*c* and which are respectively provided with fitting projections 72*e* and 72*e*. The member 73 has surfaces which respectively face the side surfaces 1*c* and 2*c* and which are respectively provided with fitting projections 73*e* and 73*e*. The fitting projections 71*e* and 71*e*, the fitting projections 72*e* and 72*e*, and the fitting projections 73*e* and 73*e* are fitted to the fitting recesses 1*e* and 2*e* of the side wall panels 1 and 2.

When the members 71, 72, and 73 are assembled together, the fitting projections 71*e*, 72*e*, and 73*e* are located so as to overlap each other as viewed from above. Thus, when the members 71, 72, and 73 are assembled together, the fitting projections 71*e*, 72*e*, and 73*e* are fitted to each other so as to constitute a long projection extending in an up-down direction.

With the constant-temperature transport container 10A in accordance with one or more embodiments, it is possible to prevent external air from flowing into the insides of the side wall panels 1 to 4 and to efficiently set storage materials (a heat storage material(s) or a cold storage material(s)) into the side wall panels 1 to 4. Particularly, in the constant-temperature transport container 10A, the fitting corner 7A can be constituted by the members 71, 72, and 73, each of which is reduced in size and weight. Thus, it is possible to carry out the fitting work of the fitting corner 7A with use of the members 71, 72, and 73 reduced in size and weight. Consequently, the efficiency of the fitting work of the fitting corner 7A is enhanced.

Embodiment 3

The following will provide a description of another embodiment of one or more embodiments of the present invention. For convenience, members having identical functions to those of the foregoing embodiment are given identical reference signs, and descriptions thereof will be omitted.

Figure 4:
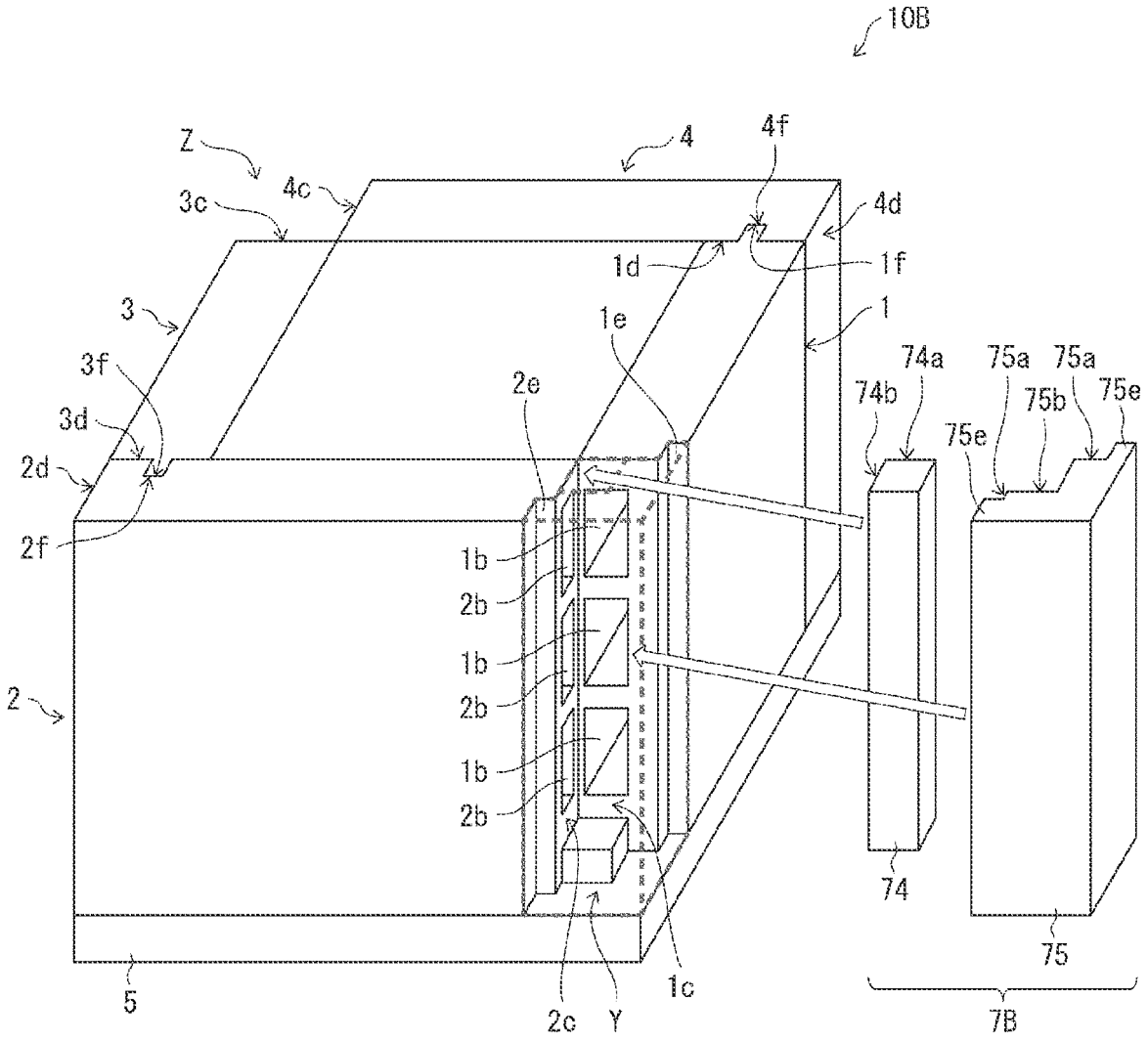
FIG. 4 is a perspective view schematically illustrating a configuration of a constant-temperature transport container in accordance with Embodiment 3 of one or more embodiments of the present invention.

FIG. 4 is a perspective view schematically illustrating a configuration of a constant-temperature transport container 10B in accordance with one or more embodiments. Note that, for simplification, FIG. 4 does not illustrate a storage part 1*a*, a storage part 2*a*, and a ceiling panel 6.

As shown in FIG. 4, the constant-temperature transport container 10B in accordance with one or more embodiments differs from Embodiment 1 in configurations of fitting recesses 1*e* and 2*e* and a fitting corner 7B. As shown in FIG. 4, the fitting recess 1*e* is provided at an outermost end of a side surface 1*c* of a side wall panel 1, and a portion of an outer side wall which portion corresponds to the fitting recess 1*e* is not formed. Further, the fitting recess 2*e* is provided at an outermost end of a side surface 2*c* of a side wall panel 2, and a portion of an outer side wall which portion corresponds to the fitting recess 2*e* is not formed.

The fitting corner 7B is made of a plurality of members that are assembled. The fitting corner 7B is made of members 74 and 75 that are assembled. The members 74 and 75 assembled into the fitting corner 7B can be accommodated in a space formed by the side surfaces 1*c* and 2*c* in the insertion corner Y. The fitting corner 7B is fitted to the insertion corner Y such that the fitting corner 7B is flush with the side wall panels 1 and 2.

The member 74 is in the form of a rectangular parallelepiped bar. The member 74 has side surfaces 74*a* and 74*b*. When the fitting corner 7B is fitted to the side surfaces 1*c* and 2*c*, the side surfaces 74*a* and 74*b* are in contact with the side surfaces 1*c* and 2*c*, respectively.

The member 75 has surfaces which respectively face the side surfaces 1*c* and 2*c* and which are respectively provided with fitting projections 75*e* and 75*e*. Each of the fitting projections 75*e* and 75*e* is a long projection extending in an up-down direction. The fitting projections 75*e* and 75*e* are fitted to the fitting recesses 1*e* and 2*e*, respectively. The member 75 has contact surfaces 75*a* and 75*a* extending in the up-down direction. When the fitting corner 7B is fitted to the side surfaces 1*c* and 2*c*, the contact surfaces 75*a* and 75*b* are in contact with the side surfaces 1*c* and 2*c*, respectively. The member 75 further has a contact recess 75*b* that is to be in contact with side surfaces of the member 74. When the side surface of the member 74 comes into contact with the contact recess 75*b*, one of the contact surfaces 75*a* is flush with the side surface 74*a* and the other of the contact surfaces 75*a* is flush with the side surface 74*b*.

With the constant-temperature transport container 10B in accordance with one or more embodiments, it is possible to prevent external air from flowing into the insides of the side wall panels 1 to 4 and to efficiently set storage materials (a heat storage material(s) or a cold storage material(s)) into the side wall panels 1 to 4.

In the constant-temperature transport container 10B, the fitting corner 7B is moved toward the side surface 1*c* from a side surface side of the constant-temperature transport container 10 so that the fitting recess 1*e* is fitted to the one fitting projection 75*e*. When the fitting recess 1*e* is fitted to the one fitting projection 75*e* in this manner, the fitting recess 2*e* is also fitted to the other fitting projection 75*e*. That is, the fitting corner 7B is configured to be inserted for fitting from the side surface side of the constant-temperature transport container 10B. Thus, with the constant-temperature transport container 10B, the efficiency of the fitting work of the fitting corner 7B is enhanced.

In the constant-temperature transport container 10B in accordance with one or more embodiments, the side wall panels 1 and 4 are connected to each other by a projection-and-recess fitting structure via the side surface 1*d*, which is opposite to the insertion corner Y, and the side surface 4*d*, which is opposite to the insertion corner Z. To be more specific, the side surface 1*d* is provided with a fitting projection if. The fitting projection if is a long projection extending in the up-down direction. Further, a portion of the side wall panel 4 which portion is close to the side surface 4*d*, i.e., a portion of the side wall panel 4 which portion faces the side surface 1*c* has a fitting recess 4*f* that is to be fitted to the fitting projection 1*f*. The fitting recess 4*f* is a recessed groove extending in the up-down direction.

Similarly, the side wall panels 2 and 3 are connected to each other by a projection-and-recess fitting structure via the side surface 2*d*, which is opposite to the insertion corner Y, and the side surface 3*d*, which is opposite to the insertion corner Z. The side surface 3*d* is provided with a fitting projection 3*f*. Further, a portion of the side wall panel 2 which portion is close to the side surface 2*d*, i.e., a portion of the side wall panel 2 which portion faces the side surface 3*c* has a fitting recess 2*f* that is to be fitted to the fitting projection 3*f*. The fitting projection 3*f* is a long projection extending in the up-down direction. The fitting recess 2*f* is a recessed groove extending in the up-down direction.

Embodiment 4

The following will provide a description of another embodiment of one or more embodiments of the present invention. For convenience, members having identical functions to those of the foregoing embodiment are given identical reference signs, and their descriptions will be omitted.

Figure 5:
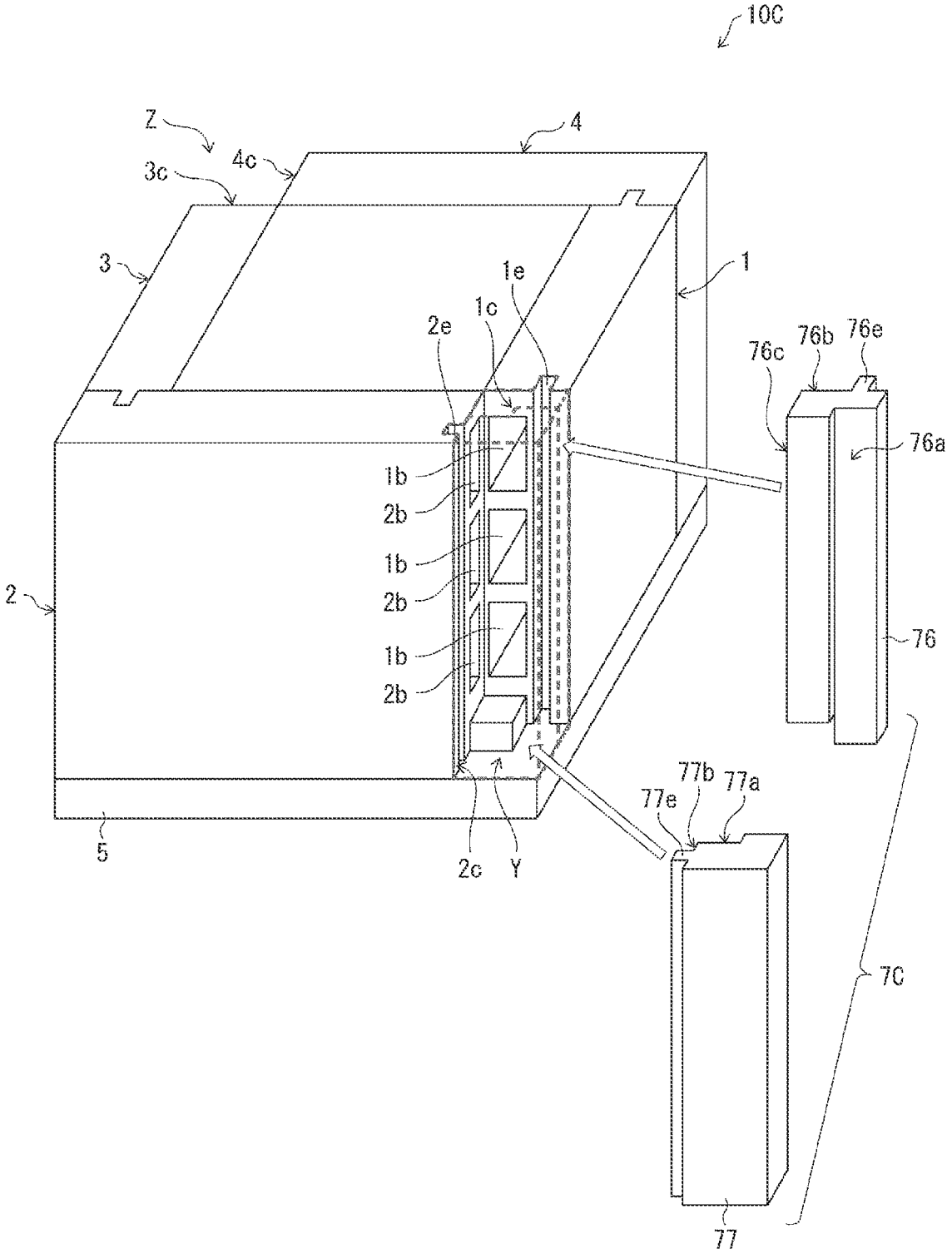
FIG. 5 is a perspective view schematically illustrating a configuration of a constant-temperature transport container in accordance with Embodiment 4 of one or more embodiments of the present invention.

FIG. 5 is a perspective view schematically illustrating a configuration of a constant-temperature transport container 10C in accordance with one or more embodiments. Note that, for simplification, FIG. 5 does not illustrate a storage part 1*a*, a storage part 2*a*, and a ceiling panel 6.

As shown in FIG. 5, the constant-temperature transport container 10C in accordance with one or more embodiments differs from Embodiment 1 in a configuration of a fitting corner 7C. As shown in FIG. 5, the fitting corner 7C is made of a plurality of members that are assembled. To be more specific, the fitting corner 7C is made of members 76 and 77 that are assembled.

The fitting corner 7C is an assembled body obtained by assembling the members 76 and 77, and is structured so as to be accommodated in a space formed by side surfaces 1*c* and 2*c* at an insertion corner Y. Each of the members 76 and 77 has a columnar shape extending in an up-down direction. The member 76 includes a fitting part 76*a*, side surfaces 76*b* and 76*c*, and a fitting projection 76*e*. The member 77 includes a fitting part 77*a*, side surfaces 77*b* and 77*c*, and a fitting projection 77*e*. Via projection-and-recess fitting of the fitting parts 76*a* and 77*a*, the members 76 and 77 are connected to each other. When the members 76 and 77 are fitted to each other, the side surfaces 76*c* and 77*b* are flush with each other. The fitting projection 76*e* of the member 76 fits with the fitting recess 1*e* of the side wall panel 1. Meanwhile, the fitting projection 77*e* of the member 77 is fitted to the fitting recess 2*e* of the side wall panel 2.

When the fitting corner 7C is fitted to the side surfaces 1*c* and 2*c*, the side surface 76*b* of the member 76 is in contact with the side surface 1*c* of the side wall panel 1. The side surface 76*c* of the member 76 and the side surface 77*b* of the member 77 are in contact with the side surface 2*c* of the side wall panel 2.

With the constant-temperature transport container 10C in accordance with one or more embodiments, it is possible to prevent external air from flowing into the insides of the side wall panels 1 to 4 and to efficiently set storage materials (a heat storage material(s) or a cold storage material(s)) into the side wall panels 1 to 4.

Particularly, in the constant-temperature transport container 10C, the fitting corner 7C is constituted by the member 76 having the fitting projection 76*e* that is to be fitted to the fitting recess 1*e* and the member 77 having the fitting projection 77*e* that is to be fitted to the fitting recess 2*e*. The members 76 and 77 can be assembled together by fitting the fitting parts 76*a* and 77*a* to each other. By employing, as members constituting the fitting corner 7C, the member 76 that is to be fitted to the side surface 1*c* and the member 77 that is to be fitted to the side surface 2*c*, the efficiency of the fitting work of the fitting corner 7C is enhanced.

For example, the fitting work can be carried out in the following manner. First, the member 76 is laterally moved so as to get closer to the side surface 1*c*, so that the member 76 is fitted to the side surface 1*c*. Then, the member 77 is laterally moved so as to get closer to the side surface 2*c*, so that the member 77 is fitted to the side surface 2*c* and the members 76 and 77 are connected to each other via fitting of the fitting parts 76*a* and 77*a*. In this manner, in the fitting work of the fitting corner 7C, it is possible to fit the members 76 and 77 to the side surfaces 1*c* and 2*c*, respectively, from the side surface sides of the constant-temperature transport container 10C. Thus, the efficiency of the fitting work of the fitting corner 7C is enhanced.

Embodiment 5

The following will provide a description of another embodiment of one or more embodiments of the present invention. For convenience, members having identical functions to those of the foregoing embodiment are given identical reference signs, and their descriptions will be omitted.

Figure 6:
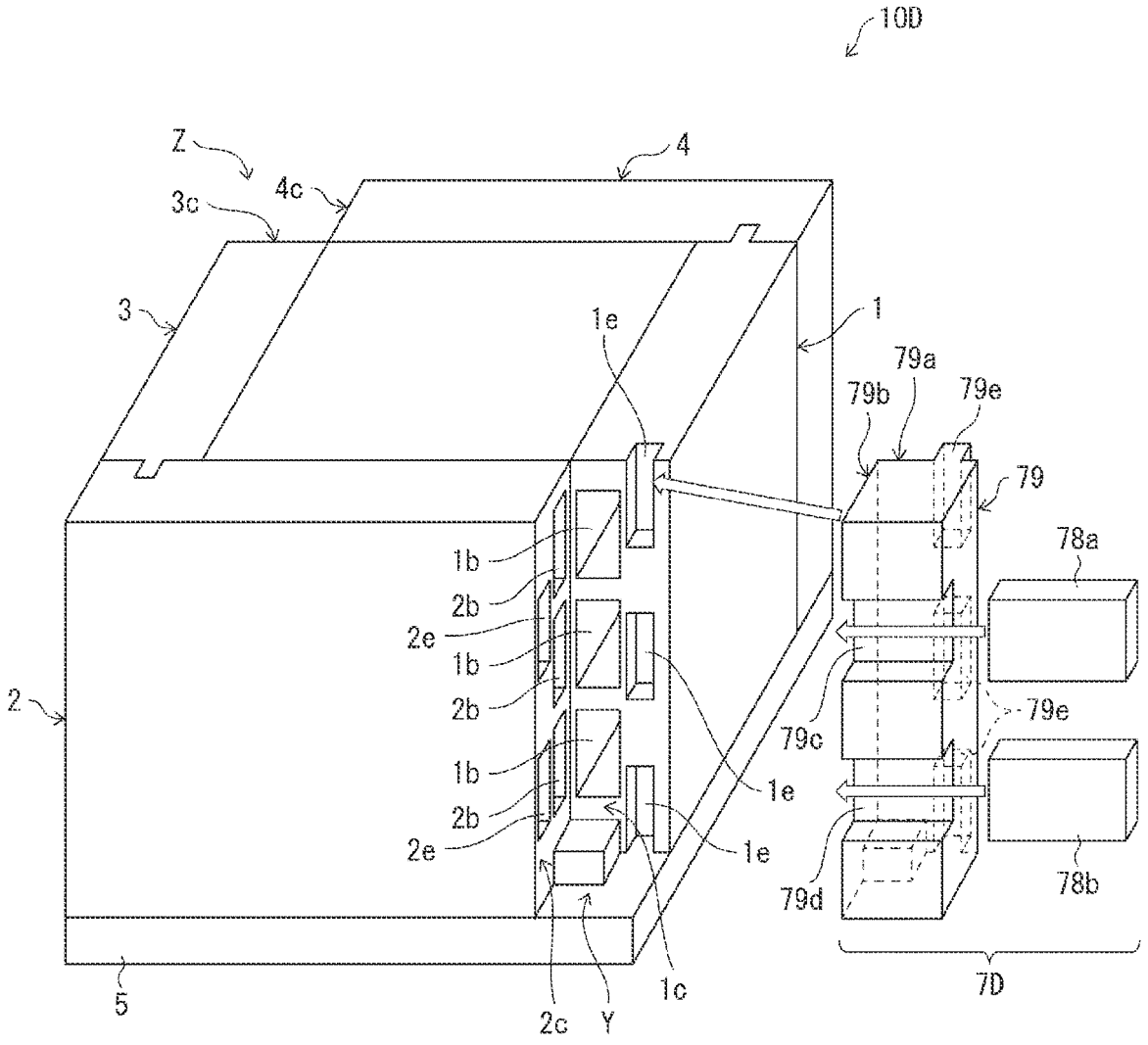
FIG. 6 is a perspective view schematically illustrating a configuration of a constant-temperature transport container in accordance with Embodiment 5 of one or more embodiments of the present invention.

FIG. 6 is a perspective view schematically illustrating a configuration of a constant-temperature transport container 10D in accordance with one or more embodiments. Note that, for simplification, FIG. 6 does not illustrate a storage part 1*a*, a storage part 2*a*, and a ceiling panel 6.

As shown in FIG. 6, the constant-temperature transport container 10D in accordance with one or more embodiments differs from Embodiment 1 in a configuration of a fitting corner 7D. As shown in FIG. 6, the fitting corner 7D is made of a plurality of members that are assembled. To be more specific, the fitting corner 7D is made of members 78*a*, 78*b*, and 79 that are assembled. In the insertion corner Y, a side surface 1*c* has three fitting recesses 1*e* aligned in an up-down direction. A side surface 2*c* has two fitting recesses 2*e* aligned in the up-down direction.

The fitting corner 7D is an assembled body obtained by assembling the members 78*a*, 78*b*, and 79, and is structured so as to be accommodated in a space formed by side surfaces 1*c* and 2*c* at an insertion corner Y. Each of the members 78*a* and 78*b* is in the form of a rectangular parallelepiped extending in a horizontal direction. The members 78*a* and 78*b* are fitted to the fitting recesses 2*e* along a horizontal direction of the side wall panel 2.

The member 79 has a columnar shape extending in the up-down direction. The member 79 has side surfaces 79*a* and 79*b*, horizontal recessed grooves 79*c* and 79*d*, and three fitting projections 79*e*. When the fitting corner 7D fits with the side surfaces 1*c* and 2*c*, the side surfaces 79*a* and 79*b* are in contact with the side surfaces 1*c* and 2*c*, respectively. The fitting projections 79*e* is fitted to the fitting recesses 1*e* of the side wall panel 1. The three fitting projections 79*e* are formed so as to be aligned in the up-down direction. The three fitting recesses 1*e* are formed so as to respectively correspond to the three fitting projections 79*e*.

Each of the horizontal recessed grooves 79*c* and 79*d* is a groove extending in the horizontal direction of the side wall panel 2. The horizontal recessed grooves 79*c* and 79*d* are formed so as to be connected to the two fitting recesses 2*e*. The side surfaces of the member 78*a* slide over all the side surfaces of the horizontal recessed groove 79*c* along the horizontal direction of the side wall panel 2 without making any gap. Similarly, the side surfaces of the member 78*b* slide over all the side surfaces of the horizontal recessed groove 79*d* along the horizontal direction of the side wall panel 2. Thus, the members 78*a* and 78*b* move through the horizontal recessed grooves 79*c* and 79*d* of the member 79 so as to be fitted to the fitting recesses 2*e*.

With the constant-temperature transport container 10D in accordance with one or more embodiments, it is possible to prevent external air from flowing into the insides of the side wall panels 1 to 4 and to efficiently set storage materials (a heat storage material(s) or a cold storage material(s)) into the side wall panels 1 to 4.

Particularly, in the constant-temperature transport container 10D, the fitting corner 7D is constituted by the members 78*a* and 78*b* that are to be fitted to the fitting recesses 2*e* and the member 79 having the fitting projections 79*e* that are to be fitted to the fitting recesses 1*e*. Further, the members 78*a*, 78*b*, and 79 can be assembled together via the horizontal recessed grooves 79*c* and 79*d*. By employing, as members constituting the fitting corner 7C, the member 79 that is to be fitted to the side surface 1*c* and the members 78*a* and 78*b* that are to be fitted to the side surface 2*c*, the efficiency of the fitting work of the fitting corner 7D is enhanced.

For example, the fitting work can be carried out in the following manner. First, the member 79 is laterally moved so as to get closer to the side surface 1*c*, so that the member 79 is fitted to the side surface 1*c*. Then, the members 78*a* and 78*b* are moved to respectively pass through the horizontal recessed grooves 79*c* and 79*d* of the member 79 so as to get closer to the side surface 2*c*, so that the members 78*a* and 78*b* are fitted to the side surface 2*c*. In this manner, in the fitting work of the fitting corner 7D, it is possible to fit the member 79 to the side surface 1*c* and to fit the members 78*a* and 78*b* to the side surface 2*c* from the side surface side of the constant-temperature transport container 10D. Thus, the efficiency of the fitting work of the fitting corner 7D is enhanced.

Figure 7:
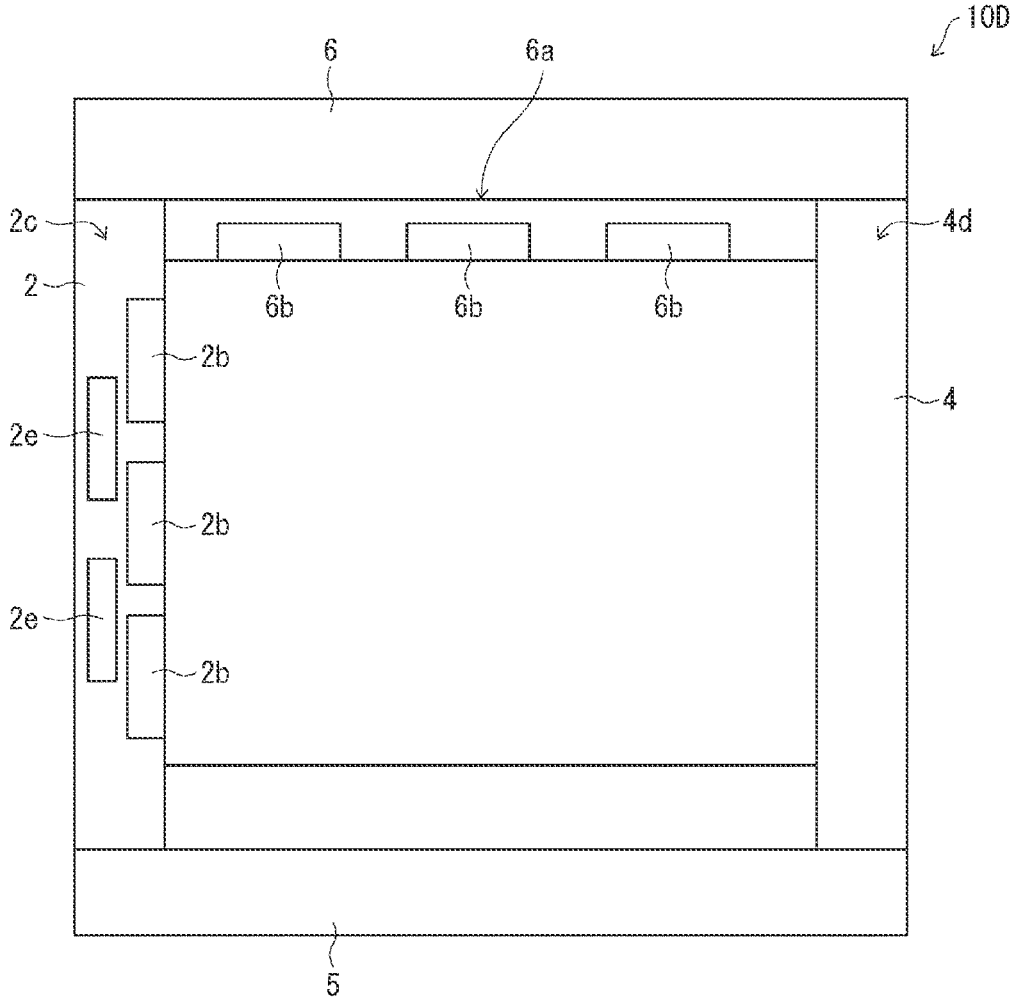
FIG. 7 is a front view schematically illustrating a configuration of the constant-temperature transport container in accordance with Embodiment 5 of one or more embodiments of the present invention.

In the constant-temperature transport container 10D in accordance with one or more embodiments, the ceiling panel 6 is provided with insertion openings 6*b* (second insertion openings). FIG. 7 is a front view schematically illustrating a configuration of the constant-temperature transport container 10D in accordance with one or more embodiments. Note that FIG. 7 is a front view of the constant-temperature transport container 10D in which the side wall panel 1 is omitted, the constant-temperature transport container 10D being seen in a horizontal direction of the side wall panels 2 and 4.

As shown in FIG. 7, in the constant-temperature transport container 10D in accordance with one or more embodiments, the insertion openings 6*b* are openings into which stored materials (a heat storage material(s) or a cold storage material(s)) are to be inserted and which communicate with storage parts 6*a* (second housing parts) of the ceiling panel 6. That is, in the constant-temperature transport container 10D, lateral insertion of the stored materials is possible not only for the side wall panels 1 to 4 but also for the ceiling panel 6. Thus, in the constant-temperature transport container 10D, it is possible to laterally insert the stored material also into the ceiling panel 6. Note that the configuration shown in FIG. 7 is applicable to any of the constant-temperature transport containers 10 and 10A to 10C in accordance with the foregoing Embodiments 1 to 4. Note that the storage parts 6*a* and the insertion openings 6*b* are similar to storage parts 6*a* and insertion openings 6*b* in a constant-temperature transport container 10E in accordance with the later-described Embodiment 6. Therefore, for details of the storage parts 6*a* and the insertion openings 6*b*, the later-described Embodiment 6 can be referred to.

Embodiment 6

The following will provide a description of another embodiment of one or more embodiments of the present invention. For convenience, members having identical functions to those of the foregoing embodiment are given identical reference signs, and their descriptions will be omitted.

Figure 8:
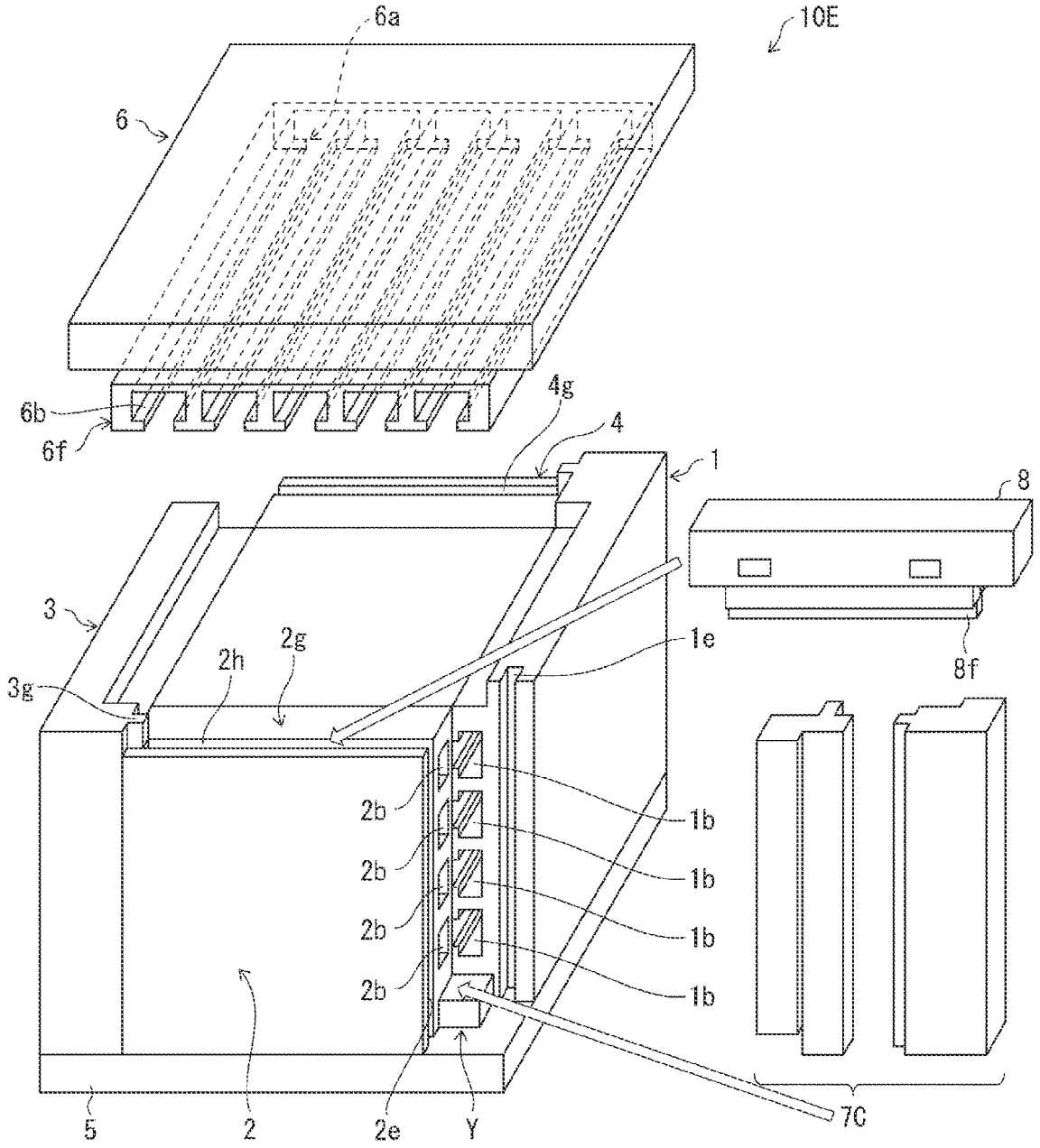
FIG. 8 is an exploded perspective view schematically illustrating a configuration of a constant-temperature transport container in accordance with Embodiment 6 of one or more embodiments of the present invention.

FIG. 8 is an exploded perspective view schematically illustrating a configuration of the constant-temperature transport container 10E in accordance with one or more embodiments.

As shown in FIG. 8, the constant-temperature transport container 10E in accordance with one or more embodiments differs from the foregoing Embodiments 1 to 5 in a connected part between (i) side wall panels 2 and 4 and (ii) a ceiling panel 6 which connecting part. The ceiling panel 6 has storage parts 6*a* in which heat storage materials are to be stored and insertion openings 6*b* (second insertion openings) through which the heat storage materials are to be inserted into the storage parts 6*a*. The insertion openings 6*b* are provided both in a side surface 6*f* of the ceiling panel 6 and in a side surface (not illustrated) of the ceiling panel 6 which side surface is opposite to the side surface 6*f*. Note that the insertion openings 6*b* may be provided at least one side surface of the ceiling panel 6.

As discussed above, in the constant-temperature transport container 10E, the insertion openings 6*b* are provided in the side surface 6*f* of the ceiling panel 6, and the storage parts 6*a* (second storage parts) communicating with the insertion openings 6*b* extends laterally. Thus, at the time of assembling of the constant-temperature transport container 10E, heat storage materials can be inserted into the ceiling panel 6 from its lateral side.

In the constant-temperature transport container 10E, the ceiling panel 6 and the side wall panels 1 to 4 form second insertion corners for heat storage materials. One of the second insertion corners is formed by the side surface 6*f*, provided with the insertion openings 6*b*, of the ceiling panel 6 and an upper surface 2*g* of the side wall panel 2 adjacent to the side surface 6*f*. Further, in the second insertion corner, the insertion openings 6*b* are exposed to the outside. Although not illustrated in FIG. 8, another second insertion corner is similarly formed by (i) the side surface of the ceiling panel 6 which side surface is opposite to the side surface 6*f* provided with the insertion openings 6*b* and (ii) an upper surface of the side wall panel 4 adjacent to the side surface opposite to the side surface 6*f*.

Further, in the constant-temperature transport container 10E, the second insertion corner is provided with a fitting corner 8 (second fitting corner). The fitting corner 8 is structured to close the insertion openings 6*b* and to be fitted to at least one of the side surface 6*f* provided with the insertion openings 6*b* and the upper surface 2*g* of the side wall panel 2. Specifically, the upper surface 2*g* of the side wall panel 2 has a fitting recess 2*h*. Similarly, the upper surface of the side wall panel 4 has a fitting recess 4*g*. Each of the fitting recesses 2*h* and 4*g* is a recessed groove extending in horizontal directions of the side wall panels 2 and 4.

The fitting corner 8 has a shape that can be accommodated in a space in the second insertion corner which space is formed by the side surface 6*f* and the upper surface 2*g*. The fitting corner 8 is fitted to the second insertion corner such that the fitting corner 8 is flush with the side wall panel 2 and the ceiling panel 6. The fitting corner 8 has a surface which faces the upper surface 2*g* and which is provided with a fitting projection 8*f* that is to be fitted to the fitting recess 2*h*. The fitting projection 8*f* is a long projection extending in the horizontal direction of the side wall panel 2. When the upper surface 2*g* of the side wall panel 2 and the fitting corner 8 is fitted to each other in the second insertion corner, the insertion openings 6*b* are closed. Consequently, it is possible to prevent external air from flowing into the insides of the storage parts of the ceiling panel 6.

Note that the fitting corner 8 may be structured to be fitted to the side surface 6*f* of the ceiling panel 6. The fitting corner 8 may be further structured to be fitted to the side wall panel 3, which is adjacent to the side wall panel 2. As shown in FIG. 8, the side wall panel 3 has a surface which faces the fitting corner 8 and which is provided with a fitting projection 3*g*. The fitting projection 3*g* is a long projection extending in the up-down direction. The fitting corner 8 has a fitting recess (not illustrated) which is a recessed groove that is to be fitted to the fitting projection 3*g*.

With the constant-temperature transport container 10E in accordance with one or more embodiments, it is possible to attain the following effects in assembling of the constant-temperature transport container 10E.

That is, according to the method for assembling the constant-temperature transport container 10E, the four side wall panels 1 to 4 are set to the bottom panel 5 such that the four side wall panels 1 to 4 stand on the bottom panel 5 to yield a container main body, and then the ceiling panel 6 is connected to an upper end portion of the container main body. In a state where the ceiling panel 6 is connected to the upper end portion of the container main body in this manner, the second insertion corner is formed. Thus, a user does not have to lift the very heavy ceiling panel 6 in which heat storage materials are set so as to connect the ceiling panel 6 to the upper end portion of the container main body. The user may connect, to the upper end portion of the container main body, the light ceiling panel 6 in which no heat storage material is set. Then, after connection of the ceiling panel 6, the user may insert heat storage materials through the insertion openings 6*b* so as to set the heat storage materials into the ceiling panel 6. Thus, by employing the configuration of the constant-temperature transport container 10E, it is possible to reduce the burden imposed on the user at the time of assembling of the ceiling panel 6.

Then, after setting the heat storage materials into the ceiling panel 6, the user may fit the fitting corner 8 to the second insertion corner. Consequently, the constant-temperature transport container 10E is completed.

Note that the fitting corner 8 may be provided with a grip. For example, at the time of disassembling the constant-temperature transport container 10E, the user may use the grip to pull the fitting corner 8 out from the side wall panel 2 and the ceiling panel 6. This facilitates disassembling of the constant-temperature transport container 10E.

Embodiments 7 to 10 of One or More Embodiments of the Present Invention

Each of constant-temperature transport containers in accordance with Embodiments 7 to 10 of one or more embodiments of the present invention includes, in addition to any of the configurations of the foregoing Embodiments 1 to 6, a configuration in which adjacent ones, in an up-down direction, of housing parts for heat storage materials have a communication hole allowing the adjacent ones, in the up-down direction, of the housing parts to communicate with each other.

In comparison with the vertical-insertion-type constant-temperature transport containers of Patent Literatures 3 and 4, the lateral-insertion-type constant-temperature transport container of Patent Literature 5 is advantageous in workability, i.e., ease of housing heat storage materials in the side wall panels.

However, although the lateral-insertion-type constant-temperature transport container involves superior workability in comparison with the vertical-insertion-type constant-temperature transport container as described above, the present inventors found, as a result of the study, that the lateral-insertion-type constant-temperature transport container has a shorter time for which the temperature in the constant-temperature transport container is maintained.

Embodiments 7 to 10 of one or more embodiments of the present invention are to provide a constant-temperature transport container that can bring about the effects of the foregoing Embodiments 1 to 6, that can enhance the workability of housing heat storage materials in side wall panels, and that can elongate the time for which the temperature in the container is maintained.

Outlines of Embodiments 7 to 10 of One or More Embodiments of the Present Invention The present inventors conducted further study on the lateral-insertion-type constant-temperature transport container. As a result, the present inventors found, through their own study, that the lateral-insertion-type constant-temperature transport container involves a shorter time for which the temperature of the temperature-keeping target article is maintained than that of the vertical-insertion-type constant-temperature transport container. The shorter time for which the temperature of the lateral-insertion-type constant-temperature transport container is maintained had never been recognized in the technical field of one or more embodiments of the present invention. In view of this, the present inventors diligently carried out research in order to develop a lateral-insertion-type constant-temperature transport container involving a longer time for which the temperature is maintained.

As a result, the present inventors arrived at the following new finding. That is, by configuring a constant-temperature transport container so as to have communication holes allowing adjacent ones, in an up-down direction, of housing parts for heat storage materials to communicate with each other, the workability is enhanced. Not only this, surprisingly, the constant-temperature transport container configured as such is remarkably excellent also in terms of the time for which the temperature is maintained, as compared to the vertical-insertion-type constant-temperature transport container. On the basis of the new finding, the present inventors completed a constant-temperature transport container in accordance with one or more embodiments.

That is, each of the constant-temperature transport containers in accordance with Embodiments 7 to 10 of one or more embodiments of the present invention is an assembled constant-temperature transport container that enables transportation of a temperature-keeping target article at a constant temperature and that includes side wall panels, a ceiling panel, and a bottom panel and has the following features. That is, each of the constant-temperature transport containers in accordance with Embodiments 7 to 10 of one or more embodiments of the present invention is configured to include, in addition to any of the configurations of the foregoing Embodiments 1 to 6, the feature wherein: each of the side wall panels includes housing parts within which heat storage materials are to be housed and insertion openings which are provided in a side surface of the side wall panel and through which the heat storage materials are to be inserted into the housing parts; the housing parts are aligned in an up-down direction; and adjacent ones, in the up-down direction, of the housing parts have a communication hole allowing the adjacent ones, in the up-down direction, of the housing parts to communicate with each other.

With the above configuration, (i) the housing parts for the heat storage materials are aligned in the up-down direction, and (ii) adjacent ones, in the up-down direction, of the housing parts have a communication hole allowing the adjacent ones, in the up-down direction, of the housing parts to communicate with each other. With this configuration, the workability of housing the heat storage materials in the side wall panels is enhanced, and the time for which the temperature is maintained is elongated.

Embodiment 7

Figure 9:
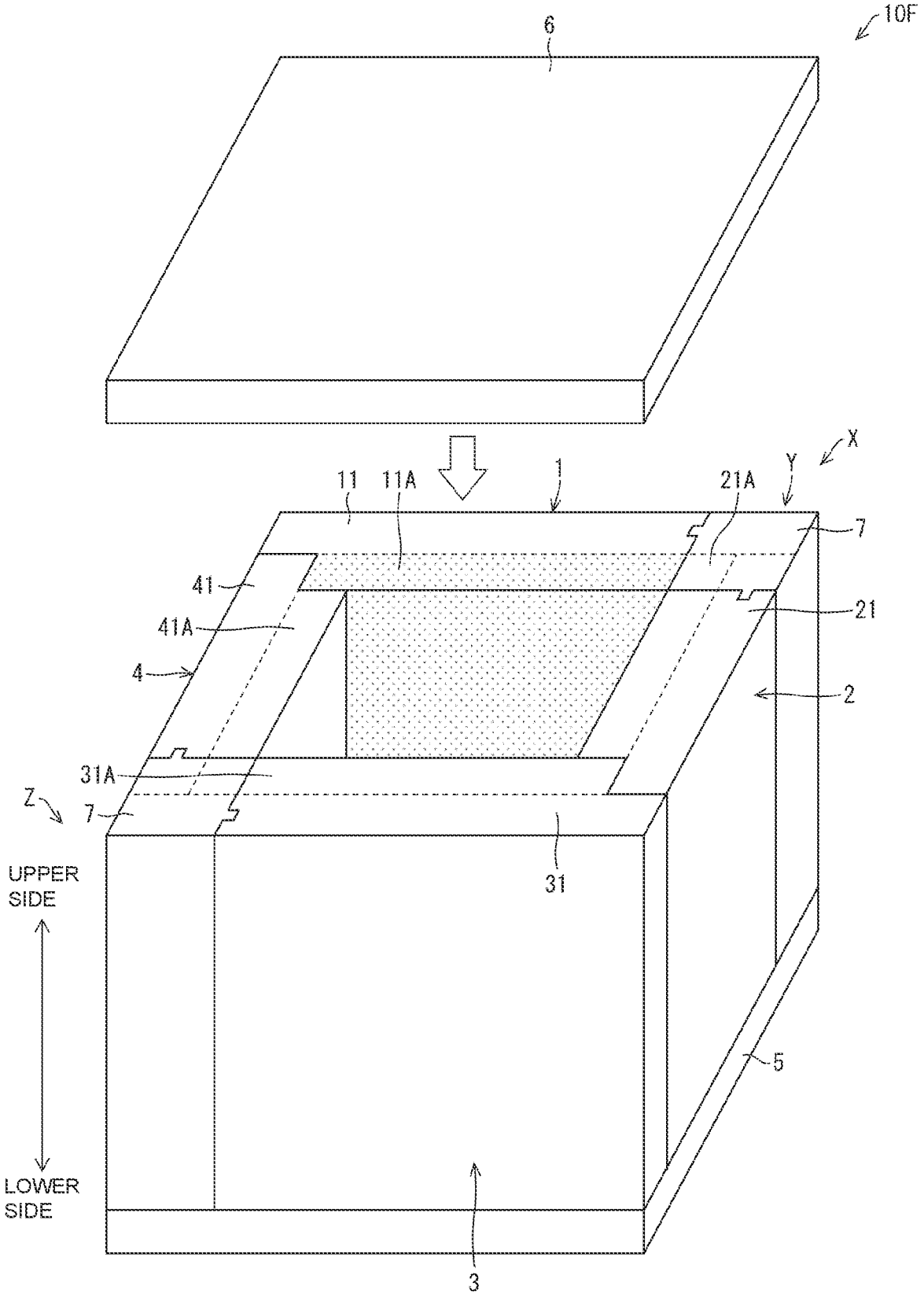
FIG. 9 is an exploded perspective view schematically illustrating a configuration of a constant-temperature transport container in accordance with Embodiment 7 of one or more embodiments of the present invention.

The following will provide a detail description of Embodiment 7 of one or more embodiments of the present invention. FIG. 9 is an exploded perspective view schematically illustrating a configuration of a constant-temperature transport container 10F in accordance with Embodiment 7 of one or more embodiments of the present invention.

As shown in FIG. 9, the constant-temperature transport container 10F in accordance with one or more embodiments is configured such that, similarly to Embodiments 1 to 6, the fitting corners 7 and 7 respectively are fitted to the insertion corners Y and Z.

The constant-temperature transport container 10F in accordance with one or more embodiments differ from Embodiments 1 to 6 in configurations of side wall panels 1, 2, 3, and 4. The side wall panels 1, 2, 3, and 4 respectively have panel main bodies 11, 21, 31, and 41, each of which is a quadrangular plate. The panel main bodies 11, 21, 31, and 41 can be separated from each other. Here, regarding the side wall panels 1, 2, 3, and 4, a side close to the bottom panel 5 is designated as a "lower side", whereas a side close to the ceiling panel 6 is designated as an "upper side". In the side wall panels 1, 2, 3, and 4, the panel bodies 11, 21, 31, and 41 are respectively provided with internal structures 11A, 21A, 31A, and 41A.

Figure 10A:
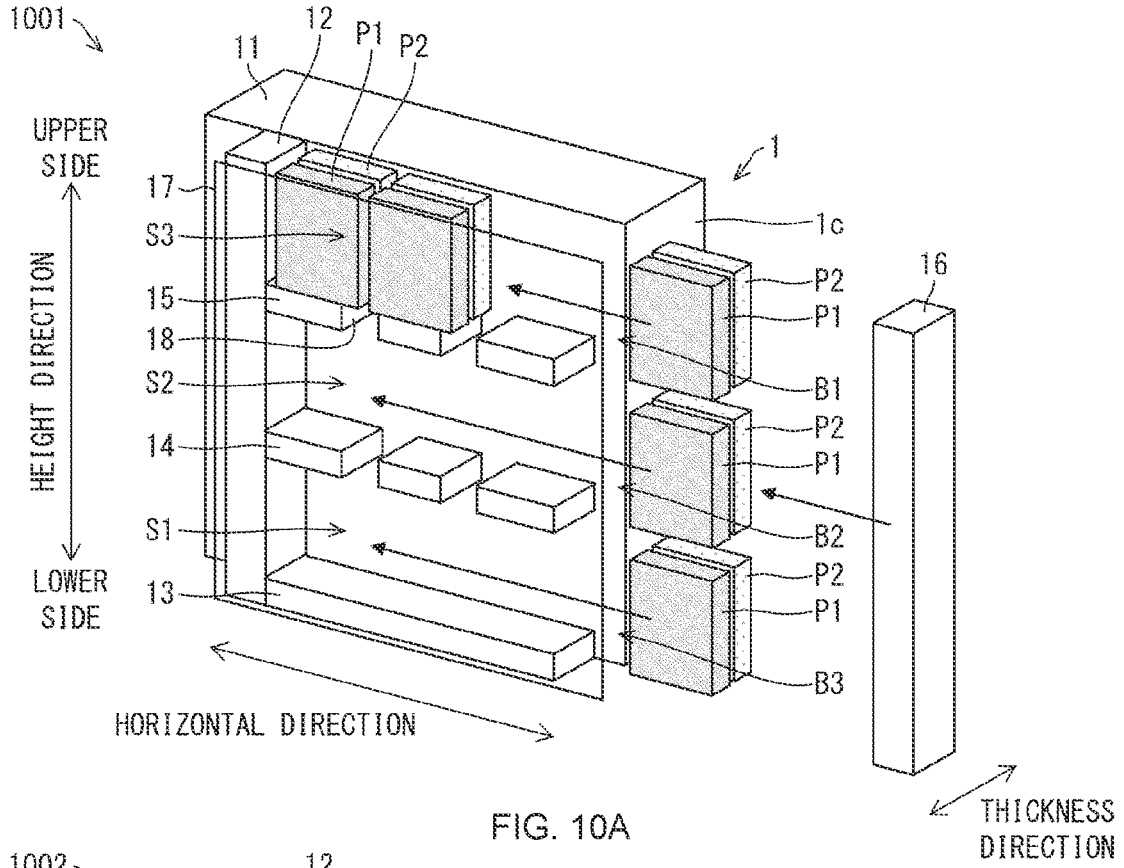
FIG. 10A (1001) is an exploded perspective view schematically illustrating a configuration of a side wall panel included in the constant-temperature transport container shown in FIG. 9.
Figure 10B:
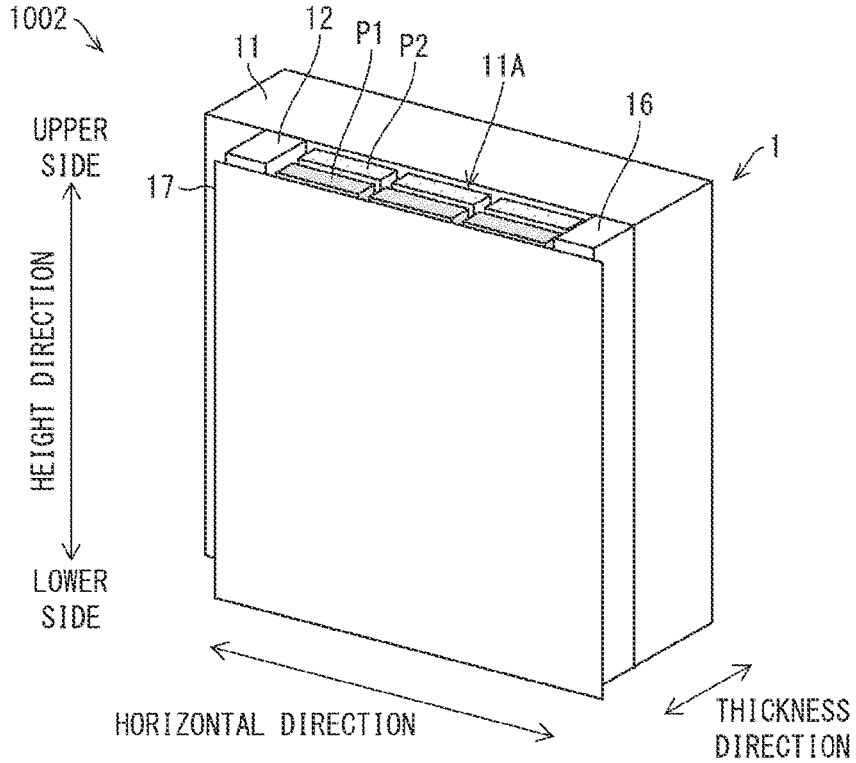
FIG. 10B (1002) is a perspective view schematically illustrating an appearance of a side wall panel included in the constant-temperature transport container shown in FIG. 9.
Figure 11:
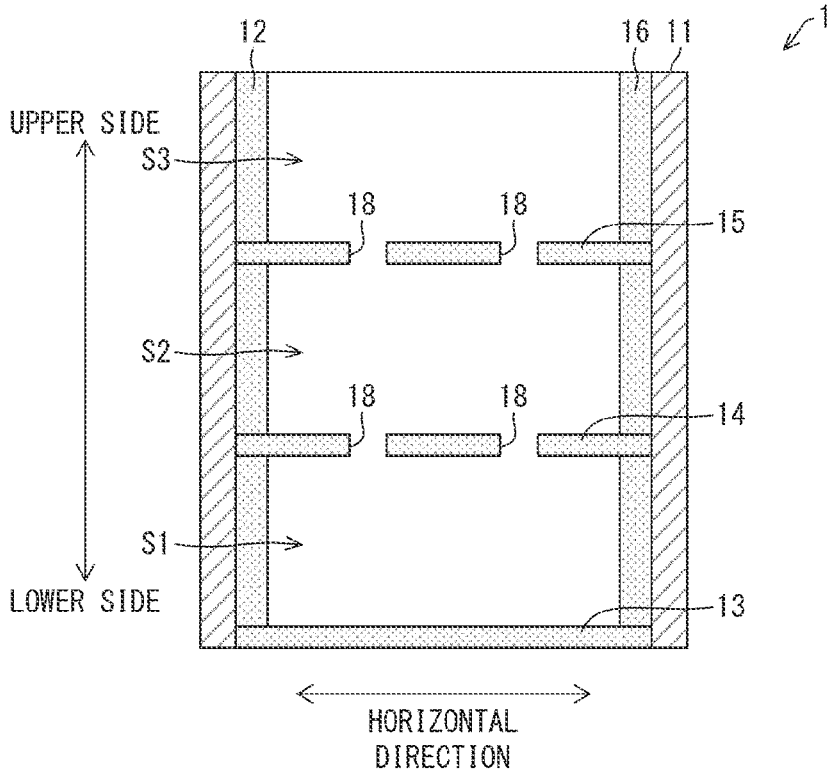
FIG. 11 is a front view illustrating an internal configuration of a side wall panel included in the constant-temperature transport container shown in FIG. 9, the front view being obtained when the side wall panel is seen from the inner side.

Next, the following will describe configurations of the side wall panels 1 to 4. The following description will focus on the configuration of the side wall panel 1. The side wall panels 2 to 4 are identical in configuration to the side wall panel 1, and therefore a description of the configurations of the side wall panels 2 to 4 is omitted. 1001 of FIG. 10A is an exploded perspective view schematically illustrating a configuration of the side wall panel 1, whereas 1002 of FIG. 10B is a perspective view schematically illustrating an appearance of the side wall panel 1. FIG. 11 is a front view illustrating an internal configuration of the side wall panel 1, the front view being obtained when the side wall panel 1 is seen from the inner side of the side wall panel 1.

As shown in 1001 and 1002 of FIGS. 10A-B and FIG. 11, the side wall panel 1 has housing parts S1 to S3 in which stored materials P1 and P2, which are heat storage materials, are to be housed and insertion openings B1 to B3 through which the stored materials P1 and P2 are to be inserted into the housing parts S1 to S3. The insertion openings B1 to B3 are provided in one side surface 1*c* of the side wall panel 1.

The stored materials P1 and P2 are heat storage materials having different melting temperature ranges. Alternatively, the stored materials that are to be stored in the housing parts S1 to S3 may be heat storage materials having identical melting temperature ranges.

In each of the housing parts S1 to S3, the stored materials P1 and P2 are housed in a state where the stored materials P1 and P2 overlap each other in a thickness direction and are arranged in parallel in a horizontal direction. Note that, in each of the housing parts S1 to S3, a single stored material may be housed.

To be more specific, the side wall panel 1 includes the panel main body 11, the internal structure 11A, a closing member 16, and a protecting member 17. The internal structure 11A is provided on an inner surface of the panel main body 11. The internal structure 11A includes a support pillar 12, a lower rail portion 13, an intermediate rail portion 14, and an upper rail portion 15.

The support pillar 12, which protrudes inwardly from an inner surface of the panel main body 11, is disposed at a location opposite to the side surface 1*c*. The support pillar 12 is in the form of a pillar extending in a height direction.

Each of the lower rail portion 13, the intermediate rail portion 14, and the upper rail portion 15 extends toward the side surface 1*c* from the support pillar 12 in the horizontal direction.

The stored materials P1 and P2 inserted through the insertion openings B1 to B3 slide over the lower rail portion 13, the intermediate rail portion 14, and the upper rail portion 1. The lower rail portion 13, the intermediate rail portion 14, and the upper rail portion 15 function as guide rails for guiding the stored materials P1 and P2 toward the inside of the side wall panel 1.

In the height direction, the lower rail portion 13, the intermediate rail portion 14, and the upper rail portion 15 are spaced from each other at equal intervals. This interval only needs to be greater than the sizes of the stored materials P1 and P2 in the height direction. An interval in the height direction between an upper end portion of the support pillar 12 and the upper rail portion 15 may be greater than the sizes of the stored materials P1 and P2 in the height direction. With such a configuration, the stored materials P1 and P2 can be housed in a space between the lower rail portion 13 and the intermediate rail portion 14, a space between the intermediate rail portion 14 and the upper rail portion 15, and a space above the upper rail portion 15. Note that an upper end surface of the support pillar 12 is provided with a ceiling panel 6 (not illustrated) in such a manner as to close a space formed by a side surface of the support pillar 12 and an upper surface of the upper rail portion 15.

The closing member 16 is a member configured to close the insertion openings B1 to B3 from the side surface 1*c* side. There is no particular limitation on the configuration of the closing member 16, provided that the configuration allows the closing member 16 to close the insertion openings B1 to B3. From the viewpoint of preventing the air in the housing parts S1 to S3 from leaking to the outside of the side wall panel 1, the closing member 16 may be structured to be fitted, by a protrusion and a recess, to the insertion openings B1 to B3 of the side wall panel 1.

The protecting member 17 is a sheet configured to cover, from the inside, the support pillar 12, the lower rail portion 13, the intermediate rail portion 14, and the upper rail portion 15 of the panel main body 11. The protecting member 17 is interposed between (i) a temperature-keeping target article and (ii) the stored materials P1 and P2 in the constant-temperature transport container 10. The protecting member 17 fixes the stored materials P1 and P2 so as to prevent the stored materials P1 and P2 from falling over toward the temperature-keeping target article, thereby protecting the temperature-keeping target article from direct contact with the stored materials P1 and P2. Examples of the protecting member 17 include a corrugated plastic sheet, a cardboard, and a plastic sheet.

In the side wall panel 1, the housing part S1 has a space formed by an upper surface of the lower rail portion 13, a lower surface of the intermediate rail portion 14, a side surface of the support pillar 12, the closing member 16, and the protecting member 17. In this space, the stored materials P1 and P2 are housed. The housing part S2 has a space formed by an upper surface of the intermediate rail portion 14, a lower surface of the upper rail portion 15, the side surface of the support pillar 12, the closing member 16, and the protecting member 17. In this space, the stored materials P1 and P2 are housed. The housing part S3 has a space formed by an upper surface of the upper rail portion 15, the ceiling panel 6, the side surface of the support pillar 12, the closing member 16, and the protecting member 17. In this space, the stored materials P1 and P2 are housed. For example, for the housing part S3, sets of stored materials P1 and P2 are inserted through the insertion opening B1 one by one in sequence, and the stored materials P1 and P2 are caused to slide over the upper rail portion 15 so as to be moved horizontally toward the support pillar 12. Consequently, the plurality of stored materials P1 and P2 are housed in the housing part S3.

In the constant-temperature transport container 10F in accordance with one or more embodiments, the housing parts S1 to S3 are aligned in the up-down direction. Further, the housing parts S1 and S2, which are adjacent to each other in the up-down direction, have communication holes 18 allowing the housing parts S1 and S2 to communicate with each other. Similarly, the housing parts S2 and S3, which are adjacent to each other in the up-down direction, have communication holes 18 allowing the housing parts S2 and S3 to communicate with each other.

As shown in 1001 of FIG. 10A and FIG. 11, the communication holes 18 extend in the thickness direction of the side wall panel 1, and allow the housing parts S1 and S2, which are adjacent to each other in the up-down direction, or the housing parts S2 and S3, which are adjacent to each other in the up-down direction, to communicate with each other. Further, in the housing parts S1 to S3 aligned in the up-down direction, the communication holes 18 are arranged so as to overlap each other when viewed in the up-down direction.

In conventional vertical-insertion-type constant-temperature transport containers, stored materials should be inserted from above the side wall panels. Thus, when the size of the constant-temperature transport container increases, the heights of the side wall panels increase. This makes it difficult for a user to put the stored materials into the side wall panels. Particularly in a case where a woman, who is relatively short, carries out the assembling, her eyes hardly contact and/or her hands hardly reach the insertion openings for the stored materials. Therefore, it is difficult for her to put the stored materials into the side wall panels. Further, if the side wall panels are to be moved after the stored materials are housed therein, it is difficult to handle the side wall panels, since the panels are very heavy.

Meanwhile, the constant-temperature transport container 10F in accordance with one or more embodiments has a lateral-insertion-type structure in which the stored materials P1 and P2 are to be inserted into the side wall panel 1 through the insertion openings B1 to B3, which are provided in the side surface 1*c*. Therefore, even when the size of the constant-temperature transport container 10F increases and accordingly the height of the side wall panel 1 increases, a user can easily access the insertion openings for the stored materials. As a result, with the constant-temperature transport container 10F, it is easier to place the stored materials P1 and P2 in the side wall panel 1. Further, it is not necessary to move the heavy side wall panels 1 in which the stored materials P1 and P2 are placed. This makes it possible to reduce the burden of the assembly work, thereby enhancing the workability.

Moreover, in the constant-temperature transport container 10F in accordance with one or more embodiments, the housing parts S1 and S2 (or the housing parts S2 and S3), which are adjacent to each other in the up-down direction, have the communication holes 18 allowing the housing parts S1 and S2 to communicate with each other. Therefore, the constant-temperature transport container 10F can attain a longer time for which the temperature in the container is maintained than that of the vertical-insertion-type constant-temperature transport container.

As discussed above, the constant-temperature transport container 10F in accordance with one or more embodiments brings about the effect of enhancing the workability of housing the stored materials P1 and P2 in the side wall panels 1 to 4 and the effect of elongating the time for which the temperature in the container is maintained.

Here, there is no particular limitation on the materials of the panel main bodies of the side wall panels 1 to 4, the bottom panel 5, and the ceiling panel 6 of the constant-temperature transport container 10F, provided that the materials have a heat insulating property. The materials may be the one used for the constant-temperature transport container 10 in accordance with Embodiment 1.

In the constant-temperature transport container 10F in accordance with one or more embodiments, the ceiling panel 6 may also have housing parts in which stored materials are to be housed. In the ceiling panel 6, the ceiling panel 6 may have or may not have a communication hole through which storage parts communicate with each other.

<Stored Materials (Heat Storage Materials) to be Housed in Ceiling Panel and Side Wall Panels of Constant-Temperature Transport Container in Accordance with One or More Embodiments>

There is no particular limitation on the stored materials to be housed in the side wall panels 1 to 4 and the ceiling panel 6. The stored materials may be the stored material P1 and the stored material P2, which has a lower melting temperature stored material than that of the P1. In the housing part, the stored material P2 may be disposed so as to overlap an outer side (a side opposite to the luggage space) of the stored material P1. Here, there is no particular limitation on the combination of the stored materials P1 and P2. The stored material P1 may be adjusted to have a melting temperature range of 5° C., and the stored material P2 is adjusted to have a melting temperature range of 0° C.

A weight ratio between the stored materials P1 and P2 that are to be stored in the side wall panels 1 to 4 and the ceiling panel 6 can be set as appropriate in accordance with the environment (e.g., summer, winter, etc.) in which the constant-temperature transport container is to be set, the capacity of the luggage space, and/or the like. The weight ratio may be set such that, given the weight of the stored material P1 is 1, the proportion of the weight of the stored material P2 may be not more than 1.5, 0.2 to 1.4, or 0.8 to 1.3.

Particularly, in the summer environment, it is preferable that the weight ratio between the stored materials P1 and P2 be set as above, since this can promote stirring of the air via the communication holes so as to efficiently transmit cold air of the stored material P2 to the stored material P1. Setting the weight ratio as above for the stored materials P1 and P2 is effective particularly in a case where the stored material P1 is adjusted to have a melting temperature range of 5° C. and the stored material P2 is adjusted to have a melting temperature range of 0° C.

Note that the weight of a stored material corresponds to the weight of a heat storage component or a cold storage component stored in the stored material. That is, needless to say, the weight of the heat storage component or the cold storage component stored in the stored material increases in proportion to the weight of the stored material. That is, needless to say, the above-described weight ratio between the stored materials P1 and P2 can be understood by being replaced with the weight ratio between (i) the heat storage component or the cold storage component stored in the stored material P1 and (ii) the heat storage component or the cold storage component stored in the stored material P2.

Further, a heat insulator for adjusting heat transmission may be provided between the stored materials P1 and P2. There is no particular limitation on the material of the heat insulator, provided that it has a heat insulating property. The material of the heat insulator may be a foamed plastic or a vacuum heat insulator. Specific examples of the foamed plastic include foamed polystyrene, foamed polyethylene, foamed polypropylene, foamed polyurethane, and a foamed poly(3-hydroxyalkanoate)-based resin. In terms of the heat insulating property and the cost, the foamed polystyrene is preferable. The heat insulator may have a thickness of 5 mm to 20 mm, or 8 mm to 12 mm.

Embodiment 8

Figure 12:
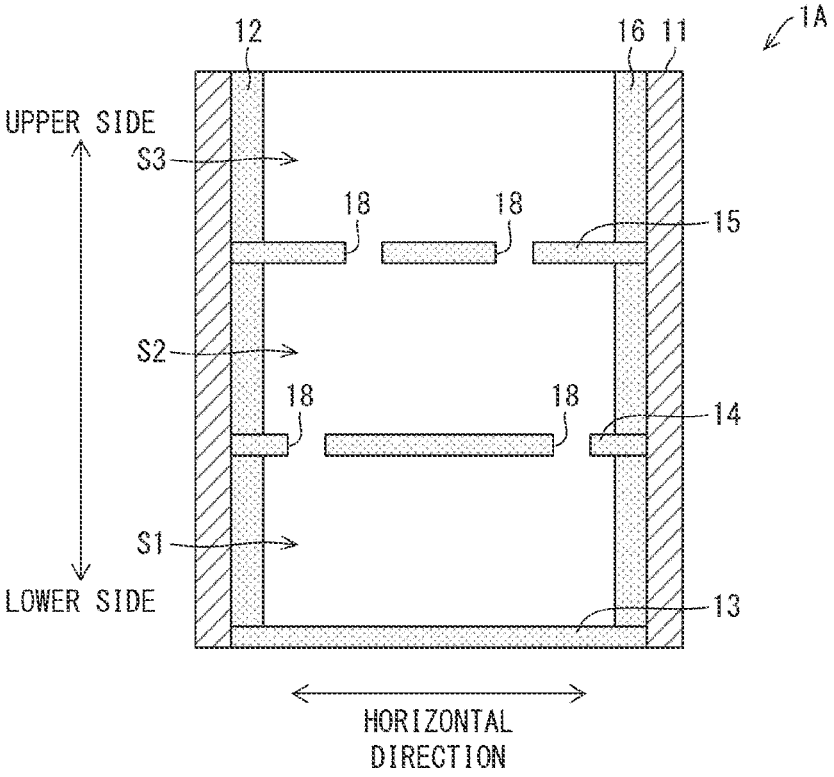
FIG. 12 is a front view illustrating an internal configuration of a side wall panel included in a constant-temperature transport container in accordance with Embodiment 8 of one or more embodiments of the present invention, the front view being obtained when the side wall panel is seen from the inner side.

The following will provide a description of Embodiment 8 of one or more embodiments of the present invention. For convenience, members having identical functions to those of the foregoing embodiment are given identical reference signs, and their descriptions will be omitted. FIG. 12 is a front view illustrating an internal configuration of a side wall panel 1A included in a constant-temperature transport container in accordance with Embodiment 8 of one or more embodiments of the present invention, the front view being obtained when the side wall panel 1A is seen from an inner side.

As shown in FIG. 12, the constant-temperature transport container in accordance with one or more embodiments differ from Embodiment 7 in arrangement of communication holes 18 in a side wall panel 1A. In the housing parts S1 to S3 aligned in the up-down direction, the communication holes 18 are arranged such that the communication holes 18 do not overlap each other when viewed in the up-down direction.

Such a configuration can also bring about the effect of enhancing the workability in housing the stored materials P1 and P2 in the side wall panels 1 to 4 and the effect of elongating the time for which the temperature in the container is maintained.

Embodiment 9

Figure 13:
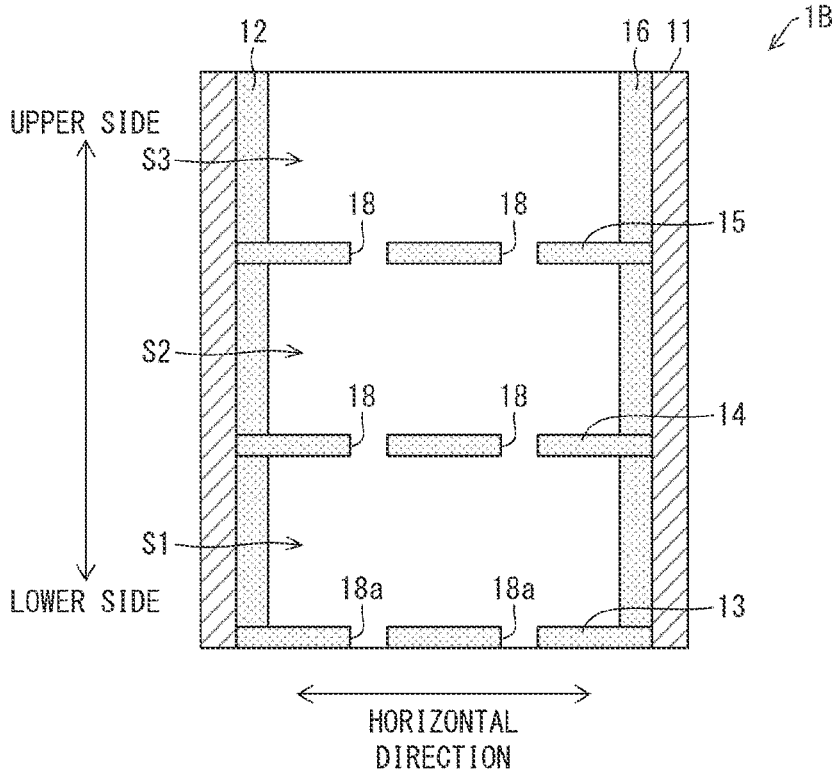
FIG. 13 is a front view illustrating an internal configuration of a side wall panel included in a constant-temperature transport container in accordance with Embodiment 9 of one or more embodiments of the present invention, the front view being obtained when the side wall panel is seen from the inner side.

The following will provide a description of Embodiment 9 of one or more embodiments of the present invention. For convenience, members having identical functions to those of the foregoing embodiment are given identical reference signs, and their descriptions will be omitted. FIG. 13 is a front view illustrating an internal configuration of a side wall panel 1B included in a constant-temperature transport container in accordance with Embodiment 9 of one or more embodiments of the present invention, the front view being obtained when the side wall panel 1B is seen from the inner side.

As shown in FIG. 13, the constant-temperature transport container in accordance with one or more embodiments differs from Embodiment 7 in a configuration of, among housing parts S1 to S3 aligned in an up-down direction, the lowermost housing part S1. A bottom wall of the housing part S1 corresponds to the lower rail portion 13. In the constant-temperature transport container in accordance with one or more embodiments, the housing part S1 has through-holes 18*a* penetrating through the lower rail portion 13.

The through-holes 18*a* are holes that communicate with the outside of the side wall panel 1B. In the constant-temperature transport container in accordance with one or more embodiments, the housing parts S1 to S3 and the luggage space of the constant-temperature transport container communicate with each other via the through-holes 18*a*. Thus, the air (cool air) in the housing parts S1 to S3 flows into the luggage space of the constant-temperature transport container via the through-holes 18*a*.

The constant-temperature transport container in accordance with one or more embodiments is effective particularly when used in an environment having a higher temperature than a controlled temperature range of a temperature-keeping target article. For example, in a case where the constant-temperature transport container is used in a high-temperature environment in summer, the air in the housing parts S1 to S3 flows into the luggage space via the through-holes 18*a*. This can prevent the phenomenon that the temperature in the luggage space exceeds the upper limit of the controlled temperature range. Thus, with the constant-temperature transport container in accordance with one or more embodiments, the time for which the temperature in the container is maintained is further elongated, particularly when the constant-temperature transport container in accordance with one or more embodiments is used in the environment having a higher temperature than a controlled temperature range of the temperature-keeping target article.

Other Variations of Communication Holes 18

The configuration of the communication holes 18 in the constant-temperature transport container 10 is not limited to the configurations of the foregoing Embodiments 7 to 9. In Embodiments 7 to 9, the communication holes 18 are formed in the intermediate rail portion 14 and the upper rail portion 15 as slits extending in the thickness direction. However, in an embodiment of one or more embodiments of the present invention, each communication hole 18 may be structured to allow housing parts S1 and S2 (or housing parts S2 and S3) adjacent to each other in an up-down direction to communicate with each other. For example, the intermediate rail portion 14 (or the upper rail portion 15) may have a mesh structure that allows housing parts S1 and S2 (or housing parts S2 and S3) adjacent to each other in the up-down direction to communicate with each other.

Embodiment 10

The following will provide a description of Embodiment 10 of one or more embodiments of the present invention. For convenience, members having identical functions to those of the foregoing embodiment are given identical reference signs, and their descriptions will be omitted.

A constant-temperature transport container in accordance with one or more embodiments differs from Embodiment 7 mainly in a configuration of the whole of side wall panels. To be more specific, the constant-temperature transport container in accordance with one or more embodiments differs from Embodiment 7 mainly in that (1), among housing parts aligned in an up-down direction, an uppermost housing part has an upper surface that is made of a rail portion provided to a panel main body, rather than a ceiling panel and (2) each rail portion has an inner end portion provided with a long projection protruding upward or downward.

Figure 14:
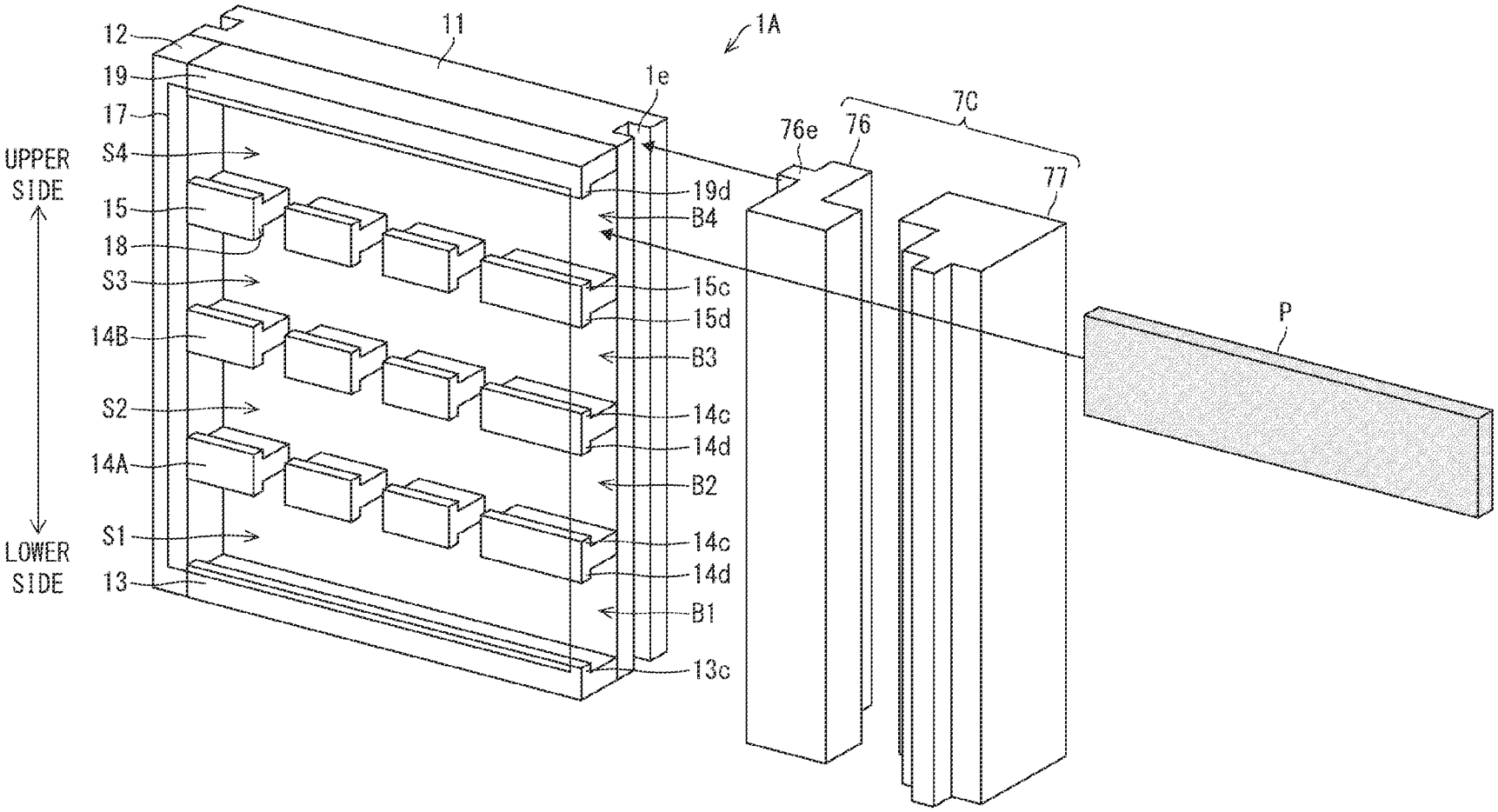
FIG. 14 is a perspective view schematically illustrating an internal configuration of a side wall panel included in a constant-temperature transport container in accordance with Embodiment 10 of one or more embodiments.

The following description will deal with an embodiment of, among side wall panels 1 to 4 shown in FIG. 9, the side wall panel 1. In the constant-temperature transport container in accordance with one or more embodiments, the side wall panels 2 to 4 are identical in configuration to the side wall panel 1, and therefore a description of the configurations of the side wall panels 2 to 4 is omitted. FIG. 14 is a perspective view schematically illustrating an internal configuration of a side wall panel 1A included in the constant-temperature transport container in accordance with one or more embodiments.

The side wall panel 1A of the constant-temperature transport container in accordance with one or more embodiments includes, as the above-described closing member, the fitting corner 7C shown in FIG. 5. As shown in FIG. 14, the side wall panel 1A includes a panel main body 11, a member 76 serving as the closing member, and a protecting member 17. The panel main body 11 has an inner surface provided with a support pillar 12, a lower rail portion 13, an intermediate rail portion 14A, an intermediate rail portion 14B, an upper rail portion 15, and an uppermost rail portion 19.

In a height direction, the lower rail portion 13, the intermediate rail portion 14A, the intermediate rail portion 14B, the upper rail portion 15, and the uppermost rail portion 19 are spaced from each other at equal intervals. The uppermost rail portion 19 is provided in such a manner that the uppermost rail portion 19 is flush with an upper surface of the panel main body 11.

The side wall panel 1A has four housing parts S1 to S4. The housing part S1 has a space formed by an upper surface of the lower rail portion 13, a lower surface of the intermediate rail portion 14A, a side surface of the support pillar 12, the member 76, and a protecting member 17. In this space, a stored material P is housed. The housing part S2 has a space formed by an upper surface of the intermediate rail portion 14A, a lower surface of the intermediate rail portion 14B, the side surface of the support pillar 12, the member 76, and the protecting member 17. In this space, a stored material P is housed. The housing part S3 has a space formed by an upper surface of the intermediate rail portion 14B, a lower surface of the upper rail portion 15, the side surface of the support pillar 12, the member 76, and the protecting member 17. In this space, a stored material P is housed. The housing part S4 has a space formed by an upper surface of the upper rail portion 15, a lower surface of the uppermost rail portion 19, the side surface of the support pillar 12, the member 76, and the protecting member 17. In this space, a stored material P is housed. For example, for the housing part S4, the stored material P is inserted through an insertion opening B4, and the stored material P is caused to slide over the upper rail portion 15 so as to be moved horizontally toward the support pillar 12. Consequently, the stored material P is housed in the housing part S4.

Further, adjacent ones, in an up-down direction, of the housing parts S1 to S4 have communication holes 18 allowing these housing parts to communicate with each other.

Here, in the constant-temperature transport container in accordance with one or more embodiments, each rail portion has an inner end portion provided with a long projection projecting upward or downward. Specifically, the lower rail portion 13 has an inner end portion having a long projection 13*c* projecting upward. The intermediate rail portions 14A and 14B respectively have inner end portions provided with a long projection 14*c* protruding upward and a long projection 14*d* protruding downward. The upper rail portion 15 has an inner end portion provided with a long projection 15*c* protruding upward and a long projection 15*d* protruding downward. The uppermost rail portion 19 has an inner end portion provided with a long projection 19*d* protruding downward. These long projections 13*c*, 14*c*, 14*d*, 15*c*, 15*d*, and 19*d* extend in a horizontal direction of the side wall panel 1A.

Long projections 13*c*, 14*c*, 14*d*, 15*c*, 15*d*, and 19*d* have a function to fasten the stored materials P so as to prevent the stored materials P that are to be housed in the housing parts S1 to S4 from falling over inwardly. Thanks to these long projections, the stored materials P are stably held in the side wall panel 1A. Particularly, in a case where the stored materials P are relatively heavy, the loads of the stored materials P applied to the protecting member 17 are reduced, which makes it possible to stably hold the stored materials P.

In the constant-temperature transport container in accordance with one or more embodiments, the side wall panel 1A may or may not include the protecting member 17. In a case where the side wall panel 1A includes the protecting member 17 as shown in FIG. 14, the cold air of the stored materials P (heat storage materials) hardly flows into the luggage space. Consequently, variations in the temperature in the luggage space are reduced. Meanwhile, in a case where the side wall panel 1A does not include the protecting member 17, the cold air of the stored materials P easily flows into the luggage space. Therefore, if the adjusted temperature of the stored materials P is outside the controlled temperatures, the temperature in the luggage space can be quickly adjusted so as to fall within the controlled temperature range after the stored materials P are set into the side wall panel 1A.

In the constant-temperature transport container in accordance with one or more embodiments, the member 76 is structured to be fitted to a side surface of the panel main body 11. To be more specific, the member 76 has a fitting projection 76*e*. The fitting projection 76*e* is a long projection extending in a height direction. The panel main body 11 has a side surface which faces the closing member 16A and which is provided with a fitting recess 1*e* configured to be fitted to the fitting projection 76*e*. The fitting recess 1*e* is a recessed groove extending in the height direction. Note that the member 77 shown in FIG. 14 is configured to be fitted to a side surface of a side wall panel (corresponding to the side wall panel 2 shown in FIG. 9) adjacent to the side wall panel 1A. That is, in the constant-temperature transport container in accordance with one or more embodiments, the members 76 and 77 constitute the above-described fitting corner 7C. The fitting corner 7C is configured to be fitted to an insertion corner between the side wall panel 1A and the side wall panel adjacent to the side wall panel 1A.

(Variations)

Figure 15:
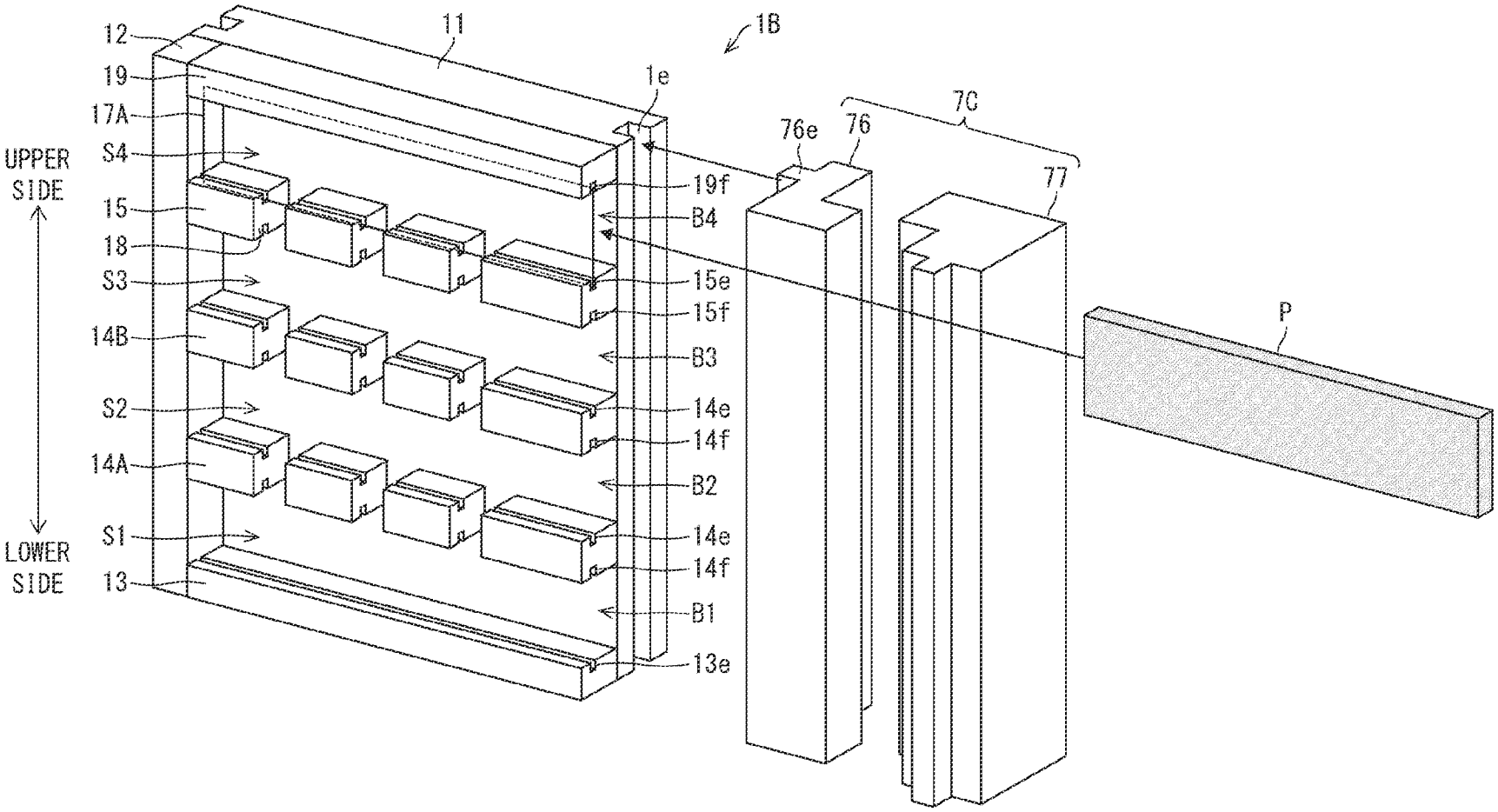
FIG. 15 is a perspective view illustrating an internal configuration of a side wall panel, which is a variation of the side wall panel shown in FIG. 14.

The following description will discuss a variation of the side wall panel included in the constant-temperature transport container in accordance with one or more embodiments. FIG. 15 is a perspective view schematically illustrating an internal configuration of a side wall panel 1B, which is a variation of the side wall panel 1A shown in FIG. 14.

As shown in FIG. 15, the side wall panel 1B differs from the side wall panel 1A in that each rail portion has an inner end portion provided with a slit (recessed groove) extending in a horizontal direction of the side wall panel 1B. Specifically, the lower rail portion 13 has an inner end portion having an upper surface provided with a slit 13*e*. The intermediate rail portion 14A has an inner end portion having an upper surface and a lower surface respectively provided with slits 14*e* and 14*f*. Similarly to the intermediate rail portion 14A, the intermediate rail portion 14B is also provided with slits 14*e* and 14*f*. The upper rail portion 15 has an inner end portion having an upper surface and a lower surface respectively provided with slits 15*e* and 15*f*. The uppermost rail portion 19 has an inner end portion having a lower surface provided with a slit 19*f*.

Into these slits 13*e*, 14*e*, 15*e*, 14*f*, 15*f*, and 19*f*, the protecting member 17A is introduced. For example, the protecting member 17A is introduced into the slits 15*e* and 19*f* facing each other in the height direction. Consequently, the protecting member 17A is fixed to the upper rail portion 15 and the uppermost rail portion 19. Thus, the housed stored material P is fixed in the housing part S4, and would not fall over toward the temperature-kept part.

Embodiments 11 to 13 of One or More Embodiments of the Present Invention

Embodiments 11 to 13 of one or more embodiments of the present invention are related to a configuration of a heat storage material to be stored in any of the housing parts of the constant-temperature transport container in accordance with the foregoing Embodiments 1 to 10, more specifically to a connected body of heat storage material packages. Each of the connected bodies of the heat storage material packages in accordance with Embodiments 11 to 13 includes: at least two heat storage material packages connected to each other, each of the at least two heat storage material packages including a heat storage material and an outer case which is in the form of a rectangular parallelepiped and in which the heat storage material is to be housed, the at least two heat storage material packages being connected to each other in such a manner that the at least two heat storage material packages are foldable, via sides of side surfaces of the outer cases of the at least two heat storage material packages which sides are close to upper surfaces or lower surfaces of the at least two heat storage material packages, such that the side surfaces of the outer cases of the at least two heat storage material packages are in contact with each other.

Here, since the connected body disclosed in Patent Literature 6 is configured such that the heat storage materials are housed in the storage pockets in the belt-like sheet, this connected body can hardly stand alone. Thus, there is room for improvement in the workability of packing. Further, the number of storage pockets is set in advance, and therefore it is difficult to increase or decrease the number of heat storage materials as necessary.

Meanwhile, since the connected body disclosed in Patent Literature 7 is configured such that the highly rigid cold storage plates are directly connected to each other via the hinges, it is difficult to change the sizes of the plates. Generally, in the temperature adjustment of a heat storage material, it is difficult to use a large-size heat storage material due to restriction of the size of a thermostatic bath or a freezer.

In view of this, the techniques disclosed in Patent Literatures 6 and 7 have room for improvement in use of the connected body of the heat storage material packages.

Embodiments 11 to 13 of one or more embodiments of the present invention are to provide, in addition to the effects of the foregoing Embodiments 1 to 10, a connected body of heat storage material packages that are excellent in the workability of temperature adjustment and packing.

Embodiment 11

Figure 16:
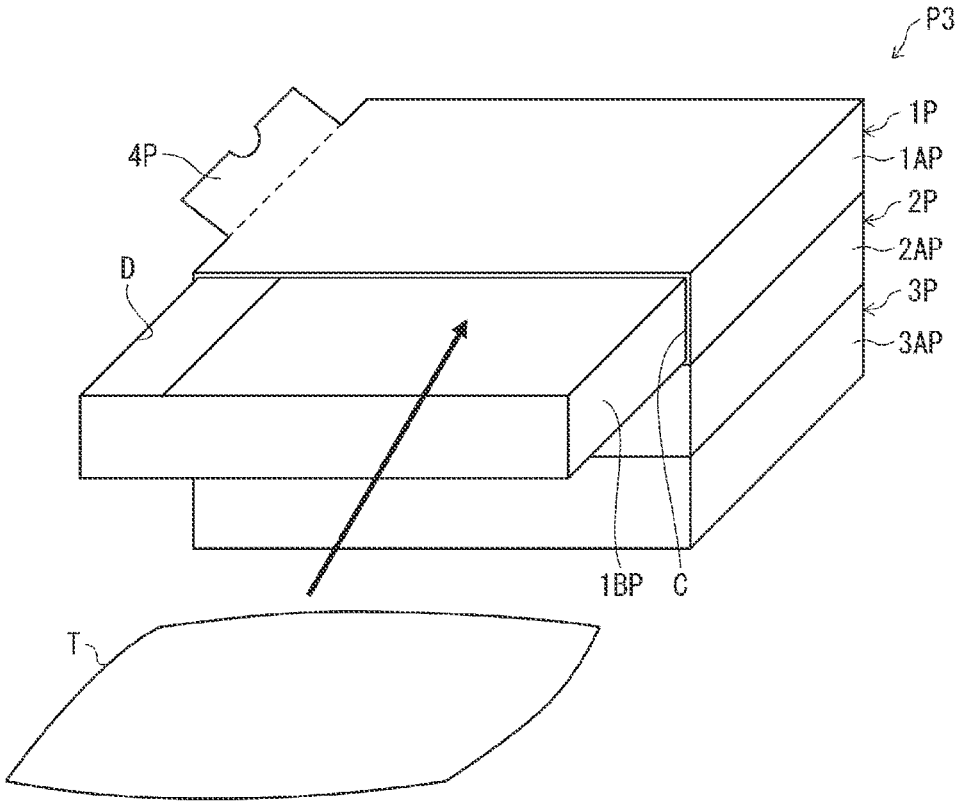
FIG. 16 is a perspective view illustrating a configuration of a connected body of heat storage material packages in accordance with Embodiment 11 of one or more embodiments of the present invention and a heat storage material provided to the connected body, the connected body being in a folded state.
Figure 17:
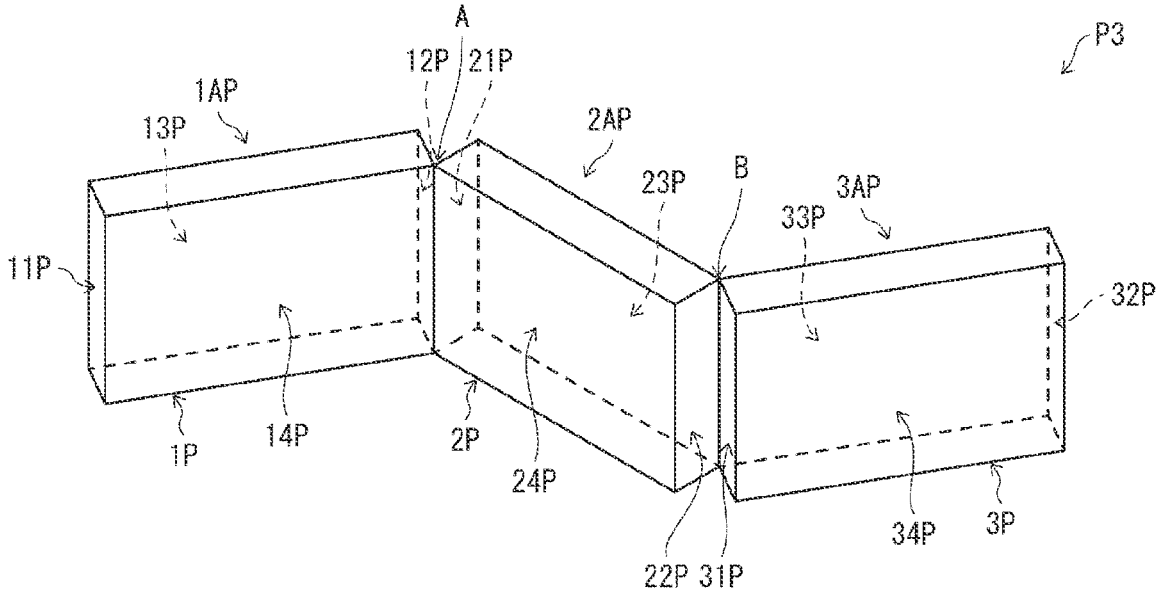
FIG. 17 is a perspective view of the connected body in accordance with Embodiment 11 of one or more embodiments of the present invention, the connected body being unfolded and bent.
Figure 18A:
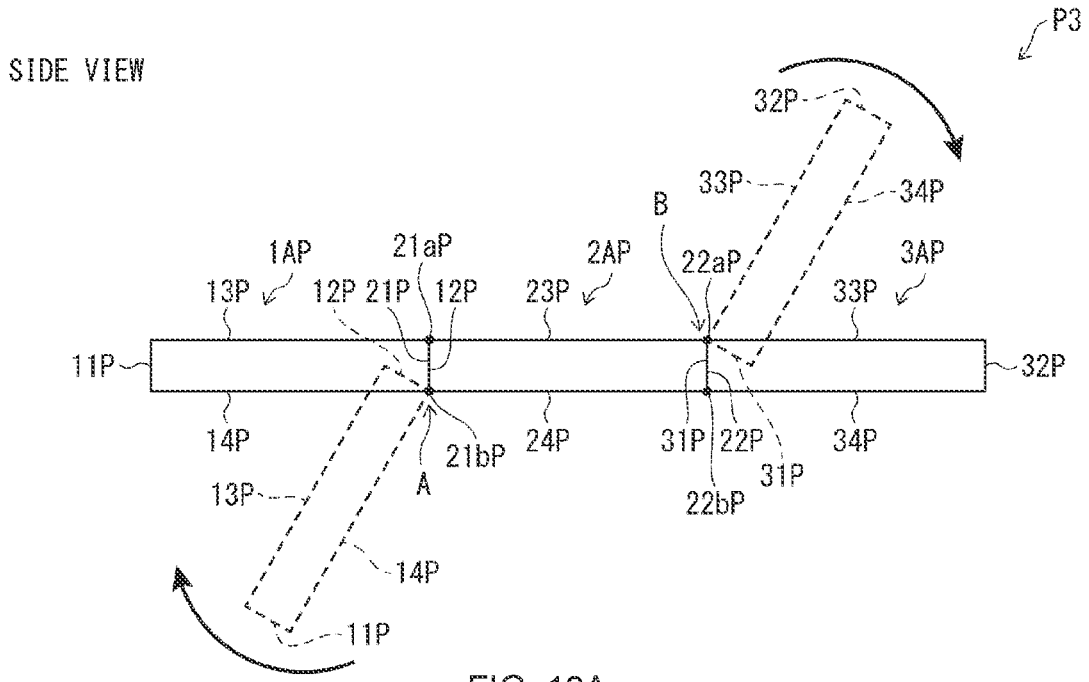
FIGS. 18A-C show a side view, a top view, and a bottom view of the connected body in accordance with Embodiment 11 of one or more embodiments of the present invention, the connected body being unfolded so as to be flat.
Figure 18B:
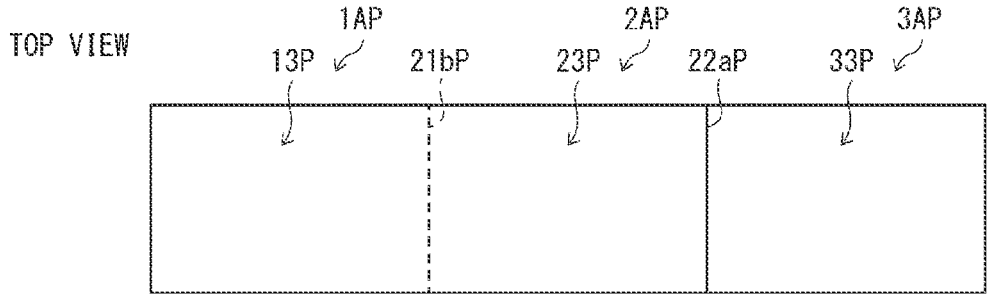
Figure 18C:
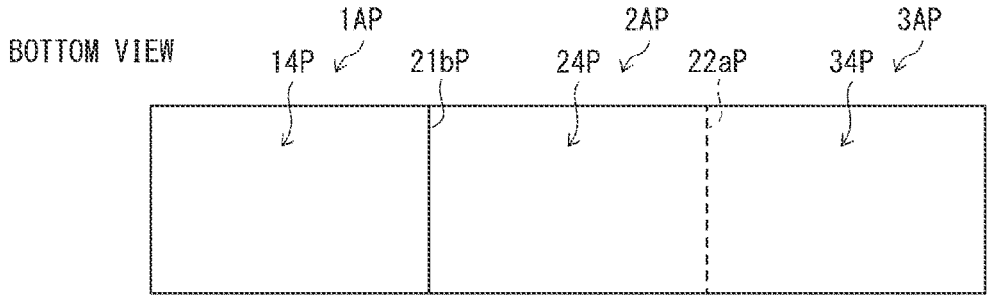

FIG. 16 is a perspective view illustrating a configuration of a connected body P3 of heat storage material packages in accordance with one or more embodiments and a heat storage material T provided to the connected body P3, the connected body P3 being in a folded state. FIG. 17 is a perspective view of the connected body P3 which is unfolded and bent. FIGS. 18A-C show a side view, a top view, and a bottom view of the connected body P3 which is unfolded so that the connected body P3 becomes flat.

As shown in FIGS. 16 to 18A-C, the connected body P3 in accordance with one or more embodiments includes heat storage material packages 1P to 3P connected to each other. The connected body P3 shown in FIGS. 16 to 18A-C is constituted by the three heat storage material packages 1P to 3P that are connected to each other. However, in the connected body P3 in accordance with one or more embodiments, the number of heat storage material packages connected to each other is not limited to three, and can be set as appropriate in accordance with the configuration of the connected body P3.

Here, the direction in which the heat storage material packages 1P to 3P are connected to each other is defined as a "front-rear direction". Further, in the direction of connection of the connected body P3, a side close to the heat storage material package 1P is defined as a "front side", and a side close to the heat storage material package 3P is defined as a "rear side". In the present disclosure, an "up-down direction" and a "left-right direction" (which may also be referred to as a "lateral" side) are defined on the basis of the front-rear direction. An upper side and a lower side are defined on the basis of the side view in FIG. 18A, which illustrates a state in which the connected body P3 is unfolded so that the connected body P3 becomes flat. That is, the upper side and the lower side in the side view in FIG. 18A are defined as an "upper side" and a "lower side" in the present disclosure.

The heat storage material packages 1P to 3P are structure as follows. For example, the heat storage material packages 1P to 3P respectively include heat storage materials T and outer cases 1AP to 3AP in which the heat storage materials T are housed. The outer cases 1AP to 3AP are boxes made of rectangular parallelepipeds having the same size. The outer case 1AP includes a drawer portion 1BP constituting a housing space of the heat storage material T and a box main body. The box main body has an opening C in its lateral side. The drawer portion 1BP has an opening in its upper part. By inserting the drawer portion 1BP through the opening C in the lateral side of the box main body, the drawer portion 1BP is housed in the box main body. By laterally pulling the drawer portion 1BP out from the box main body, an opening D in the upper part of the drawer portion 1BP is exposed. Through the opening D, the heat storage material T is housed in the drawer portion 1BP. The outer cases 2AP and 3AP are identical in configuration to the outer case 1AP, and therefore a description of the configurations of the outer cases 2AP and 3AP is omitted.

Next, connection between the three heat storage material packages 1P to 3P in the connected body P3 will be described in more detail. As shown in FIGS. 16 to 18, the outer case 1AP has a front side surface 11P, a rear side surface 12P, an upper surface 13P, and a lower surface 14P. The outer case 2AP has a front side surface 21P, a rear side surface 22P, an upper surface 23P, and a lower surface 24P. Similarly, the outer case 3AP has a front side surface 31P, a rear side surface 32P, an upper surface 33P, and a lower surface 34P.

In the connected body P3, the outer case 1AP of the heat storage material package 1P and the outer case 2AP of the heat storage material package 2P are connected to each other in such a manner that the outer cases 1AP and 2AP are foldable via a connecting part A. Similarly, the outer case 2AP of the heat storage material package 2P and the outer case 3AP of the heat storage material package 3P are connected to each other foldably via a connecting part B. The heat storage material packages 1P to 3P are detachable from each other.

In the connected body P3, among the heat storage material packages 1P to 3P, at least two heat storage material packages 1P and 2P are connected to each other via the connecting part A such that a rear side surface 12P of the outer case 1AP and a front side surface 21P of the outer case 2AP are in contact with each other. Similarly, the heat storage material packages 2P and 3P are connected to each other via the connecting part B such that a rear side surface 22P of the outer case 2AP and a front side surface 31P of the outer case 3AP are in contact with each other.

Further, the heat storage material packages 1P and 2P are connected to each other via sides 21*b*P and 21*b*P of the rear side surface 12P and the front side surface 21P, the sides 21*b*P and 21*b*P being close to lower surfaces 14P and 24P of the heat storage material packages 1P and 2P. Similarly, the heat storage material packages 2P and 3P are connected to each other via the sides 22*a*P and 22*a*P of the rear side surface 22P and the front side surface 31P, the sides 22*a*P and 22*a*P being close to upper surfaces 23P and 33P of the heat storage material packages 2P and 3P. In other words, the connecting part A of the outer cases 1AP and 2AP foldably connects (i) the side 21*b*P of the rear side surface 12P of the outer case 1AP which side 21*b*P is close to the lower surface 14P and (ii) the side 21*b*P of the front side surface 21P of the outer case 2AP which side 21*b*P is close to the lower surface 24P to each other. Similarly, the connecting part B of the outer cases 2AP and 3AP connects (i) the side 22*a*P of the rear side surface 22P of the outer case 2AP which side 22*a*P is close to the upper surface 23P and (ii) the side 22*a*P of the front side surface 31P of the outer case 3AP which side 22*a*P is close to the upper surface 334P to each other.

In the connected body P3, the side 21*a*P of the rear side surface 12P of the outer case 1AP which side 21*a*P is close to the upper surface 13P and the side 21*a*P of the front side surface 21P of the heat storage material package 2P which side 21*a*P is close to the upper surface 23P are not connected to each other, and can be separated from each other. Similarly, the side 22*b*P of the rear side surface 22P of the outer case 2AP which side 22*b*P is close to the lower surface 24P and the side 22*b*P of the front side surface 31P of the outer case 3AP which side 22*b*P is close to the lower surface 24P are not connected to each other, and can be separated from each other.

Thus, the heat storage material package 1P turns, with respect to the heat storage material package 2P, about the side 21*b*P close to the lower surface 24P. In unfolding of the connected body P3, the heat storage material package 1P turns, with respect to the heat storage material package 2P, downward from a position where the lower surfaces 14P and 24P are in contact with each other. Then, the rear side surface 12P comes into contact with the front side surface 21P, whereby turning of the heat storage material package 1P is stopped. That is, in unfolding of the connected body P3, the heat storage material package 1P is turnable, with respect to the heat storage material package 2P, in a range in which an angle between the heat storage material package 1P and the heat storage material package 2P is within a range of 0° to 180°. Thus, in the connected body P3 in an unfolded state, turning of the heat storage material package 1P is stopped by the front side surface 21P. Thus, the heat storage material package 1P cannot turn to a position higher than the heat storage material package 2P. Meanwhile, in folding of the connected body P3, the heat storage material package 1P turns, with respect to the heat storage material package 2P, about the side 21*b*P close to the lower surface 24P. Then, the heat storage material package 1P is layered with respect to the heat storage material package 2P such that the lower surfaces 14P and 24P are in contact with each other.

Similarly, the heat storage material package 3P turns, with respect to the heat storage material package 2P, about the side 22*a*P close to the upper surface 23P. In unfolding of the connected body P3, the heat storage material package 3P turns, with respect to the heat storage material package 2P, upward from a position where the upper surfaces 33P and 23P are in contact with each other. Then, the front side surface 31P comes into contact with the rear side surface 22P, whereby turning of the heat storage material package 3P is stopped. That is, in unfolding of the connected body P3, the heat storage material package 3P is turnable, with respect to the heat storage material package 2P, in a range in which an angle between the heat storage material package 2P and the heat storage material package 3P is within a range of 0° to 180°. Thus, in the connected body P3 in an unfolded state, turning of the heat storage material package 3P is stopped by the rear side surface 22P. Thus, the heat storage material package 3P cannot turn to a position lower than the heat storage material package 2P. Meanwhile, in a state where the connected body P3 is in a folded state, the heat storage material package 3P turns, with respect to the heat storage material package 2P, about the side 22*a*P close to the upper surface 23P. Then, the heat storage material package 3P is layered with respect to the heat storage material package 2P such that the upper surfaces 33P and 23P are in contact with each other.

In the connected body P3 in accordance with one or more embodiments, in a state where the heat storage material packages 1P to 3P are unfolded so as to be flat without being bent, the heat storage material package 1P cannot turn to a position higher than the heat storage material package 2P and the heat storage material package 3P cannot turn to a position lower than the heat storage material package 2P. Thus, in a state where the heat storage material packages 1P to 3P are unfolded so as to be flat without being bent, the connected body P3 can maintain the flat state. Therefore, even in a case where the connected body P3 is placed such that the front-rear direction is perpendicular to the ground (such that the front side surface 11P of the connected body P3 is in contact with the ground), the connected body P3 can stand alone while the connected body P3 is maintained in the unfolded state. Each of the heat storage material packages 1P to 3P is a rectangular parallelepiped box. Thus, even when the connected body P3 is installed such that a side surface of the connected body P3 is in contact with the ground, the connected body P3 can stand alone while the connected body P3 is maintained in the unfolded state. Therefore, with one or more embodiments, it is possible to provide the connected body P3 of the heat storage material packages 1P to 3P configured on the basis of assumption that the connected body P3 is used to maintain the temperature of a temperature-keeping target article while the connected body P3 is in the flat unfolded state.

In the temperature adjustment of a heat storage material to be used for a constant-temperature transport container, large-size heat storage materials cannot be used due to restriction of the size of a thermostatic bath or a freezer. Meanwhile, if small-size heat storage materials are used, it is troublesome to carry out the temperature adjustment, since the temperature adjustment of the heat storage materials need to be carried out one by one. Further, if the small-size heat storage materials are used, it takes time to carry out setting, since the heat storage materials having been subjected to the temperature adjustment need to be set one by one in the constant-temperature transport container.

In the connected body P3 in accordance with one or more embodiments, the three heat storage material packages 1P to 3P are connected to each other, and the heat storage material package 2P has two connecting parts (the connecting parts A and B) via which the heat storage material package 2P is connected to the heat storage material packages 1P and 3P. Further, in the connected body P3, the heat storage material package 2P has (i) one connecting part B disposed in the side 22*a*P close to the upper surface 23P and (ii) the other connecting part A disposed in the side 21*b*P close to the lower surface 24P. With such a configuration, it is possible to fold the connected body P3 into a compact zigzag state in which the connected body P3 is folded forward and backward alternately. Therefore, in the state where the connected body P3 is folded, it is possible to carry out the temperature adjustment of the heat storage materials T in the heat storage material packages 1P to 3P in a thermostatic bath or a freezer. Thus, it is possible to carry out the temperature adjustment of the heat storage materials T in the heat storage material packages 1P to 3P without restriction of the size of the thermostatic bath or the freezer. Further, it is possible to set a plurality of small-size heat storage materials T in container, as a single connected body P3. This facilitates the work of setting the heat storage materials T in the constant-temperature transport container. Consequently, the time taken for the setting work of the heat storage materials T can be shortened. Therefore, in accordance with one or more embodiments, it is possible to provide the connected body P3 of the heat storage material packages 1P to 3P excellent in the workability of the temperature adjustment and the packing.

Further, with the connected body P3 in accordance with one or more embodiments, the heat storage material packages 1P to 3P are detachable from each other. Therefore, it is possible to freely adjust the number of heat storage material packages to be connected. Thus, with one or more embodiments, the degree of freedom is increased in designing the size of the connected body P3 in accordance with the constant-temperature transport container.

Note that, in the connected body P3 in accordance with one or more embodiments, the configuration of the heat storage material packages 1P to 3P is not limited to the configuration in which the heat storage material packages 1P to 3P are detachable from each other, and may be any configuration that allows the connected body P3 to be foldable via the connecting parts A and B. For example, the heat storage material packages 1P to 3P may be made foldable by, e.g., gummed tape applied to the sides 21*b*P and 22*a*P.

Further, in the connected body P3 in accordance with one or more embodiments, the heat storage material packages 1P to 3P are connected to each other in the front-rear direction. However, the direction in which the heat storage material packages 1P to 3P are connected to each other is not limited to the front-rear direction. The heat storage material packages 1P to 3P may be connected to each other in the front-rear direction or the left-right direction.

(Connecting Parts)

Figure 19:
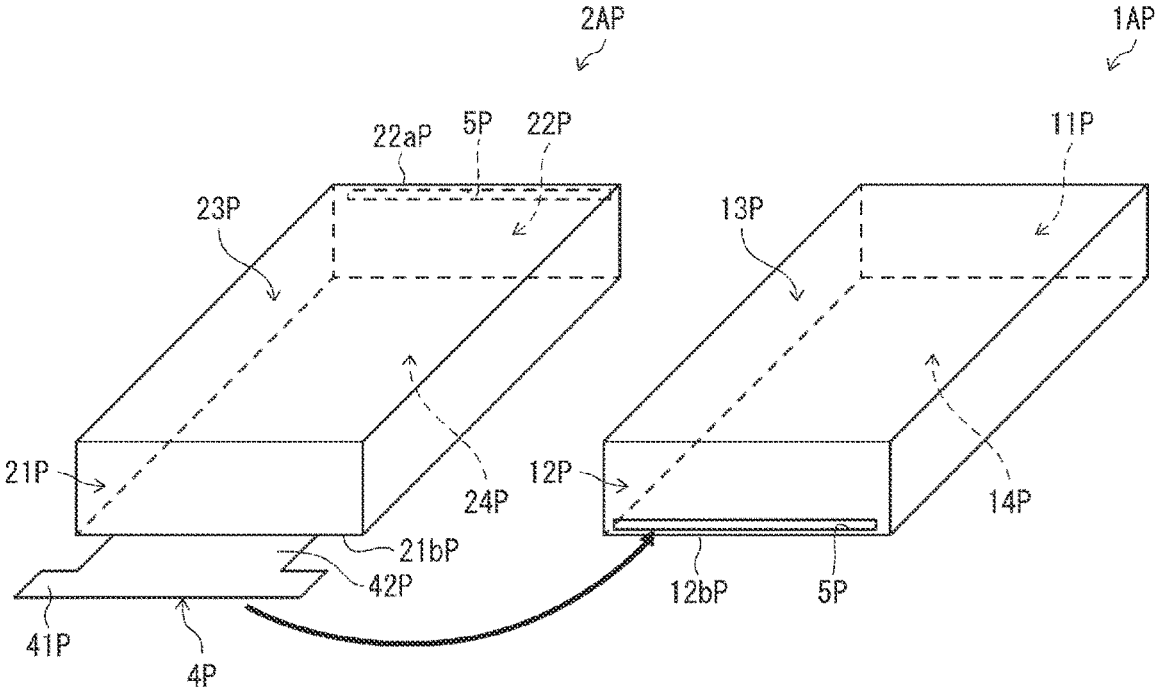
FIG. 19 is a perspective view illustrating one example of a connecting part of the connected body in accordance with Embodiment 11 of one or more embodiments of the present invention, and shows two outer cases that are separated from each other.

The following will give a description of the connecting parts A and B of the connected body P3. Note that the connecting part B is similar to the connecting part A, and therefore a description of the connecting part B is omitted. FIG. 19 is a perspective view illustrating one example of the connecting part A of the connected body P3, and shows the outer cases 1AP and 2AP that are separated from each other.

As shown in FIG. 19, the outer case 2AP has the front side surface 21P (first side surface) which is to be in contact with another outer case 1AP that is to be connected to the outer case 2AP and the rear side surface 22P (second side surface) facing the front side surface 21P. Similarly, the outer case 1AP has the rear side surface 12P which is to be in contact with another outer case 2AP that is to be connected to the outer case 1AP.

The side 21*b*P of the front side surface 21P of the outer case 2AP which side 21*b*P is close to the lower surface 24P is provided with a connecting member 4P. Meanwhile, the side 22*a*P of the rear side surface 22P which side 22*a*P is close to the upper surface 23P has a connecting opening 5P. The side 22*a*P having the connecting opening 5P corresponds to, among the side close to the upper surface 23P and the side close to the lower surface 24P of the rear side surface 22P, the side close to the upper surface 23P opposite to the side close to the lower surface 24P provided with the connecting member 4P.

Further, the side 12*b* of the rear side surface 12P of the outer case 1AP which side 12*b* is close to the lower surface 14P has a connecting opening 5P. Although not illustrated in the drawings, a side of the front side surface 11P of the outer case 1AP which side is close to the upper surface 13P has a connecting member 4P.

Further, although not illustrated in the drawings, the outer case 3AP of the heat storage material package 3P is configured similarly to the outer case 2AP. Specifically, a side of the front side surface 31P which side is close to the upper surface 33P has a connecting member 4P, and a side of the rear side surface 32P which side is close to the lower surface 34P has a connecting opening 5P.

When the outer cases 1AP to 3AP are placed such that the connecting members 4P are located on the lower side, the connecting openings 5P of all of the outer cases 1AP to 3AP are located on the upper side. That is, when the outer cases 1AP to 3AP are placed such that the connecting members 4P are located on the lower side, the outer cases 1AP to 3AP are identical in shape. In the connected body P3, the outer cases 1AP to 3AP are placed such that the connecting members 4P thereof are located alternately on the upper side and the lower side, and accordingly the connecting openings 5P thereof are also located alternately. With such a configuration, the connecting member 4P and the connecting opening 5P face each other in, among the side surfaces of the outer cases 1AP to 3AP, two side surfaces that are in contact with each other.

The connecting part A includes the above-described connecting member 4P and connecting opening 5P. In the outer case 2AP, the connecting member 4P is in the form of a sheet that is substantially flush with the lower surface 24P. Further, the connecting member 4P is configured to be bent at the side 21*b*P of the front side surface 21P which side 21*b*P is close to the lower surface 24P. With this, the connecting member 4P is turnable about the side 21*b*P. The connecting opening 5P is an opening into which the connecting member 4P can be inserted.

Here, the connecting opening 5P of the outer case 1AP is structured to be capable of being locked in a state where that connecting member 4P of another outer case 2AP is inserted into the connecting opening 5P. In the configuration shown in FIG. 19, the connecting member 4P has a wide portion 41P which is wide in a left-right direction and a narrow portion 42P which is narrow in the left-right direction. In the connecting member 4P, the narrow portion 42P and the wide portion 41P are arranged in this order along a direction extending from the side 21*b*P toward the front side. The width in the left-right direction of the wide portion 41P is smaller than the width in the left-right direction of the outer case 1AP and is larger than the width in the left-right direction of the connecting opening 5P. Meanwhile, the width in the left-right direction of the narrow portion 42P is smaller than the width in the left-right direction of the connecting opening 5P. Thus, when the connecting member 4P of the outer case 2AP is inserted into the connecting opening 5P of the outer case 1AP, the outer cases 1AP and 2AP are foldably connected to each other. Further, in this state, the wide portion 41P is locked by the connecting opening 5P, and therefore the connecting member 4P would not be separated from the connecting opening 5P. That is, the connecting opening 5P of the outer case 1AP is locked in the state where the connecting member 4P of another outer case 2AP is inserted into the connecting opening 5P.

In the configuration shown in FIG. 19, the outer case 2AP is configured such that the connecting member 4P is provided to the front side surface 21P and the connecting opening 5P is provided to the rear side surface 22P. In the connected body P3 in accordance with one or more embodiments, the connecting member 4P and the connecting opening 5P, which constitute the connecting part A, may be provided between the side surfaces (the rear side surface 12P and the front side surface 21P) of the outer cases 1AP and 2AP, the side surfaces being in contact with each other. For example, the outer case 2AP may be configured such that the connecting openings 5P are provided both to the front side surface 21P and the rear side surface 22P. In this case, the connecting member 4P is provided to the rear side surface 12P of the outer case 1AP.

As shown in FIG. 19, each of the outer cases 1AP to 3AP may be configured such that the connecting member 4P and the connecting opening 5P are provided to each of the front side surface and the rear side surface of the outer case. With this, the outer cases 1AP to 3AP can be configured to have the identical shapes, which makes it easier to produce the heat storage material packages 1P to 3P.

There is no particular limitation on the material of the outer cases 1AP to 3AP. However, from the viewpoint of ease of production, the material may be a foldable sheet material. Each of the outer cases 1AP to 3AP may be made of at least one selected from the group consisting of a cardboard, a corrugated cardboard, a corrugated plastic sheet, and a plastic sheet.

(Method for Cooling (Temperature Adjustment) of Connected Body P3)

Cooling (temperature adjustment) of the connected body P3 in accordance with one or more embodiments is carried out with the connected body P3 being in a folded state. That is, in the method for cooling the connected body P3 in accordance with one or more embodiments, the cooling is carried out in a state where the outer cases 1AP to 3AP of the heat storage material packages 1P to 3P are connected to each other and the heat storage materials T in the outer cases 1AP to 3AP connected to each other are not in contact with each other. For example, the connected body P3 folded so that the heat storage material packages 1P to 3P are layered is housed in the thermostatic bath or the freezer, so as to be cooled therein. With this, it is possible to cool the heat storage materials T in the heat storage material packages 1P to 3P without any restriction given by the size of the thermostatic bath or the freezer.

Note that there are spaces between (i) the outer cases 1AP to 3AP and (ii) the heat storage materials T housed in these outer cases. Thus, even in a state where the heat storage material packages 1P to 3P are layered, the heat storage materials T in the outer cases 1AP to 3AP are not in contact with each other. This provides better cooling efficiency, as compared to a case where heat storage materials T are simply layered such that the heat storage materials T are in contact with each other.

Furthermore, cooling the connected body P3 with the connected body P3 being not completely folded (with the connected body P3 being unfolded) further enhances the cooling efficiency of the heat storage materials T. For example, as shown in FIG. 17, the connected body P3 is unfolded so that the upper surface and the lower surface of adjacent ones of the outer cases 1AP to 3AP are spaced from each other without being in contact with each other. Cooling the connected body P3 with the connected body P3 in such an unfolded state further enhances the cooling efficiency of the heat storage materials T.

In the connected body P3 in accordance with one or more embodiments, the heat storage material T may have a transformable shape. Examples of such a heat storage material T include a film bag including a liquid or gel heat storage component or cold storage component sealed therein. Such a heat storage material T having a transformable shape cannot stand alone. To such a heat storage material T that cannot stand alone, the connected body P3 in accordance with one or more embodiments may be applied. This makes it possible to maintain a temperature-keeping target article at a constant temperature with the heat storage material T standing alone.

Embodiment 12

The following will provide a description of another embodiment of one or more embodiments of the present invention. For convenience, members having identical functions to those of the foregoing embodiment are given identical reference signs, and their descriptions will be omitted.

Figure 20:
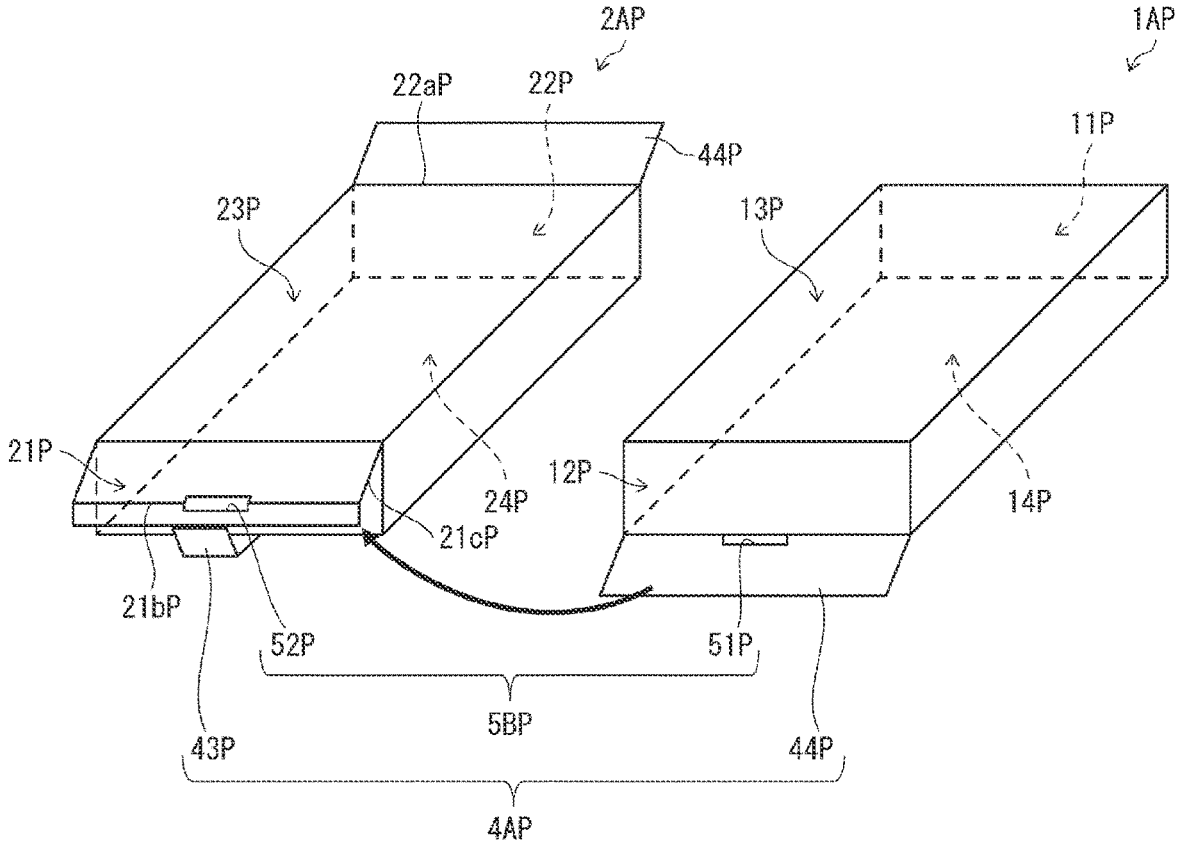
FIG. 20 is a perspective view illustrating one example of a connecting part of a connected body in accordance with Embodiment 12 of one or more embodiments of the present invention, and shows two outer cases that are separated from each other.
Figure 21:
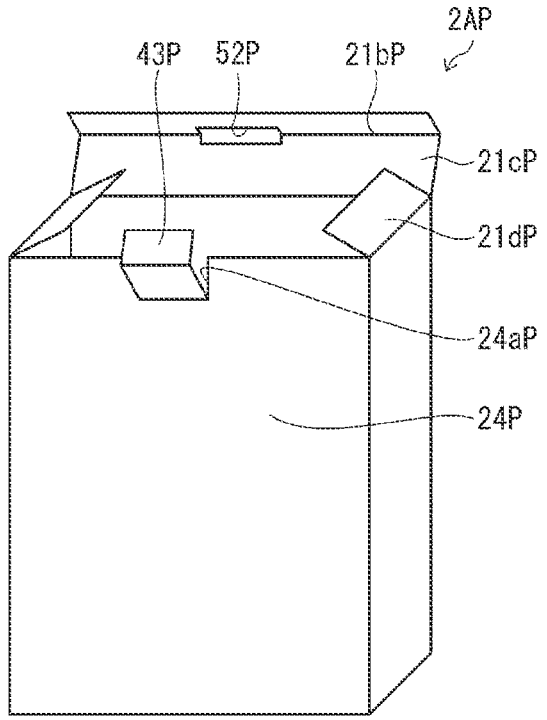
FIG. 21 is a perspective view of the outer case shown in FIG. 20 whose front side surface is unfolded.

FIG. 20 is a perspective view illustrating a configuration of a connecting part of a connected body in accordance with one or more embodiments, and shows outer cases 1AP and 2AP that are separated from each other. FIG. 21 is a perspective view of the outer case 2AP with its front side surface 21P being unfolded. As shown in FIGS. 20 and 21, the connected body in accordance with one or more embodiments differs from Embodiment 1 in configurations of a connecting member 4AP and a connecting opening 5BP.

The connecting member 4AP includes an insertion type tongue 43P provided to the front side surface 21P of the outer case 2AP and an insertion type tongue 44P provided to a rear side surface 12P of the outer case 1AP. The connecting opening 5BP includes an opening 51P provided to the rear side surface 12P of the outer case 1AP and an opening 52P provided to the front side surface 21P of the outer case 2AP.

As shown in FIG. 21, the front side surface 21P portion of the outer case 2AP is constituted by an outer flap 21*c*P and an inner flap 21*d*P. By inwardly folding the inner flap 21*d*P and then inwardly folding the outer flap 21*c*P so that the outer flap 21*c*P overlaps the inner flap 21*d*P, it is possible to form the front side surface 21P portion of the outer case 1AP.

Further, two slits 24*a*P extending in a front-rear direction are provided in a side of a lower surface 24P of the outer case 2AP which side is close to the front side surface 21P. The insertion type tongue 43P is a portion, formed by these two slits 24$a$P, which can be bent downward. When the insertion type tongue 43P is flat without being bent and is flush with the lower surface 24P, the insertion type tongue 43P protrudes from the side of the lower surface 24P which side is close to the front side surface 21P.

The outer flap 21$c$P constitutes the front side surface 21P. An opening 52P is provided in a portion of the outer flap 21$c$P which portion corresponds to the side 21$b$P of the lower surface 24P. The insertion type tongue 43P is introduced into the opening 52P. Thus, the insertion type tongue 43P and the opening 52P are disposed at locations where the insertion type tongue 43P and the opening 52P overlap each other in the left-right direction. By introducing the insertion type tongue 43P into the opening 52P, the outer flap 21$c$P is fixed so as not to be separated from the lower surface 24P.

Further, the insertion type tongue 44P protrudes and extends from a side of the rear side surface 12P of the outer case 1AP which side is close to the lower surface 14P. The insertion type tongue 44P is in the form of a quadrangular sheet whose width is substantially equal to a width in the left-right direction of the outer case 1AP. When the front side surface 21P portion of the outer case 2AP is formed by bending the outer flap 21$c$P and the inner flap 21$d$P, the insertion type tongue 44P is inserted between the outer flap 21$c$P and the lower surface 24P. Note that another insertion type tongue 44P is provided in a side 22$a$P of the rear side surface 22P of the outer case 2AP which side 22$a$P is close to the upper surface 23P.

The opening 51P has a size that allows the insertion type tongue 43P to be introduced into the opening 51P. When the front side surface 21P and the rear side surface 12P come into contact with each other, the openings 51P and 52P communicate with each other.

Next, the following will describe a method for connecting the outer cases 1AP and 2AP to each other. First, the outer flap 21$c$P and the inner flap 21$d$P are bent, so as to constitute the front side surface 21P portion of the outer case 2AP. Next, the insertion type tongue 44P is inserted between the outer flap 21$c$P and the lower surface 24P so that the openings 51P and 52P overlap each other. Then, the insertion type tongue 43P is introduced into both the openings 51P and 52P, so that the outer case 1AP is foldably connected to the side 21$b$P of the front side surface 21P of the outer case 2AP which side 21$b$P is close to the lower surface 24P.

Also with the connected body in accordance with one or more embodiments, it is possible to provide a connected body of heat storage material packages excellent in the workability in temperature adjustment and packing.

Embodiment 13

The following will provide a description of another embodiment of one or more embodiments of the present invention. For convenience, members having identical functions to those of the foregoing embodiment are given identical reference signs, and their descriptions will be omitted.

Figure 22:
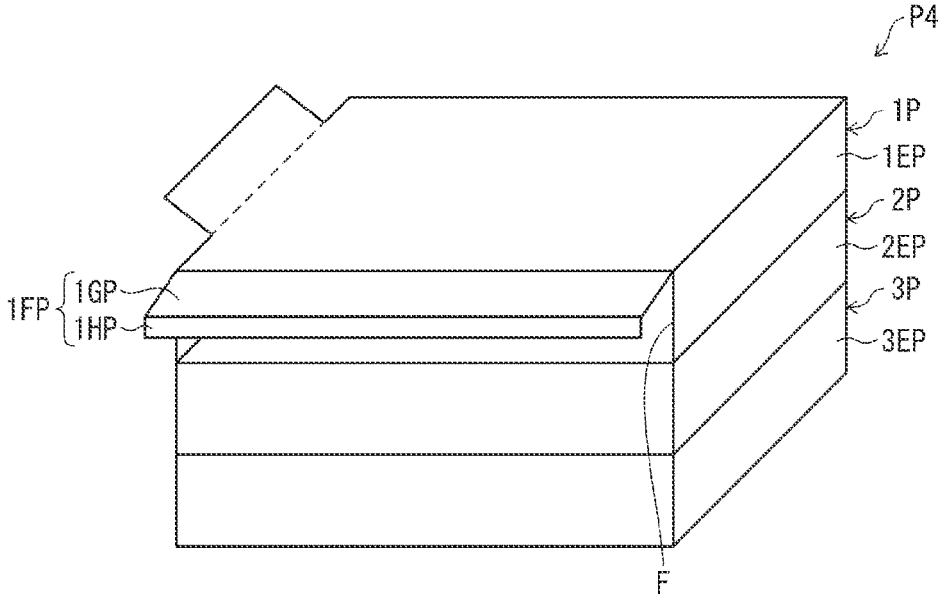
FIG. 22 is a perspective view illustrating a configuration of a connected body in accordance with Embodiment 13 of one or more embodiments of the present invention, the connected body being in a folded state.

FIG. 22 is a perspective view illustrating a configuration of a connected body P4 in accordance with one or more embodiments, the connected body being in a folded state. As shown in FIG. 22, the connected body P4 in accordance with one or more embodiments differs from Embodiment 1 in configurations of outer cases 1EP to 3EP.

The outer cases 1EP to 3EP are boxes in the form of rectangular parallelepipeds having the same size. The outer case 1EP has an opening F in its lateral side. Through the opening F, a heat storage material T is housed in a box main body of the outer case 1EP. Then, the outer case 1EP has a flaP1FP configured to close the opening F. The flaP1FP has a turning portion 1GP which is turnable about a side of the upper surface and a fin portion 1HP. The turning portion 1GP is substantially identical in size to the opening F, and is configured to close the opening F. The fin portion 1G is connected to the turning portion 1GP, and can be bent at an end of the turning portion 1GP.

According to the outer case 1EP, the fin portion 1HP is inserted into the opening F so as to be housed in the box main body. Consequently, the flaP1FP closes the opening F. Further, by laterally pulling the fin portion 1HP out from the box main body of the outer case 1EP, the turning portion 1GP turns, so that the opening F is exposed. Note that the outer cases 2EP and 3EP are similar in configuration to the outer case 1EP, and therefore a description of the outer cases 2EP and 3EP is omitted.

Also with the connected body P4 in accordance with one or more embodiments, it is possible to provide a connected body of heat storage material packages excellent in the workability in temperature adjustment and packing.

Figure 23:
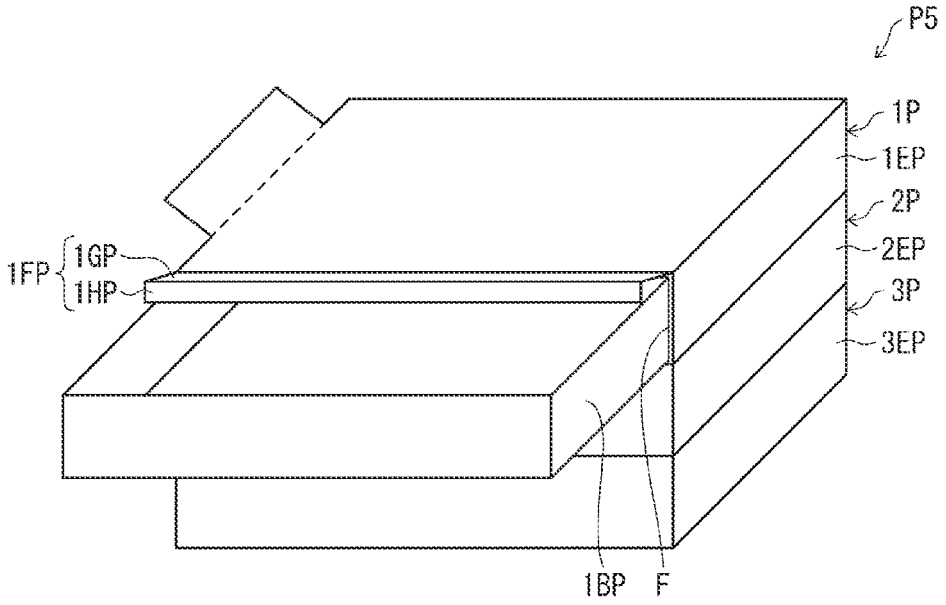
FIG. 23 is a perspective view illustrating a variation of the connected body in accordance with Embodiment 13 of one or more embodiments of the present invention, the connected body being in a folded state.

Note that the connected body P4 in accordance with one or more embodiments is not limited to the configuration in which a heat storage material T is solely housed in each of the openings F of the outer cases 1EP to 3EP. In each of the openings F of the outer cases 1EP to 3EP, the heat storage material T and a container-like member may be housed. The container-like member is configured to house the heat storage material T therein and to be housed in the box main body of any of the outer cases 1E to 3EP through the opening F thereof. For example, the container-like member may be the drawer portion 1BP shown in FIG. 16. The connected body P5 shown in FIG. 23 is configured such that the drawer portion 1BP is housed in the opening F shown in FIG. 22.

(Constant-Temperature Transport Container to which Connected Body of Heat Storage Material Packages is Applicable)

Figure 24:
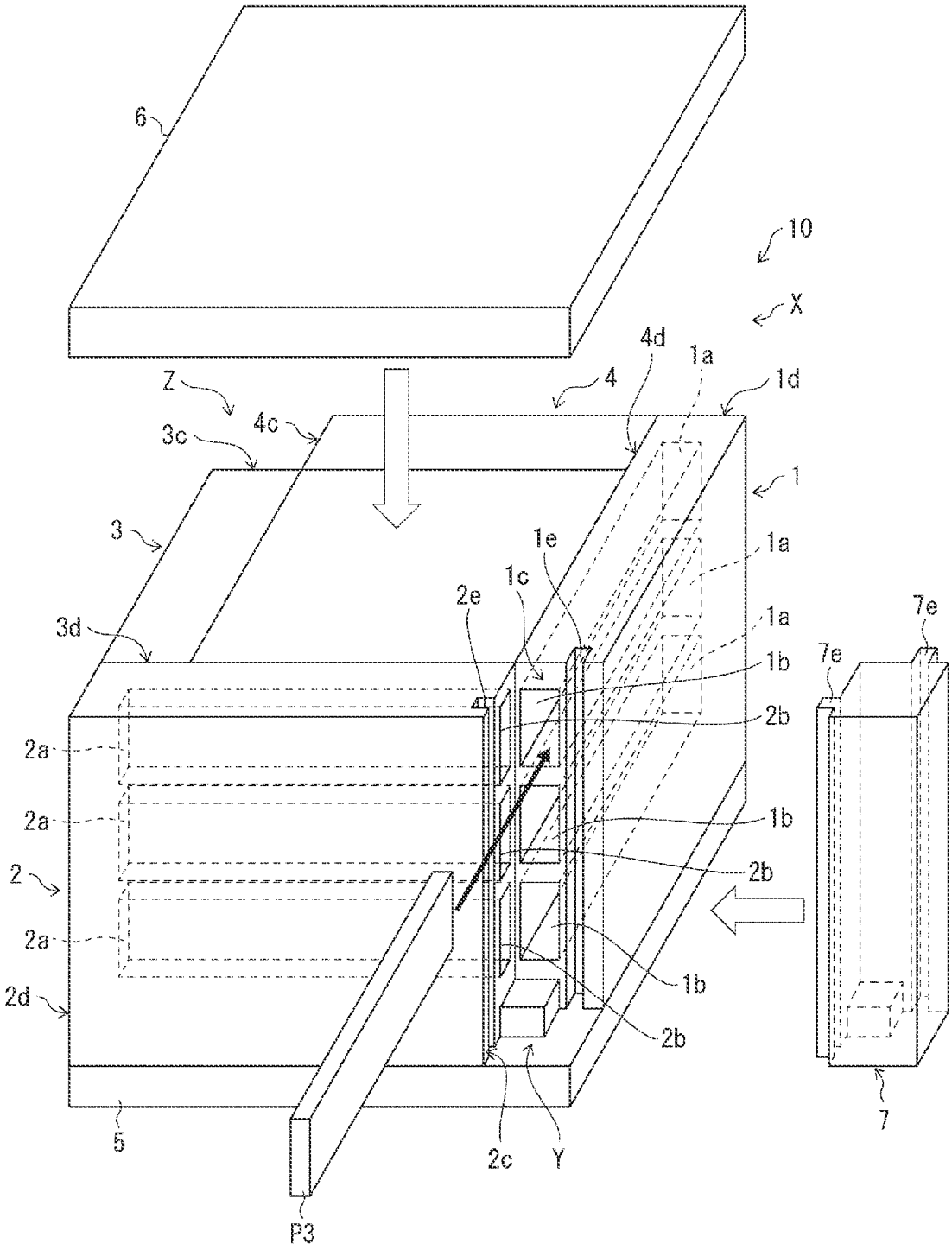
FIG. 24 is an exploded perspective view schematically illustrating a case where any of the connected bodies in accordance with Embodiments 11 to 13 is applied to the constant-temperature transport container in accordance with Embodiment 1.

There is no particular limitation on a constant-temperature transport container to which the connected bodies in accordance with the foregoing Embodiments 11 to 13 are applicable, provided that the constant-temperature transport container is usable with the connected body of the heat storage material packages standing alone. Examples of such a constant-temperature transport container include a constant-temperature transport container in which the connected body P3 in a flat unfolded state is placed longitudinally (i.e., placed such that the front-rear direction of the connected body P3 coincides with the vertical direction). Alternatively, the connected bodies in accordance with the foregoing Embodiments 11 to 13 are applicable also to a constant-temperature transport container in which the connected body P3 in a flat unfolded state is placed laterally (i.e., placed such that the front-rear direction of the connected body P3 coincides with the horizontal direction). For example, as shown in FIG. 24, the connected body P3 in accordance with Embodiment 11 is applicable to the constant-temperature transport container 10 in accordance with Embodiment 1.

One or more embodiments of the present invention are not limited to the embodiments, but can be altered by a skilled person in the art within the scope of the claims. One or more embodiments of the present invention also encompass, in its technical scope, any embodiment derived by combining technical means disclosed in differing embodiments. Further, it is possible to form a new technical feature by combining the technical means disclosed in the respective embodiments.

Aspects of one or more embodiments of the present invention can also be expressed as follows:

A constant-temperature transport container 10 in accordance with aspect 1 of one or more embodiments of the present invention is a constant-temperature transport container 10 that is assembled and that keeps a temperature of a temperature-keeping target article at a constant temperature, the constant-temperature transport container including: four side wall panels 1 to 4; a ceiling panel 6; and a bottom panel 5, each of the four side wall panels 1 to 4 including at least one first housing part (housing parts 1*a*, 2*a*) within which a heat storage material (stored material P1, P2) is to be housed and a first insertion opening (insertion opening 1*b*, 2*b*) which is provided in a side surface 1*c*, 2*c* of the side wall panel and through which the heat storage material (storage parts 1*a*, 2*a*) is to be inserted into the first housing part, the four side wall panels 1 to 4 being configured such that: the four side wall panels 1 to 4 form first insertion corners (insertion corners Y and Z) for the heat storage materials (stored materials P1, P2), each of the four side wall panels 1 to 4 being formed by the side surfaces 1*c* and 2*c*, each provided with the first insertion opening, of two side wall panels among the four side wall panels, the side surfaces of the two side wall panels being arranged adjacent to each other with the first insertion openings being exposed to an outside; the number of first insertion corners is two, and the two first insertion corners are formed to face each other; the side wall panels 1 to 4 are connected to each other via side surfaces 1*d* to 4*d* of the side wall panels which side surfaces are opposite to the two first insertion corners; and each of the two first insertion corners is provided with a first fitting corner (fitting corner 7) configured to close the insertion openings 1*b* and 2*b* and to be fitted to the side surfaces 1*c* and 2*c* provided with the insertion openings 1*b* and 2*b*.

A constant-temperature transport container 10 in accordance with aspect 2 of one or more embodiments of the present invention is configured such that, in aspect 1, the side surface 1*c*, 2*c* of each of the four side wall panels which side surface 1*c*, 2*c* is provided with the first insertion opening (insertion opening 1*b*, 2*b*) has a fitting recess 1*e*, 2*e* configured to be fitted to a corresponding one of the two first fitting corners (fitting corner 7); and each of the two first fitting corners is provided with fitting projections configured to be fitted to the fitting recesses 1*e*, 2*e*.

A constant-temperature transport container 10A in accordance with aspect 3 of one or more embodiments of the present invention is configured such that, in aspect 1 or 2, each of the two first fitting corners (fitting corners 7A) is constituted by a plurality of members 71 to 73 that are assembled.

A constant-temperature transport container 10B in accordance with aspect 4 of one or more embodiments of the present invention is configured such that, in any one of aspects 1 to 3, each of the two first fitting corners (fitting corners 7B) is configured to be inserted for fitting from a side of a side surface of the constant-temperature transport container 10B.

A constant-temperature transport container 10E in accordance with aspect 5 of one or more embodiments of the present invention is configured such that, in any one of aspects 1 to 4, the ceiling panel 6 includes a second housing part (storage part 6*a*) within which a heat storage material is to be housed and a second insertion opening (insertion opening 6*a*) which is provided in at least one side surface 6*f* of the ceiling panel 6 and through which the heat storage material is to be inserted into the second housing part, a second insertion corner is formed by (i) the at least one side surface 6*f*, provided with the second insertion opening, of the ceiling panel 6 and (ii) an upper surface 2*g* of the side wall panel 2 which is adjacent to the at least one side surface 6*f*, with the second insertion opening being exposed to an outside; and the second insertion corner is provided with a second fitting corner (fitting corner 8) configured to close the second insertion opening and to be fitted to at least one of (i) the at least one side surface 2*g*, provided with the second insertion opening, of the ceiling panel 6 and (ii) the upper surface 2*g* of the side wall panel 2.

A constant-temperature transport container 10F in accordance with aspect 6 of one or more embodiments of the present invention is configured such that, in any one of aspects 1 to 5, the at least one first housing part includes a plurality of first housing parts S1 to S3 aligned in an up-down direction; and adjacent ones, in the up-down direction, of the plurality of first housing parts S1 to S3 have a communication hole 18 allowing the adjacent ones, in the up-down direction, of the plurality of first housing parts to communicate with each other.

A constant-temperature transport container 10F in accordance with aspect 7 of one or more embodiments of the present invention is configured such that, in aspect 6, the communication hole 18 extends in a thickness direction of a corresponding one (side wall panel 1) of the four side wall panel so as to allow the adjacent ones, in the up-down direction, of the plurality of first housing parts S1 to S3 to communicate with each other; and in the plurality of first housing parts S1 to S3 aligned in the up-down direction, (i) the communication hole 18 of the adjacent ones, in the up-down direction, of the plurality of first housing parts S1 to S3 to communicate with each other and (ii) another communication hole 18 of adjacent ones, in the up-down direction, of the plurality of first housing parts S1 to S3 to communicate with each other are arranged so as to overlap each other as viewed in the up-down direction.

A constant-temperature transport container in accordance with aspect 8 of one or more embodiments of the present invention is configured such that, in aspect 6 or 7, among the plurality of first housing parts S1 to S3 aligned in the up-down direction, a lowermost first housing part S1 has a through-hole 18*a* penetrating through a bottom wall (lower rail portion 13).

A constant-temperature transport container in accordance with aspect 9 of one or more embodiments of the present invention is configured such that, in any one of aspects 6 to 8, the heat storage material (stored material P1, P2) includes a first heat storage material (stored material P1) and a second heat storage material (stored material P2) having a melting temperature lower than that of the first heat storage material.

A constant-temperature transport container in accordance with aspect 10 of one or more embodiments of the present invention is configured such that, in aspect 9, a weight ratio between the first heat storage material and the second heat storage material (stored materials P1 and P2) is set such that, given a weight of the first heat storage material (stored material P1) is 1, a proportion of a weight of the second heat storage material (stored material P2) is not more than 1.5.

A constant-temperature transport container 10 in accordance with aspect 11 of one or more embodiments of the present invention is configured such that, in aspect any one of aspects 1 to 10, the heat storage material (stored material P1, P2) is a connected body including a plurality of heat storage materials connected to each other.

A constant-temperature transport container 10 in accordance with aspect 12 of one or more embodiments of the present invention is configured such that, in aspect any one of aspects 1 to 11, the heat storage material (stored material P1, P2) includes a plurality of heat storage materials having different melting temperature ranges.

A connected body P3 of heat storage material packages 1P to 3P in accordance with aspect 13 of one or more embodiments of the present invention is housed in a constant-temperature transport container recited in any one of aspects 1 to 12, the connected body P3 including: at least two heat storage material packages 1P to 3P connected to each other, each of the at least two heat storage material packages 1P to 3P including: a heat storage material T; and an outer case (1AP to 3AP) which is in a form of a rectangular parallelepiped and in which the heat storage material T is to be housed, the at least two heat storage material packages 1P to 3P being foldably connected to each other, via sides 21*b*P and 22*a*P of side surfaces (rear side surface 12P and front side surface 21P, rear side surface 22P and front side surface 31P) of the outer cases 1AP to 3AP of the at least two heat storage material packages 1P to 3P which sides 21*b*P and 22*a*P are close to upper surfaces 23P and 33P or lower surfaces 14P and 24P of the at least two heat storage material packages, such that the side surfaces of the outer cases of the at least two heat storage material packages are in contact with each other.

A connected body P3 of heat storage material packages 1P to 3P in accordance with aspect 14 of one or more embodiments of the present invention is configured such that, in aspect 13, the at least two heat storage material packages 1P to 3P includes three or more heat storage material packages 1P to 3P connected to each other: and one (heat storage material package 2P) of the three or more heat storage material packages 1P to 3P has two connecting parts A and B via which the one heat storage material package 2P is connected to other ones 1P and 3P of the three or more heat storage material packages 1P to 3P, one (connecting part B) of the two connecting parts being provided in a side 22*a*P of the one heat storage material package which side 22*a*P is close to an upper surface 23P of the one heat storage material package, the other (connecting part A) of the two connecting parts being provided in a side 21*b*P of the one heat storage material package which side 21*b*P is close to a lower surface 24P of the one heat storage material package.

A connected body P3 of heat storage material packages 1P to 3P in accordance with aspect 15 of one or more embodiments of the present invention is configured such that, in aspect 13 or 14, at least one (outer case 2AP) of the outer cases includes: a first side surface (front side surface 21P) which is in contact with a side surface of, among the outer cases, another outer 1AP case connected to the outer case 2AP; a second side surface (rear side surface 22P) facing the first side surface; a connecting member 4P provided to a side 21*b*P of the first side surface which side 21*b*P is close to an upper surface 23P or a lower surface 24P of the outer case; and a connecting member 4P provided to a side 21*b*P of the first side surface which side is close to an upper surface 23P or a lower surface 24P of the outer case; and a connecting opening 5P provided to a side 22*a*P of the second side surface which side is close to the upper surface 23P or the lower surface 24P of the outer case, the upper surface 23P or the lower surface 24P close to which the connecting opening 5P is provided being opposite to the upper surface 23P or the lower surface 24P close to which the connecting member 4P is provided, the connecting opening 5P being capable of being locked in a state where a connecting member 4P of another one (1AP) of the outer cases is inserted into the connecting opening 5P.

Other Configurations

A constant-temperature transport container in accordance with aspect 15 of one or more embodiments of the present invention is configured such that, in any of the foregoing constant-temperature transport containers, a plurality of heat storage materials (stored materials P1, P2) can be inserted into each of the housing parts S1 to S3.

A connected body P3 of heat storage material packages in accordance with aspect 16 of one or more embodiments of the present invention is configured such that, in any of the foregoing connected bodies, the heat storage material packages 1P to 3P are detachable from each other.

A connected body P3 of heat storage material packages in accordance with aspect 17 of one or more embodiments of the present invention is configured such that, in any of the foregoing connected bodies P3, each of the outer cases 1AP to 3AP is made of at least one selected from the group consisting of a cardboard, a corrugated cardboard, a corrugated plastic sheet, and a plastic sheet.

A connected body P3 of heat storage material packages in accordance with aspect 18 of one or more embodiments of the present invention is configured such that, in any of the foregoing connected bodies P3, the heat storage material T has a transformable shape.

A cooling method in accordance with aspect 19 of one or more embodiments of the present invention is a method for cooling any of the connected bodies P3, the method including carrying out the cooling in a state where the outer cases 1AP to 3AP of the heat storage material packages 1P to 3P are connected to each other and the heat storage materials T in the outer cases 1AP to 3AP connected to each other are not in contact with each other.

EXAMPLES

Example 1 and Comparative Examples 1 and 2

Assembling of Constant-Temperature Transport Container

Figure 25A:
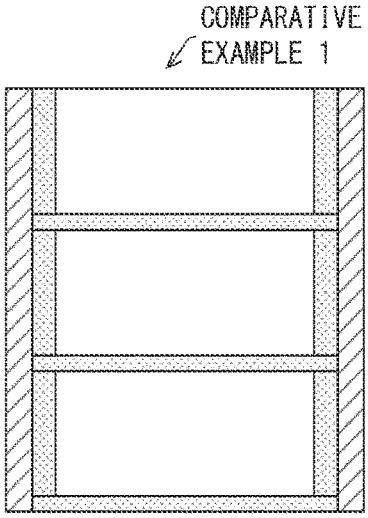
FIGS. 25A-C show front views respectively illustrating internal configurations of side wall panels included in constant-temperature transport containers of Example 1 and Comparative Examples 1 and 2, the front views being obtained when the side wall panels are seen from the inner sides.
Figure 25B:
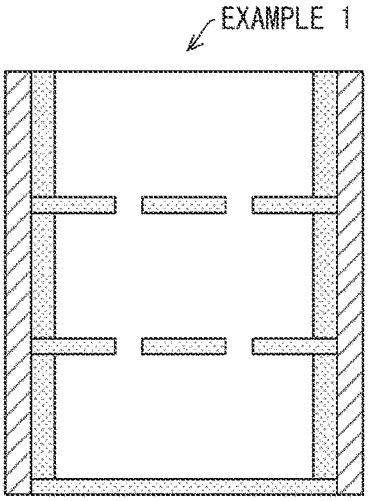
Figure 25C:
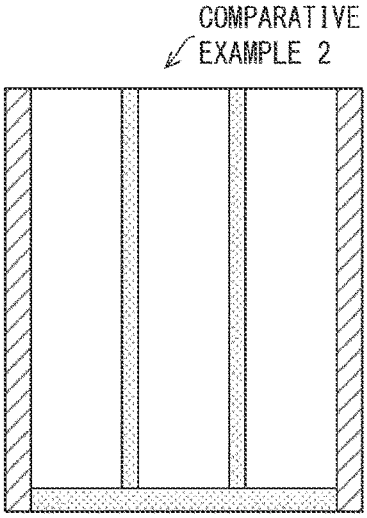

Side wall panels configured as in Example 1 and Comparative Examples 1 and 2 shown in FIGS. 25A-C were produced. The side wall panels of Example 1 were of a lateral-insertion-type. Similarly to the configuration shown in FIG. 9, adjacent ones, in an up-down direction, of housing parts for heat storage materials had communication holes allowing the adjacent ones of the housing parts to communicate with each other. Further, in the housing parts aligned in the up-down direction, the communication holes are arranged so as to overlap each other as viewed in the up-down direction. The side wall panels of Comparative Example 1 were of a lateral-insertion-type. Adjacent ones, in an up-down direction, of housing parts for heat storage materials did not have any communication hole allowing the adjacent ones of the housing parts to communicate with each other. The side wall panels of Comparative Example 2 were of a vertical-insertion-type.

Note that bottom panels 5 and ceiling panels 6 in Example 1 and Comparative Examples 1 and 2 were identical to each other.

In each of Example 1 and Comparative Examples 1 and 2, four side wall panels, a bottom panel, and a ceiling panel were assembled into a constant-temperature transport container. In each of the constant-temperature transport containers of Example 1 and Comparative Examples 1 and 2, a heat storage material was not housed in the bottom panel. In the ceiling panel, nine heat storage materials (grade: Kaneka latent heat storage material "PATTHERMO F5", 550 g)

having a melting temperature of 5° C., nine heat insulators (foamed polystyrene plates) having a thickness of 10 mm, and nine heat storage materials (grade: COLDICE OHG, 1000 g) having a melting temperature of 0° C. were housed in a layered state. Further, in each of the side wall panels, nine heat storage materials (grade: Kaneka latent heat storage material "PATTHERMO F5", 550 g) having a melting temperature of 5° C., nine heat insulators having a thickness of 10 mm, and eight heat storage materials (grade: COLDICE OHG, 750 g) having a melting temperature of 0° C. were housed in a layered state. In each of the housing parts of the side wall panels, three sets of the heat storage materials having a melting temperature of 5° C. and the heat storage materials having a melting temperature of 0° C. were housed. In a set of heat storage materials housed in the middle of the lowermost housing part, an empty box was set in place of the heat storage material having a melting temperature of 0° C.

Evaluation of Time in which Temperature was Maintained

For each of the constant-temperature transport containers of Example 1 and Comparative Examples 1 and 2, a time for which the temperature of the luggage space was maintained in a range of 2° C. to 8° C. was measured in an environment having an ambient temperature of 30° C. or −10° C. (in an environment of 30° C. or an environment of −10° C.). To be more specific, the temperatures were measured at certain two locations (an upper location at a middle portion and a lower location at a corner) of each of the luggage spaces of the constant-temperature transport containers of Example 1 and Comparative Examples 1 and 2. Then, based on the changes over time of these temperatures, the time for which the temperature was maintained in a range of 2° C. to 8° C. was evaluated.

Result

Table 1 below indicates the results of the evaluation of the time for which the temperature was maintained in a range of 2° C. to 8° C., the evaluation having been carried out for the constant-temperature transport containers of Example 1 and Comparative Examples 1 and 2.

TABLE 1

| | In environment of 30° C. [h:m] | In environment of −10° C. [h:m] |
|---|---|---|
| Example 1 | 93:25 | 56:15 |
| Comparative Example 1 | 72:35 | 52:10 |
| Comparative Example 2 | 86:30 | 51:05 |

As indicated in Table 1, in the environment of −10° C., the time for which the temperature was maintained in a range of 2° C. to 8° C. was almost the same among the constant-temperature transport containers of Example 1 and Comparative Examples 1 and 2.

Meanwhile, in the environment of 30° C., the time for which the temperature was maintained in a range of 2° C. to 8° C. was significantly different among the constant-temperature transport containers of Example 1 and Comparative Examples 1 and 2. First, comparison between Comparative Examples 1 and 2 indicates that, in the environment of 30° C., the time for which the temperature was maintained in a range of 2° C. to 8° C. of the lateral-insertion-type constant-temperature transport container (Comparative Example 1) tended to be shorter than that of the vertical-insertion-type constant-temperature transport container (Comparative Example 2). In spite of such a tendency, surprisingly, the time for which the temperature was maintained in a range of 2° C. to 8° C. of the lateral-insertion-type constant-temperature transport container with the communication holes of Example 1 was longer than that of the vertical-insertion-type constant-temperature transport container (Comparative Example 2).

Examples 2 and 3, Comparative Examples 3 and 4, and Reference Examples 1 and 2

Configurations of Constant-Temperature Transport Containers

Figure 26A:
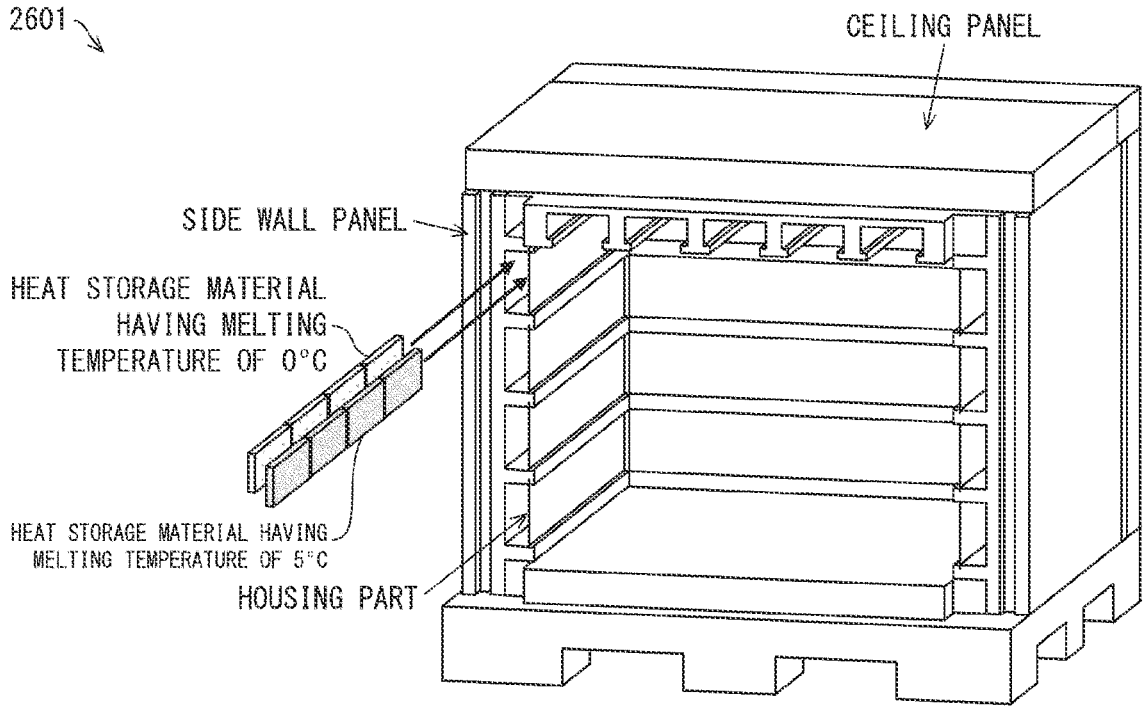
FIGS. 26A-C illustrate configurations of constant-temperature transport containers used in Examples 2 and 3, Comparative Examples 3 and 4, and Reference Examples 1 and 2.
Figure 26B:
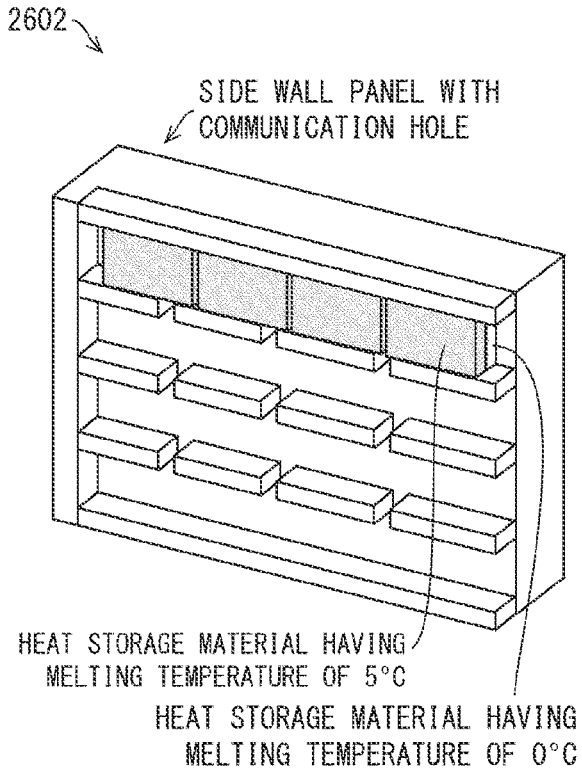
Figure 26C:
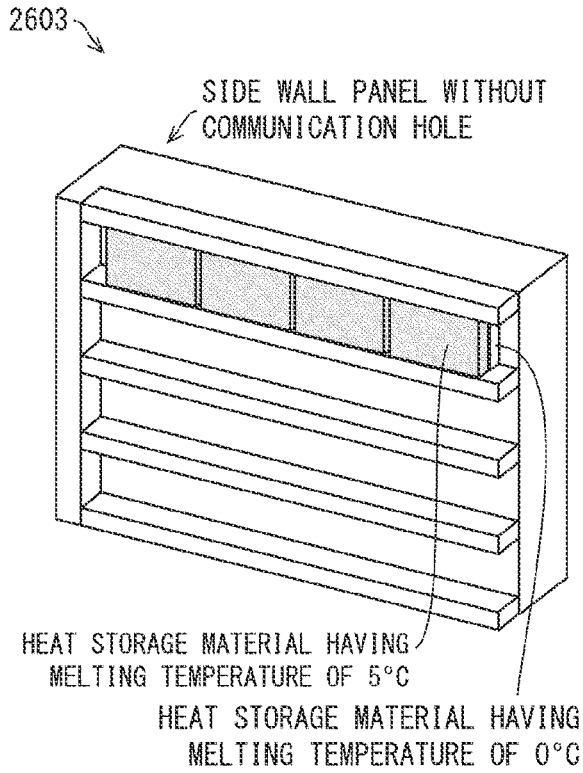

FIGS. 26A-C illustrate configurations of constant-temperature transport containers used in Examples 2 and 3, Comparative Examples 3 and 4, and Reference Examples 1 and 2. 2601 of FIG. 26A is a perspective view illustrating an internal configuration of each of the constant-temperature transport containers. 2602 of FIG. 26B is a perspective view illustrating a configuration of each of the side wall panels of the constant-temperature transport containers used in Examples 2 and 3 and Reference Example 1. 2603 of FIG. 26C is a perspective view illustrating a configuration of each of the side wall panels of the constant-temperature transport containers used in Comparative Examples 3 and 4 and Reference Example 2.

In the constant-temperature transport container shown in 2601 of FIG. 26A, four stages of housing parts are provided in each of four side wall panels. In each of the housing parts, a connected body (hereinafter, which may also be referred to as a "first connected body") of four heat storage materials (grade: Kaneka latent heat storage material "PATTHERMO F5") having a melting temperature of 5° C. and a connected body (hereinafter, which may also be referred to as a "second connected body") of four heat storage materials (grade: COLDICE OHG) having a melting temperature of 0° C. could be housed in a layered state. A ceiling panel had five rows of housing parts. In each of the housing parts, a connected body of five heat storage materials having a melting temperature of 5° C. and a connected body of five heat storage materials having a melting temperature of 0° C. could be housed in a layered state. In the constant-temperature transport container shown in 2601 of FIG. 26A, in each of the side wall panels, 16 heat storage materials having a melting temperature of 5° C. and 16 heat storage materials having a melting temperature of 0° C. could be housed. In the whole of the four side wall panels, 64 heat storage materials having a melting temperature of 5° C. and 64 heat storage materials having a melting temperature of 0° C. can be housed. In the ceiling panel, 25 heat storage materials having a melting temperature of 5° C. and 25 heat storage materials having a melting temperature of 0° C. could be housed. Thus, in the constant-temperature transport container, 89 heat storage materials having a melting temperature of 5° C. and 89 heat storage materials having a melting temperature of 0° C. can be housed. Note that the heat storage materials having a melting temperature of 5° C. and the heat storage materials having a melting temperature of 0° C. each had an outer case in which a main body of a heat storage material was housed.

Further, as shown in 2602 of FIG. 26B, in the constant-temperature transport containers used in Examples 2 and 3 and Reference Example 1, each side wall panel had three communication holes formed at equal intervals, the communication holes allowing the housing parts to communicate with each other. Meanwhile, as shown in 2603 of FIG. 26C, in the constant-temperature transport containers used in Comparative Examples 3 and 4 and Reference Example 2, the side wall panels had no communication hole allowing the housing parts to communicate with each other.

Evaluation of Time in which Temperature was Maintained

In an environment of 7Dsummer program, a time for which the temperature in the luggage space was maintained in a range of 2° C. to 8° C. was measured. 7Dsummer program intends a summer environment. According to this program, a 24-hour cycle of carrying out the following steps 1 to 4 in sequence is repeatedly carried out six times. SteP 1: An environment of 22° C. is maintained for four hours. Step 2: An environment of 35° C. is maintained for two hours. Step 3: An environment of 30° C. is maintained for 12 hours. Step 4: An environment of 35° C. is maintained for six hours.

The evaluation of the time for which the temperature was maintained was carried out in the following manner. Specifically, the temperatures were measured at certain six locations (an upper location, a middle location, and a lower location at a middle portion and an upper location, a middle location, and a lower location at a corner) of each of the luggage spaces of the constant-temperature transport containers. Then, based on the changes over time of these temperatures, the time for which the temperature was maintained in a range of 2° C. to 8° C. was evaluated.

Example 2

In each of the housing parts of the ceiling panel and the side wall panels of the constant-temperature transport containers shown in 2601 and 2602 of FIGS. 26A-B, the first connected body and the second connected body were housed in a layered state. The first connected body and the second connected body were layered such that the first connected body was located at an inner side of the housing part and the second connected body was located at an outer side of the housing part. Then, a cardboard was attached to the inside of the housing part so as to prevent the first connected body and the second connected body from falling over toward the inside of the luggage space. In this manner, each constant-temperature transport container was assembled. Then, each of the constant-temperature transport containers thus assembled was left until the temperature of the luggage space therein became not more than 8° C. Then, in an environment of 7Dsummer program, a time for which the temperature in the luggage space was maintained in a range of 2° C. to 8° C. was measured.

Each of the heat storage materials having a melting temperature of 5° C. used in Example 2 had a weight of 550 g. Thus, a total weight of the heat storage materials having a melting temperature of 5° C. housed in the constant-temperature transport container was 550 g×89 (pieces)=49.0 kg.

Meanwhile, regarding the heat storage materials having a melting temperature of 0° C. used in Example 2, (i) the heat storage materials housed in the housing parts of the ceiling panel and (ii) the heat storage materials housed in the side wall panels differ from each other in weight. In each of the housing parts of the ceiling panel, a heat storage material having a melting temperature of 0° C. and having a weight of 1000 g was housed. In each of the housing parts of the side wall panels, a heat storage material having a melting temperature of 0° C. and having a weight of 700 g was housed. Thus, a total weight of the heat storage materials having a melting temperature of 0° C. housed in the constant-temperature transport container was 1000 g×25 (pieces)+700 g×64 (pieces)=69.8 kg.

A weight ratio between the heat storage materials having a melting temperature of 5° C. and the heat storage materials having a melting temperature of 0° C. was as follows. The heat storage materials having a melting temperature of 5° C.: the heat storage materials having a melting temperature of 0° C.=1:1.4. Note that the outer case of each heat storage material having a melting temperature of 5° C. also included a foamed polystyrene plate having a thickness of 10 mm. The foamed polystyrene plate was interposed between the heat storage material having a melting temperature of 5° C. and the heat storage material having a melting temperature of 0° C.

Example 3

A time for which the temperature of a luggage space of a constant-temperature transport container was maintained in a range of 2° C. to 8° C. was measured in the same manner as that in Example 2 except that, in Example 3, heat storage materials having a melting temperature of 5° C. and not including a foamed polystyrene plate having a thickness of 10 mm were used and a different weight ratio between heat storage materials having a melting temperature of 5° C. and heat storage materials having a melting temperature of 0° C. was employed.

Each of the heat storage materials having a melting temperature of 5° C. used in Example 3 had a weight of 800 g. Thus, a total weight of the heat storage materials having a melting temperature of 5° C. housed in the constant-temperature transport container was 800 g×89 (pieces)=71.2 kg.

Meanwhile, the heat storage materials having a melting temperature of 0° C. used in Example 3 were identical in configuration to the heat storage materials of Example 1. Thus, a total weight of the heat storage materials having a melting temperature of 0° C. housed in the constant-temperature transport container was 1000 g×25 (pieces)+700 g×64 (pieces)=69.8 kg.

A weight ratio between the heat storage materials having a melting temperature of 5° C. and the heat storage materials having a melting temperature of 0° C. was as follows. The heat storage materials having a melting temperature of 5° C.: the heat storage materials having a melting temperature of 0° C.=1:1.

Comparative Example 3

A time for which the temperature of a luggage space of a constant-temperature transport container was maintained in a range of 2° C. to 8° C. was measured in the same manner as that in Example 2 except that, in Comparative Example 3, a first connected body and a second connected body were housed in a layered state in each of the housing parts of the ceiling panel and the side wall panels of the constant-temperature transport containers shown in 2601 and 2603 of FIGS. 26A and 26C.

Comparative Example 4

A time for which the temperature of a luggage space of a constant-temperature transport container was maintained in a range of 2° C. to 8° C. was measured in the same manner as that in Example 2 except that, in Comparative Example 4, heat storage materials having a melting temperature of 5° C. and not including a foamed polystyrene plate having a thickness of 10 mm were used and a first connected body and a second connected body were housed in a layered state in each of the housing parts of the ceiling panel and the side wall panels of the constant-temperature transport containers shown in 2601 and 2603 of FIGS. 26A and 26C.

Reference Example 1

A time for which the temperature of a luggage space of a constant-temperature transport container was maintained in a range of 2° C. to 8° C. was measured in the same manner as that in Example 2 except that, in Reference Example 1, a different weight ratio between heat storage materials having a melting temperature of 5° C. and heat storage materials having a melting temperature of 0° C. was employed.

Each of the heat storage materials having a melting temperature of 5° C. used in Reference Example 1 had a weight of 300 g. Thus, a total weight of the heat storage materials having a melting temperature of 5° C. housed in the constant-temperature transport container was 300 g×89 (pieces)=26.7 kg.

In Reference Example 1, in each of the housing parts of the ceiling panel and the side wall panels, a heat storage material having a melting temperature of 0° C. and having a weight of 1000 g was housed. Thus, a total weight of the heat storage materials having a melting temperature of 0° C. housed in the constant-temperature transport container was 1000 g×89 (pieces)=89.0 kg.

A weight ratio between the heat storage materials having a melting temperature of 5° C. and the heat storage materials having a melting temperature of 0° C. was as follows. The heat storage materials having a melting temperature of 5° C.: the heat storage materials having a melting temperature of 0° C.=1:3.3. Note that the outer case of each heat storage material having a melting temperature of 5° C. also included a foamed polystyrene plate having a thickness of 10 mm. The foamed polystyrene plate was interposed between the heat storage material having a melting temperature of 5° C. and the heat storage material having a melting temperature of 0° C.

Reference Example 2

A time for which the temperature of a luggage space of a constant-temperature transport container was maintained in a range of 2° C. to 8° C. was measured in the same manner as that in Comparative Example 5 except that, in Reference Example 2, a first connected body and a second connected body were housed in a layered state in each of the housing parts of the ceiling panel and the side wall panels of the constant-temperature transport containers shown in 2601 and 2603 of FIGS. 26A and 26C.

Result

Table 1 indicates the results of evaluation of the time for which the temperature was maintained in a range of 2° C. to 8° C., the evaluation having been carried out for the constant-temperature transport containers of Examples 2 and 3 and Comparative Examples 3 to 6.

TABLE 2

| | Total weight of HSM(*4) having melting temperature of 5° C. | Total weight of HSM having melting temperature of 0° C. | Weight ratio between HSM having melting temperature of 5° C. and HSM having melting temperature of 0° C. | Communication hole | Time taken until temperature becomes 8° C. or less | Time in which temperature is maintained in 2° C. to 8° C. |
|---|---|---|---|---|---|---|
| Ex. 2 (*1) | 49.0 kg | 69.8 kg | 1:1.4 | w/ | 45 min. | 111:30 |
| C. Ex. 3 (*2) | | | | w/o | 60 min. | 106:25 |
| Ex. 3 | 71.2 kg | 69.8 kg | 1:1 | w/ | 105 min. | 107:25 |
| C. Ex. 4 | | | | w/o | 140 min. | 96:30 |
| R. Ex. 1 (*3) | 26.7 kg | 89.0 kg | 1:3.3 | w/ | 20 min. | 134:40 |
| R. Ex. 2 | | | | w/o | 30 min. | More than 142:30 |

*1: "Ex." stands for "Example".
*2: "C. Ex." stands for "Comparative Example".
*3: "R. Ex." stands for "Reference Example".
*4: "HSM" stands for "heat storage material".

The evaluation of the time for which the temperature was maintained in a range of 2° C. to 8° C. indicated in Table 2 was based on the assumption that they were in a summer environment. In a case where the weight ratio between the heat storage materials having a melting temperature of 5° C.: the heat storage materials having a melting temperature of 0° C. was not more than 1:1.4, the time for which the temperature was maintained in a range of 2° C. to 8° C. was longer in the constant-temperature transport containers (Examples 2 and 3) including the side wall panels having the communication holes than that in the constant-temperature transport containers (Comparative Examples 3 and 4) including the side wall panels having no communication hole. Meanwhile, in a case where the weight ratio between the heat storage materials having a melting temperature of 5° C.: the heat storage materials having a melting temperature of 0° C. was more than 1:1.4, the time for which the temperature was maintained in a range of 2° C. to 8° C. was longer in the constant-temperature transport containers (Reference Example 2) including the side wall panels having no communication holes than that in the constant-temperature transport containers (Comparative Example 1) including the side wall panels having the communication holes. This shows that, in a summer environment, setting the weight ratio between the heat storage materials having a melting temperature of 5° C. and the heat storage materials having a melting temperature of 0° C. so that, given the weight of the heat storage materials having a melting temperature of 5° C. is 1, the proportion of the weight of the heat storage materials having a melting temperature of 0° C. is not more than 1.4 elongates the time for which the temperature is maintained in a range of 2° C. to 8° C.

It is considered that, for the weight ratio between the heat storage materials having a melting temperature of 5° C. and the heat storage materials having a melting temperature of 0° C., setting a too high proportion of the heat storage materials having a melting temperature of 0° C. causes the cold air of the heat storage materials having a melting temperature of 0° C. to be excessively supplied the heat storage materials having a melting temperature of 5° C. through the communication holes. Further, this causes consumption of the latent heat of the heat storage materials having a melting temperature of 0° C. more than necessary. This is considered to be a reason why the time for which the temperature was maintained in a range of 2° C. to 8° C. was longer in the constant-temperature transport container of Reference Example 2 than in the constant-temperature transport container of Reference Example 1.

Meanwhile, it is considered that, in the weight ratio between the heat storage materials having a melting temperature of 5° C. and the heat storage materials having a melting temperature of 0° C., setting a higher proportion of the heat storage materials having a melting temperature of 5° C. will promote stirring of the air through the communication holes, thereby making it possible to efficiently transmit, to the heat storage materials having a melting temperature of 5° C., the cold air of the heat storage materials having a melting temperature of 0° C. This is considered to be a reason why the time for which the temperature was maintained in a range of 2° C. to 8° C. was longer in the constant-temperature transport containers of Examples 2 and 3 than in the constant-temperature transport containers of Comparative Examples 3 and 4.

REFERENCE SIGNS LIST

1, 2, 3, 4: side wall panel
1*a*, 2*a*: storage part (first storage part)
1*b*, 2*b*: insertion opening (first insertion opening)
1*c*, 2*c*, 3*c*, 4*c*: side surface
1*d*, 2*d*, 3*d*, 4*d*: side surface
1*e*, 2*e*: fitting recess
2*f*: upper surface
5: bottom panel
6: ceiling panel
6*a*: storage part (second storage part)
6*b*: insertion opening (second insertion opening)
6*f*: side surface
7, 7A, 7B, 7C, 7D: fitting corner (first fitting corner)
7*e*, 71*e*, 72*e*, 73*e*, 75*e*, 76*e*, 77*e*, 79*e*: fitting projection
71, 72, 73, 74, 75, 76, 77, 78*a*, 78*b*, 79: member
8: fitting corner (second fitting corner)
8*f*: fitting projection
10, 10A, 10B, 10C, 10D, 10E, 10F: constant-temperature transport container
X, Y, Z: insertion corner (first insertion corner)
P1, P2: stored material (heat storage material)
13: lower rail portion (bottom wall of housing part located at lowermost position)
18: communication hole
18*a*: through-hole
B1, B2, B3: insertion opening
Sb, S2, S3, S4: housing part (first storage part)
1P, 2P, 3P: heat storage material package
1AP, 2AP, 3AP: outer case
1EP, 2EP, 3EP: outer case
1FP: flap
1GP: turning portion
1HP: fin portion
4P, 4AP: connecting member
5P, 5AP, 5BP: connecting opening
P3, P4, P5: connected body
11P, 21P, 31P: front side surface
12P, 22P, 32P: rear side surface
12*b*P, 21*a*P, 21*b*P, 22*a*P, 22*b*P: side
13P, 23P, 33P: upper surface
14P, 24P, 34P: lower surface Although the disclosure has been described with respect to only a limited number of embodiments, those skilled in the art, having benefit of this disclosure, will appreciate that various other embodiments may be devised without departing from the scope of the present disclosure. Accordingly, the scope of the disclosure should be limited only by the attached claims.

The invention claimed is:

1. A constant-temperature transport container that is assembled and that keeps a temperature of a temperature-keeping target article at a constant temperature, the constant-temperature transport container comprising:
- four side wall panels;
- a ceiling panel; and
- a bottom panel,
- wherein:
  - each of the four side wall panels includes:
    - at least one first housing part within which a heat storage material is to be housed, and
    - a first insertion opening provided on a side surface of the side wall panel through which the heat storage material is to be inserted into the first housing part,
  - the four side wall panels form first insertion corners for the heat storage materials;
  - each of the first insertion corners is formed by the side surfaces, each provided with the first insertion opening;
  - of two side wall panels among the four side wall panels, the side surfaces of the two side wall panels are arranged adjacent to each other with the first insertion openings being exposed to an outside;
  - a number of the first insertion corners is two, and the two first insertion corners are formed at diagonally opposite corners of the constant-temperature transport container;
  - the side wall panels are connected to each other via side surfaces of the side wall panels which side surfaces are opposite to the two first insertion corners; and
  - each of the two first insertion corners is provided with a first fitting corner configured to close the first insertion openings and to be fitted to the side surfaces provided with the first insertion openings.

2. The constant-temperature transport container as set forth in claim 1, wherein:
- the side surface of each of the four side wall panels which is provided with the first insertion opening has a fitting recess configured to be fitted to a corresponding one of the two first fitting corners; and
- each of the two first fitting corners is provided with fitting projections configured to be fitted to the fitting recesses.

3. The constant-temperature transport container as set forth in claim 1, wherein:
- each of the two first fitting corners is constituted by a plurality of members that are assembled.

4. The constant-temperature transport container as set forth in claim 1, wherein:
- each of the two first fitting corners is configured to be inserted for fitting from a side of a side surface of the side wall panels.

5. The constant-temperature transport container as set forth in claim 1, wherein:

the ceiling panel includes:

a second housing part within which a heat storage material is to be housed; and a second insertion opening which is provided in at least one side surface of the ceiling panel through which the heat storage material is to be inserted into the second housing part, a second insertion corner is formed by (i) the at least one side surface, provided with the second insertion opening, of the ceiling panel and (ii) an upper surface of one of the four side wall panels which is adjacent to the at least one side surface, with the second insertion opening being exposed to an outside; and the second insertion corner is provided with a second fitting corner configured to close the second insertion opening and to be fitted to at least one of (i) the at least one side surface, provided with the second insertion opening, of the ceiling panel and (ii) the upper surface of the one of the four side wall panels.

6. The constant-temperature transport container as set forth in claim 1, wherein:

the at least one first housing part comprises a plurality of first housing parts aligned in an up-down direction, and adjacent ones of the plurality of first housing parts, in the up-down direction, have a communication hole allowing the adjacent ones of the plurality of first housing parts, in the up-down direction, to communicate with each other.

7. The constant-temperature transport container as set forth in claim 6, wherein:

the communication hole extends in a thickness direction of a corresponding one of the four side wall panels to allow the adjacent ones of the plurality of first housing parts, in the up-down direction, to communicate with each other; and in the plurality of first housing parts aligned in the up-down direction, (i) the communication hole of the adjacent ones of the plurality of first housing parts, in the up-down direction, and (ii) another communication hole of adjacent ones of the plurality of first housing parts in the up-down direction, are arranged so as to overlap each other as viewed in the up-down direction.

8. The constant-temperature transport container as set forth in claim 6, wherein:

among the plurality of first housing parts aligned in the up-down direction, a lowermost first housing part has a through-hole penetrating through a bottom wall.

9. The constant-temperature transport container as set forth in claim 6, wherein:

the heat storage material includes a first heat storage material and a second heat storage material having a melting temperature lower than that of the first heat storage material.

10. The constant-temperature transport container as set forth in claim 9, wherein:

a weight ratio between the first heat storage material and the second heat storage material is set such that, given a weight of the first heat storage material is 1, a proportion of a weight of the second heat storage material is not more than 1.5.

11. The constant-temperature transport container as set forth in claim 1, wherein:

the heat storage material is a connected body including a plurality of heat storage materials connected to each other.

12. The constant-temperature transport container as set forth in claim 1, wherein:

the heat storage material includes a plurality of heat storage materials having different melting temperature ranges.

* * * * *